US009991640B2

(12) United States Patent
Tziviskos et al.

(10) Patent No.: US 9,991,640 B2
(45) Date of Patent: Jun. 5, 2018

(54) DURABLE CONNECTOR RECEPTACLES

(71) Applicant: Apple Inc., Cupertino, CA (US)

(72) Inventors: George Tziviskos, Cupertino, CA (US); Jae Hwang Lee, San Jose, CA (US); Mahmoud R. Amini, Sunnyvale, CA (US); Paul J. Hack, San Jose, CA (US); Zheng Gao, San Jose, CA (US); Rui Zhou, Mountain View, CA (US)

(73) Assignee: APPLE INC., Cupertino, CA (US)

( * ) Notice: Subject to any disclaimer, the term of this patent is extended or adjusted under 35 U.S.C. 154(b) by 0 days. days.

(21) Appl. No.: 14/683,134

(22) Filed: Apr. 9, 2015

(65) Prior Publication Data

US 2015/0295362 A1 Oct. 15, 2015

Related U.S. Application Data

(60) Provisional application No. 61/979,469, filed on Apr. 14, 2014, provisional application No. 62/001,060,
(Continued)

(51) Int. Cl.

| | |
|---|---|
| ***H01R 13/648*** | (2006.01) |
| ***H01R 13/6581*** | (2011.01) |
| ***H01R 13/6585*** | (2011.01) |
| ***H01R 24/64*** | (2011.01) |
| *H01R 13/6466* | (2011.01) |

(Continued)

(52) U.S. Cl.

CPC ..... *H01R 13/6581* (2013.01); *H01R 13/6585* (2013.01); *H01R 24/64* (2013.01); *H01R 12/71* (2013.01); *H01R 13/405* (2013.01); *H01R 13/504* (2013.01); *H01R 13/6466* (2013.01); *H01R 13/6582* (2013.01); *H01R 13/6587* (2013.01); *H01R 13/6594* (2013.01); *H01R 23/02* (2013.01); *H01R 24/60* (2013.01);
(Continued)

(58) Field of Classification Search

CPC ..... H01R 23/02; H01R 24/60; H01R 24/62; H01R 13/6466; H01R 13/6587; H01R 13/6594

USPC ..... 439/660, 607.4, 607.35, 607.36, 676

See application file for complete search history.

(56) References Cited

U.S. PATENT DOCUMENTS

| | | | |
|---|---|---|---|
| 3,539,973 | A | 11/1970 | Wright |
| 5,267,868 | A | 12/1993 | Wolff, Jr. |

(Continued)

FOREIGN PATENT DOCUMENTS

| | | |
|---|---|---|
| CN | 201 285 872 | 8/2009 |
| EP | 2 590 273 A2 | 5/2013 |

(Continued)

OTHER PUBLICATIONS

First Examination Report dated Mar. 17, 2016 for AU Patent Application No. 2016100014, 4 pages.

(Continued)

*Primary Examiner* — Abdullah Riyami
*Assistant Examiner* — Justin Kratt
(74) *Attorney, Agent, or Firm* — Kilpatrick Townsend & Stockton, LLP

(57) ABSTRACT

Connector receptacles that are able to withstand insertion and other forces, are reliable, and are easy to manufacture. In various examples, the connector receptacle tongue or other portions may be reinforced such that they may withstand the insertion forces exerted through a connector insert.

20 Claims, 54 Drawing Sheets

Related U.S. Application Data filed on May 21, 2014, provisional application No. 62/129,826, filed on Mar. 7, 2015.

(51) Int. Cl.

| | |
|---|---|
| *H01R 24/00* | (2011.01) |
| *H01R 24/62* | (2011.01) |
| *H01R 13/6587* | (2011.01) |
| *H01R 12/71* | (2011.01) |
| *H01R 13/504* | (2006.01) |
| *H01R 13/6594* | (2011.01) |
| *H01R 13/405* | (2006.01) |
| *H01R 43/02* | (2006.01) |
| *H01R 24/60* | (2011.01) |
| *H01R 13/6582* | (2011.01) |
| *H01R 107/00* | (2006.01) |

(52) U.S. Cl.

CPC ..... *H01R 24/62* (2013.01); *H01R 43/0221* (2013.01); *H01R 2107/00* (2013.01)

(56) References Cited

U.S. PATENT DOCUMENTS

| | | | | |
|---|---|---|---|---|
| 6,179,627 | B1 | 1/2001 | Daly | |
| 6,884,094 | B1 | 4/2005 | Bernhart | |
| 7,922,535 | B1 | 4/2011 | Jiang | |
| 8,794,981 | B1 | 8/2014 | Rodriguez | |
| 8,821,181 | B1 | 9/2014 | Lam | |
| 9,093,779 | B1 | 7/2015 | Wang | |
| 9,350,121 | B2 * | 5/2016 | Ju | H01R 13/6585 |
| 9,509,084 | B2 | 11/2016 | Zhao | |
| 9,531,113 | B2 | 12/2016 | Ohyama | |
| 2002/0149875 | A1 | 10/2002 | Dague | |
| 2009/0163071 | A1 | 6/2009 | Chen | |
| 2009/0190277 | A1 | 7/2009 | Hiew et al. | |
| 2010/0055986 | A1 * | 3/2010 | Wang | H01R 13/405 439/638 |
| 2011/0159747 | A1 | 6/2011 | Tung et al. | |
| 2011/0195606 | A1 | 8/2011 | Hsia | |
| 2011/0230074 | A1 * | 9/2011 | Schmidt | H01R 13/405 439/271 |
| 2013/0143441 | A1 | 6/2013 | Huang et al. | |
| 2013/0244494 | A1 | 9/2013 | Tziviskos et al. | |
| 2013/0288520 | A1 | 10/2013 | Simmel et al. | |
| 2013/0330976 | A1 | 12/2013 | Simmel et al. | |
| 2014/0073184 | A1 * | 3/2014 | Zhao | H01R 13/6594 439/607.55 |
| 2014/0099835 | A1 * | 4/2014 | Chang | H01R 13/6581 439/682 |
| 2015/0162684 | A1 | 6/2015 | Amini et al. | |
| 2015/0171562 | A1 | 6/2015 | Gao et al. | |
| 2015/0200493 | A1 | 7/2015 | Gao et al. | |
| 2015/0263465 | A1 * | 9/2015 | Zhang | H01R 13/6581 439/676 |
| 2015/0270661 | A1 | 9/2015 | Kao | |
| 2015/0295356 | A1 | 10/2015 | Tziviskos et al. | |
| 2015/0340782 | A1 | 11/2015 | Amini et al. | |
| 2015/0340783 | A1 | 11/2015 | Lee et al. | |
| 2015/0340813 | A1 | 11/2015 | Ng et al. | |
| 2015/0340825 | A1 | 11/2015 | Ng et al. | |
| 2016/0276765 | A1 | 9/2016 | Lee | |

FOREIGN PATENT DOCUMENTS

| | | | | |
|---|---|---|---|---|
| EP | 2590273 | A2 * | 5/2013 | H01R 13/516 |
| JP | 2003-059586 | A | 2/2003 | |
| JP | 2013-118165 | A | 6/2013 | |
| JP | 2013-522846 | A | 6/2013 | |
| KR | 10-2010-0050530 | | 5/2010 | |
| WO | 2009/017599 | A1 | 2/2009 | |

OTHER PUBLICATIONS

Autralian Office Action dated Jun. 10, 2015 for AU Patent Application No. 2015100481, 4 pages.

International Search Report and Written Opinion for PCT/US2015/025661, dated Dec. 16, 2015, 16 pages.

Office Action (English Translation) dated Jul. 29, 2016 in Korean Patent Application No. 20-2015-0002381, 5 pages.

Office Action (English Translation) dated Aug. 1, 2016 in Korean Patent Application No. 20-2015-0002378, 4 pages.

Office Action (English Translation) dated Jun. 23, 2017 in Korean Patent Application No. 20-2015-0002378, 3 pages.

Examination Report dated Dec. 16, 2016 in Australian Patent Application No. 2016101829, 4 pages.

Invitation to Pay Additional Fees and, Where Applicable, Protest Fee with Partial International Search Report dated Dec. 15, 2017 for PCT Patent Application No. PCT/US2017/053300, 13 pages.

U.S. Appl. No. 15/714,915, Tziviskos et al., filed Sep. 25, 2017.

* cited by examiner

DURABLE CONNECTOR RECEPTACLES

CROSS-REFERENCES TO RELATED APPLICATIONS

This application claims the benefit of U.S. provisional applications No. 61/979,469, filed on Apr. 14, 2014, No. 62/001,060, filed May 21, 2014, and No. 62/129,826, filed Mar. 7, 2015, each titled "DURABLE CONNECTOR RECEPTACLES," which are incorporated by reference.

BACKGROUND

The amount of data transferred between electronic devices has grown tremendously the last several years. Large amounts of audio, streaming video, text, and other types of data content are now regularly transferred among desktop and portable computers, media devices, handheld media devices, displays, storage devices, and other types of electronic devices.

Power may be transferred with this data, or power may be transferred separately. Power and data may be conveyed over cable assemblies. Cable assemblies may include a cable that may have wire conductors, fiber optic cables, or some combination of these or other conductors. Cable assemblies may also include a connector insert at each end of the cable, though other cable assemblies may be connected or tethered to an electronic device in a dedicated manner. The connector inserts may be inserted into receptacles in the communicating electronic devices.

During these insertions, a user inserting a connector insert may exert a force in the direction of insertion into the receptacle. Also, the direction of insertion may be somewhat tilted or rotated. This force may exert compression and angular forces on one or more portions of the connector receptacle. This force may damage the connector receptacle causing a reduction or loss of functionality of the electronic device housing the connector receptacle. Similar forces may be exerted on one or more portions of a connector receptacle after a connector insert has been inserted in the receptacle or during extraction of a connector insert from the receptacle.

Also, these connector inserts may be inserted into a device receptacle one or more times a day for multiple years. It may be desirable that these connector inserts be reliable and do not break or wear down prematurely, since such failures may lead to user dissatisfaction with the electronic device.

Electronic devices may be sold in the millions, with an attendant number of connector receptacles sold with them. With such volumes, any reduction or simplification in the manufacturing of a connector receptacle becomes significant. For such reasons, it may be desirable that these connector receptacles are readily manufactured.

Thus, what is needed are connector receptacles that are able to withstand insertion and other forces, are reliable, and are easy to manufacture.

SUMMARY

Accordingly, embodiments of the present invention may provide connector receptacles that are able to withstand insertion and other forces, are reliable, and are readily manufactured. An exemplary embodiment of the present invention may provide a connector receptacle where a receptacle tongue or other portion may be reinforced to withstand insertion forces. While these techniques are well-suited to use in connector receptacles, they may also be employed in connector inserts, or both connector inserts and receptacles, consistent with embodiments of the present invention. Also, while embodiments of the present invention may protect connector receptacles from damage during the insertion of a connector insert, embodiments of the present invention may also protect connector receptacles from damage during an extraction of a connector insert and from damage caused by forces being applied to a connector insert or connector receptacle while the connector insert is positioned inside the connector receptacle. Embodiments of the present invention may also protect connector receptacles from damage by unrelated items at other times. Throughout this document damage that may occur at any of these or other times may be referred to as damage caused during the insertion of a connector insert for clarity.

An illustrative embodiment of the present invention may provide connector receptacles having one or more portions that are reinforced to withstand insertion forces. This may help to protect the tongue during insertions where a connector insert is not directly inserted into the receptacle, but is instead inserted in an offset or rotated direction. This may be of particular importance when the tongue is exceptionally thin and would otherwise be prone to damage. The reinforcing structures used may be primarily located on an surface or internal to the portions of the connector receptacle. In various embodiments of the present invention, a tongue of a connector receptacle may be reinforced. The reinforcement may be provided by a metallic piece that forms a frame that is substantially on a surface of the tongue. The metallic piece may have side portions to form sides of the tongue. The side portions may each have cutout portions to engage retention features on a connector insert when the connector insert is inserted into the connector receptacle. The side portions may be braced or joined with one or more bracing or crosspiece portions.

In an illustrative embodiment of the present invention, a nonconductive insert portion may be inserted into the frame of the metallic piece. Contacts may be placed on one or both sides of the nonconductive insert. The metallic piece, nonconductive insert, and parts of sides of the contacts may be encased in an injection molded non-conductive portion. Ground contacts may be attached to the metallic piece.

In another illustrative embodiment of the present invention, a frame may be formed along the sides and front of a tongue. The sides may be exposed and be used as side ground contacts to form electrical connections with retention features in a plug. The tongue frame may further include a front brace or crosspiece. This front crosspiece may either be exposed as a front ground contact, or it may be covered with plastic or other nonconductive material used to form the tongue. Ground contacts on a top and bottom of the tongue may be formed with the frame as a single piece. In these and other embodiments of the present invention, a connecting structure may be formed either with the frame and ground contacts as a single piece, or it may be formed separately then later attached to the frame and ground contacts. The connecting structure may then be used to attach the frame to a shield or other receptacle portion.

The metallic pieces provided by embodiments of the present invention, including the frame and crosspieces or braces, may provide reinforcement for the tongue and may help to prevent damage during insertion of a connector insert. They may also provide strong, durable surfaces for engaging retention features in the connector insert. The braces or crosspieces on the metallic piece may help to prevent twisting that may otherwise occur when a connector insert is inserted with a rolled or otherwise indirect angle. The metallic pieces may further provide a degree of shielding for signals on the contacts. While the metallic pieces in these and other embodiments of the present invention may be formed of metal or other conductive material, in other embodiments of the present invention, metallic pieces may be formed of non-metallic materials, such as ceramics or other materials. The metallic piece may be formed by metal injection molding, 3-D printing, or other technique.

Another illustrative embodiment of the present invention may provide a tongue or other portion of a connector receptacle that is reinforced with a metallic center piece that is located substantially internally in the tongue. The metallic center piece may be folded to create ground contacts for contacting ground contacts of a connector insert, and optionally, a shield for the connector receptacle. A first molded portion may be formed around a portion of the metallic center piece. Contacts may be fit to the first molded portion, or the contacts may be put in place before the first molded portion is formed around a part of the contacts. An optional second molded portion or overmold may be formed around the metallic center piece and first molded portion, leaving the tops of the contacts and ground contacts exposed. In other embodiments of the present invention, the first and second molded portions may be combined into a single mold. The metallic center piece may also provide shielding.

More specifically, an illustrative embodiment of the present invention may provide a contactor receptacle having a tongue, the tongue having a metallic center piece having a center portion, the center portion having a right extension and a left extension. The left extension may be folded to form a first ground contact and the left extension may have a rear extension folded to form a second ground contact. Similarly, the right extension may be folded to form a third ground contact, and the right extension may have a rear extension folded to form a fourth ground contact. The tongue may further include a first molded portion around the center portion of the metallic center piece, a plurality of contacts in the first molded portion, and a second molded portion over a rear of the first molded portion. In other embodiments, the first and second molded portions may be combined into a single mold. The second molded portion may leave a portion of the plurality of contacts, the first ground contact, the second ground contact, the third ground contact, and the fourth ground contact exposed. The metallic center piece may further include a rear extension, where the rear extension includes a plurality of tabs to be fit into openings in a printed circuit board or other appropriate substrate. The center portion further may further include folded side and front portions to provide reinforcement for sides and front of the tongue. A portion of the outside of the side reinforcement portion may be exposed by the first and second molded portions such that it may electrically contact a retention feature in a connector insert when the connector insert is inserted into this connector receptacle.

While the metallic center piece may be a single piece, it may instead be formed of two, three, or more pieces. These pieces may be soldered or laser or spot welded together, or secured in another manner. In the examples herein, the pieces are described as spot welded for simplicity. These pieces may be folded to form ground contacts. One or more molding steps may form a plastic molded portion around the metallic center piece to form a connector receptacle tongue.

Another illustrative embodiment of the present invention may provide a tongue or other portion of a connector receptacle that may be reinforced with a metallic center piece that is located substantially internally in the tongue. The metallic center piece may be formed of multiple portions attached to each other to create ground contacts for contacting ground contacts of a connector insert, and optionally, a shield for the connector receptacle. A first molded portion may be formed around a portion of the metallic center piece. Contacts may be fit to the first molded portion, or the contacts may be put in place before the first molded portion is formed around a part of the contacts. An optional second molded portion or overmold may be formed around the metallic center piece and first molded portion, leaving the tops of the contacts and ground contacts exposed. In other embodiments of the present invention, the first and second molds may be combined into a single molded portion. The metallic center piece may also provide shielding. While the metallic center piece in this and other embodiments of the present invention may be formed of metal, in other embodiments of the present invention metallic center pieces may be formed of non-metallic materials, such as ceramics or other materials.

Other illustrative embodiments of the present invention may employ tongues for connector receptacles, where the tongues may include one or more printed circuit board portions. Using a printed circuit board may provide a connector receptacle tongue where signal traces may be well-matched and shielded. In a specific embodiment the present invention, a tongue may be reinforced with a metal core. A first printed circuit board portion may be located on a first side of a metal core, while a second printed circuit board portion may be located on a second opposing side of the metal core. Contacts and signal traces may be located on and in these printed circuit board portions, and each circuit board portion may include one or more layers. These signals traces may be matched and shielded. Additional printed circuit board portions may be placed on top and underneath the first and second printed circuit board portions and ground contacts may be placed on the surfaces. These additional printed circuit board portions may be laminated, attached, or otherwise fixed to the first and second printed circuit board portions. In other embodiments of the present invention, other print circuit board portions may be removed leaving the additional printed circuit board portions behind.

In this specific example, it may be desirable to route traces through the metal core. For example, it may be desirable to route a trace from a bottom of the tongue to a top of the tongue. Accordingly, an opening may be formed in the metal core and a nonconductive material may be used to isolate a via from the metal core, where the via is used to route a signal from a top to a bottom of the tongue.

In another illustrative embodiment of the present invention, instead of these additional printed circuit board portions, plastic overmold portions may be formed on a top and bottom of a printed circuit board. Ground contacts may be formed on the surfaces of these overmold portions.

In another illustrative embodiments the present invention, a metal core may be covered on a top side and a bottom side by a plastic overmold. Printed circuit boards may be molded, placed, or attached to a top and bottom of the overmold portion. The printed circuit boards may support contacts and interconnect traces. Second overmold portions may be formed on the printed circuit boards and plated to form ground contacts.

In another illustrative embodiment of the present invention, a laser direct structuring (LDS) process may be used. Specifically, a piece of LDS plastic may be used. Paths for contacts and traces may be etched in a surface of the LDS plastic using a laser. Traces and contacts may then be formed in the laser tracks. The LDS plastic pieces may be then at least partially encased in a plastic overmold to form a tongue for a connector receptacle.

In these various examples, a molding at a front and optionally other parts of a connector receptacle tongue may be colored or died to match a color of a device enclosure for the device housing the connector receptacle.

In various embodiments of the present invention, contacts, ground contacts, metallic pieces, and other conductive portions of a connector receptacle, such as the shell or shield, may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions may be formed using injection or other molding, 3-D printing, machining, or other manufacturing process. The nonconductive portions may be formed of silicon or silicone, rubber, hard rubber, plastic, nylon, liquid-crystal polymers (LCPs), ceramics, or other nonconductive material or combination of materials. Again, the gaskets or grommets may be formed of various materials including, but not limited to, elastomers with low compression set. This may help to ensure consistent performance over the life of the connector receptacle. In specific embodiments of the present invention, the elastomers used may be silicone or urethane. The printed circuit boards used may be formed of FR-4 or other material. Printed circuit boards may be replaced by other substrates, such as flexible circuit boards, in many embodiments of the present invention.

Embodiments of the present invention may provide connector receptacles that may be located in and may connect to various types of devices, such as portable computing devices, tablet computers, desktop computers, laptops, all-in-one computers, cell phones, smart phones, media phones, storage devices, portable media players, navigation systems, monitors, power supplies, adapters, remote control devices, chargers, and other devices. These connector receptacles may provide pathways for signals and power compliant with various standards such as Universal Serial Bus (USB), a High-Definition Multimedia Interface (HDMI), Digital Visual Interface (DVI), power, Ethernet, DisplayPort, Thunderbolt, Lightning and other types of standard and non-standard interfaces that have been developed, are being developed, or will be developed in the future.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
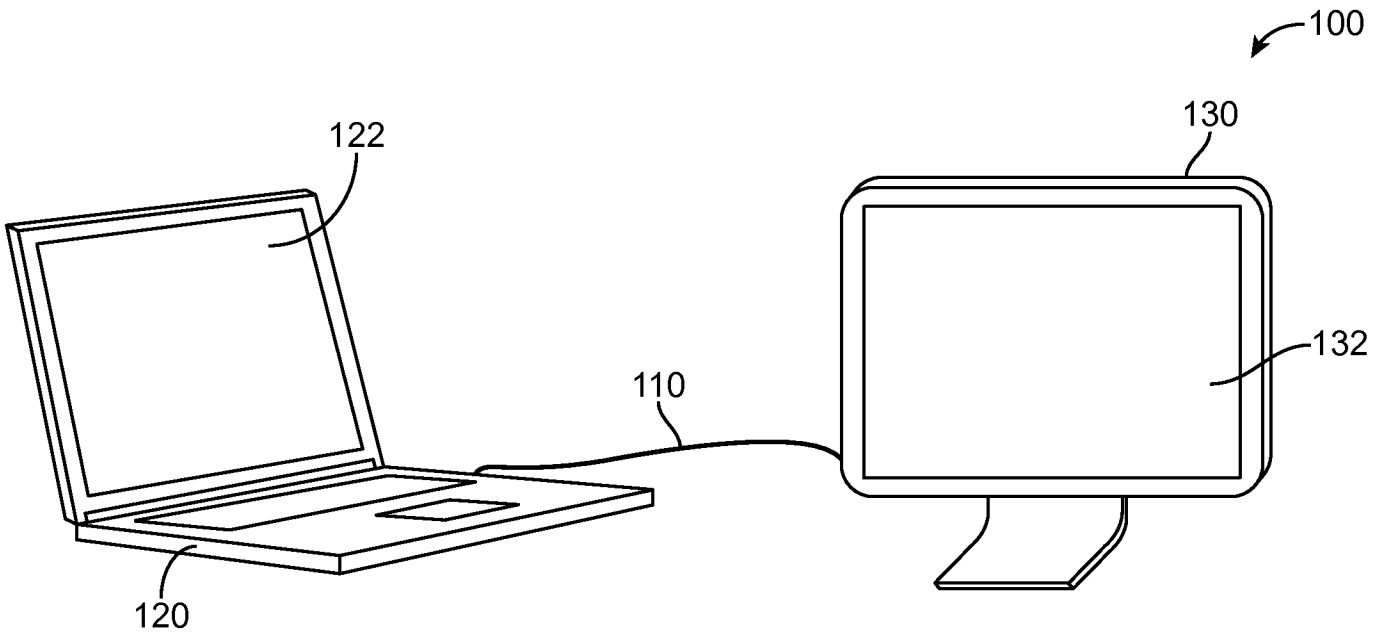
FIG. 1 illustrates an electronic system that may be improved by the incorporation of embodiments of the present invention.

FIG. 1 illustrates an electronic system that may be improved by the incorporation of embodiments of the present invention. This figure, as with the other included figures, is shown for illustrative purposes and does not limit either the possible embodiments of the present invention or the claims.

Electronic system 100 may include cable 110 joining electronic devices 120 and 130. In this example, electronic device 120 may be a laptop or portable computer having screen 122. Electronic device 130 may be a monitor 130 that may include screen 132. In other embodiments of the present invention, cable 110 may couple various types of devices, such as portable computing devices, tablets, desktop computers, all-in-one computers, cell phones, smart phones, media phones, storage devices, portable media players, navigation systems, monitors power supplies, adapters, and chargers, and other devices. These cables, such as cable 110, may provide pathways for signals and power compliant with various standards such as Universal Serial Bus (USB), a High-Definition Multimedia Interface (HDMI), Digital Visual Interface (DVI), power, Ethernet, DisplayPort, Thunderbolt, Lightning and other types of standard and non-standard interfaces that are either presently developed, under development, or will be developed in the future. Cable 110 may attach to electronic devices 110 and 130 through connector receptacles provided by embodiments of the present invention.

Again, these insertions may damage the connector receptacles. This may be particularly true when a connector insert is not inserted directly into the connector receptacle, but is instead inserted in a tilted or rotated direction. Damage may also be more likely when portions of a connector receptacle, such as a tongue, are small or thin. Accordingly, embodiments of the present invention may provide connector receptacles that are able to withstand these insertion forces. Again, while embodiments of the present invention may protect connector receptacles from damage during insertion of a connector insert, embodiments of the present invention may also protect connector receptacles from damage during extraction of a connector insert and from damage caused by forces being applied to a connector insert or connector receptacle while the connector insert is positioned inside the connector receptacle. Embodiments of the present invention may also protect connector receptacles from damage by unrelated items at other times. Throughout this document damage that may occur at any of these or other times may be referred to as damage caused during the insertion of a connector insert for clarity.

Figure 2:
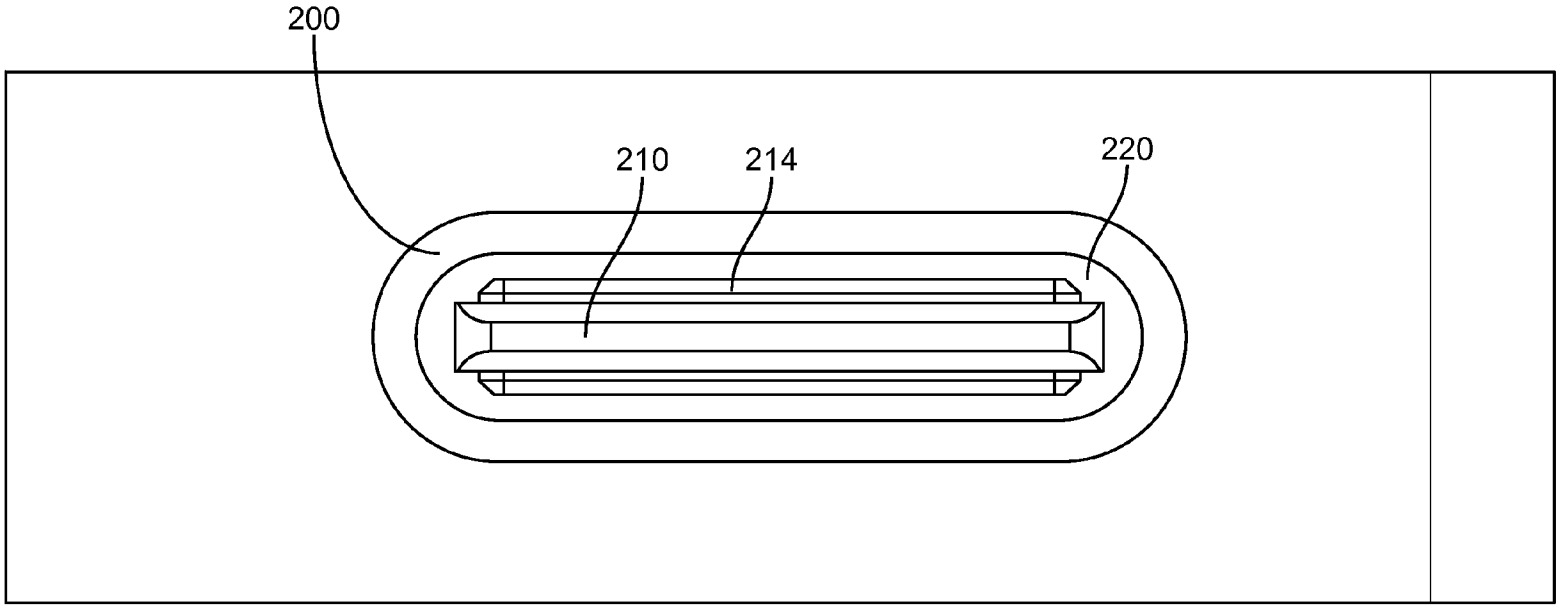
FIG. 2 illustrates a front view of a connector receptacle according to an embodiment of the present invention.

FIG. 2 illustrates a front view of a connector receptacle according to an embodiment of the present invention. This connector receptacle may include tongue 210 in opening of device enclosure 200. Tongue 210 may support one or more ground contacts 214. Tongue 210 may emerge into the connector receptacle recess through rear wall 220 in device enclosure 200.

In this and other embodiments of the present invention, a front of tongue 210 may be chamfered for easier insertion into an opening in a connector insert. This chamfered opening may be coated to reduce wear on the front surface of tongue 210 that may be caused by repeated insertions of a connector insert.

In various embodiments of the present invention, tongue 210 or other portions of this connector receptacle may be reinforced to prevent damage during the insertion of a connector insert. These tongues may be located in openings in device enclosures, they may be located in connector receptacle housings separate from device enclosures, or they may be located in other structures. An example of such a connector system is shown in the following figure.

Figure 3:
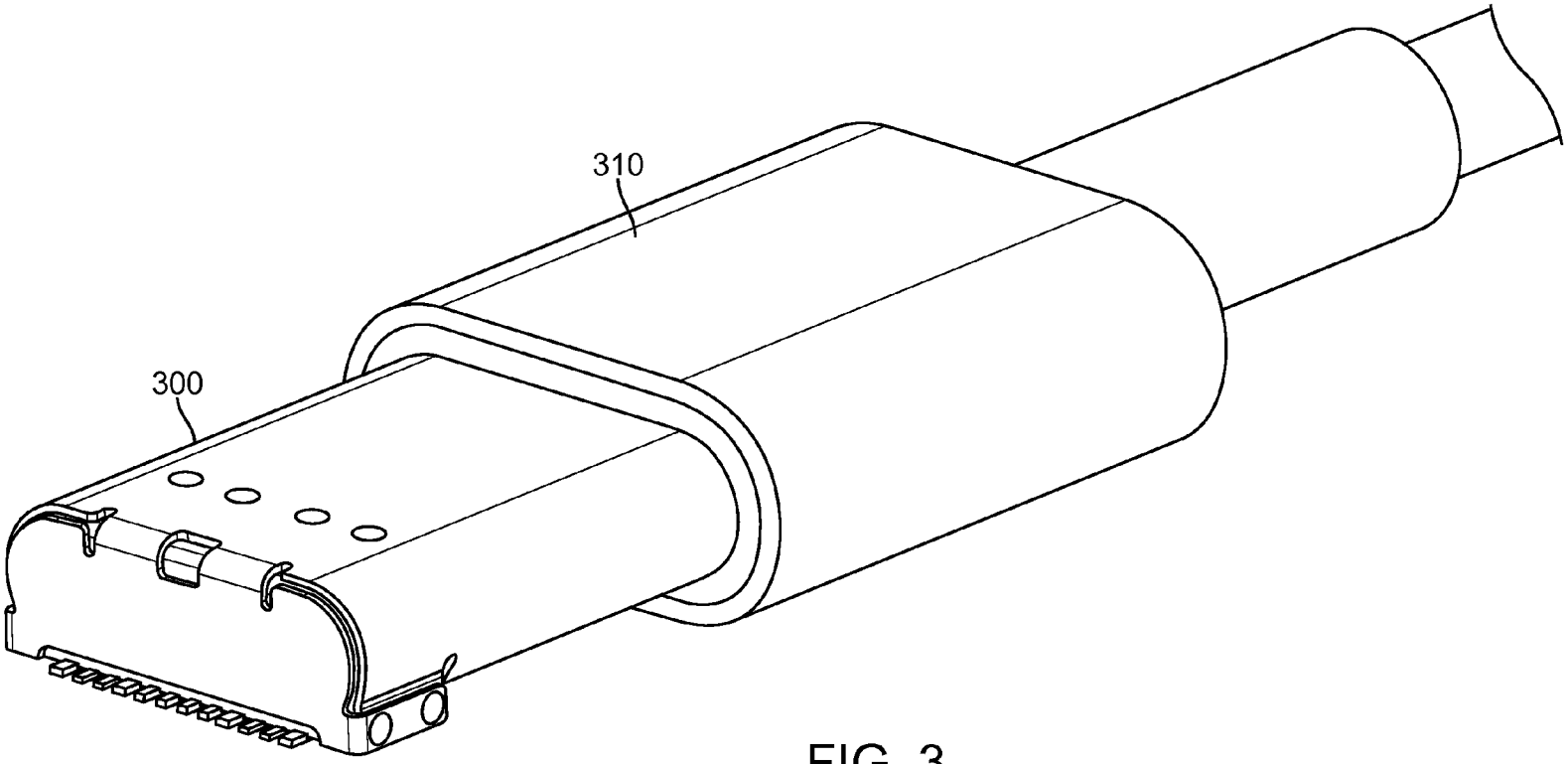
FIG. 3 illustrates a connector system where a connector insert is inserted into a connector receptacle according to an embodiment of the present invention.

FIG. 3 illustrates a connector insert according to embodiments of the present invention that is been inserted into a connector receptacle according to an embodiment of the present invention. Specifically, connector insert 310 has been inserted into connector receptacle 300. Receptacle 300 may be located in various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. Connector insert 310 and receptacle 300, as with the other included connector inserts and recetpacles, may provide pathways for signals that are compliant with various standards such as one of the Universal Serial Bus (USB) standards including USB-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. In other embodiments of the present invention, connector insert 310 and receptacle 300, as with the other included connector inserts and receptacles, may be used to provide a reduced set of functions for one or more of these standards. In various embodiments of the present invention, these interconnect paths provided by connector insert 310 and receptacle 300 and the other inserts and receptacles herein may be used to convey power, ground, signals, test points, and other voltage, current, data, or other information. More information about connector insert 310 may be found in co-pending U.S. patent application Ser. No. 14/543,711, filed Nov. 17, 2014, titled CONNECTOR RECEPTACLE HAVING A SHIELD, which is incorporated by reference.

Figure 4:
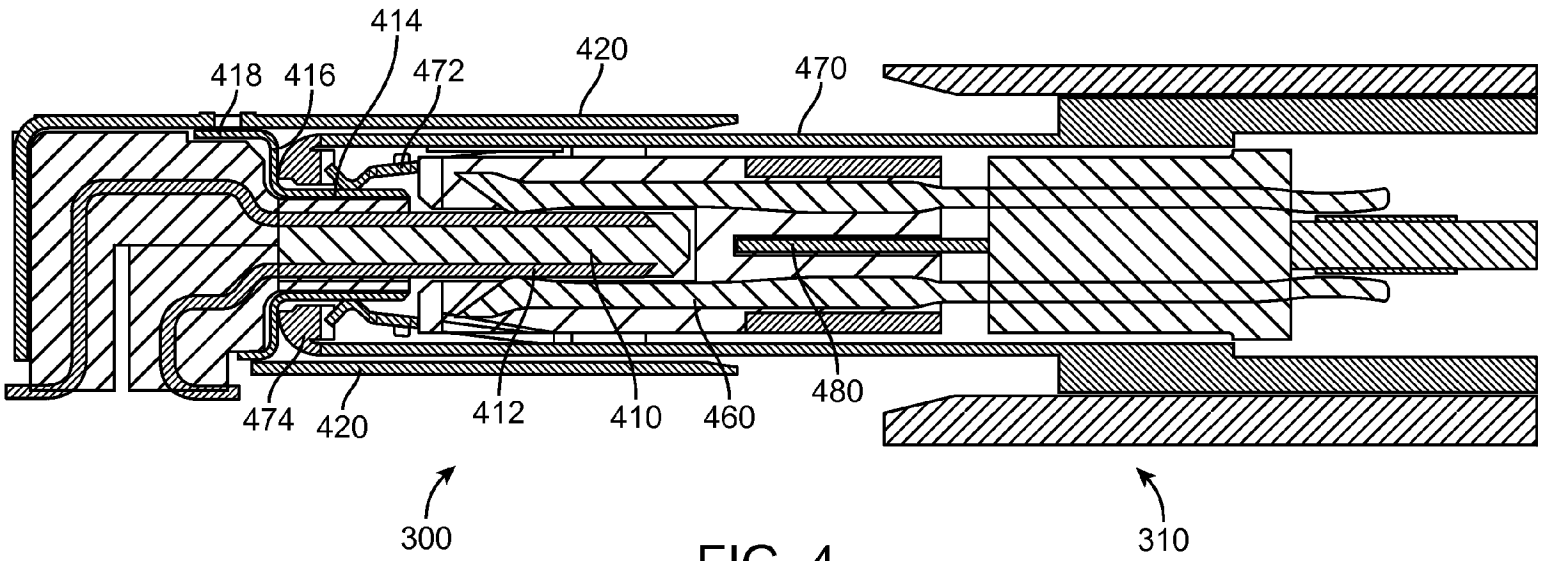
FIG. 4 illustrates a cutaway side view of a connector system according to an embodiment of the present invention.

FIG. 4 illustrates a cutaway side view of a connector system according to an embodiment of the present invention. This example may illustrate the functionality of the other receptacles and tongues herein and in other embodiments of the present invention. In this example, connector receptacle 300 may include tongue 410 supporting a number of contacts 412. As before, ground contacts 414 may be located on tongue 410. Ground contacts 414 may be stepped to include vertical portion 416 and horizontal portion 518. Horizontal portion 418 may contact receptacle shield 420.

Connector insert 310 may include shield 470 surrounding contacts 460. Shield 470 may be electrically connected to ground contacts 472. Shield 470 may terminate in end pieces 474. Tongue 410 may include a central ground plane or portion (not shown), while the connector insert may include ground plane or portion 480.

This arrangement may provide shielding for signal paths formed by contacts 412 and 460. Specifically, connector insert shield 470 may electrically contact receptacle shield 420. Receptacle shield 420 may electrically connect to ground contact 414 through vertical portion 416 and horizontal portion 418. Ground contact 472 in the connector insert may electrically contact ground contacts 414 and connector insert shield 470. Ground planes and ground portions in tongue 410 and ground plane or portions 480 in the connector insert may electrically connect to each other and these other structures as well. In various embodiments of the present invention, end pieces 474 may be conductive, and may thus form electrical connections with vertical portions 416. This shielding may help to isolate signals on contacts 412 and 460 from each other and from circuits, traces, and components external to this connector system.

Figure 5:
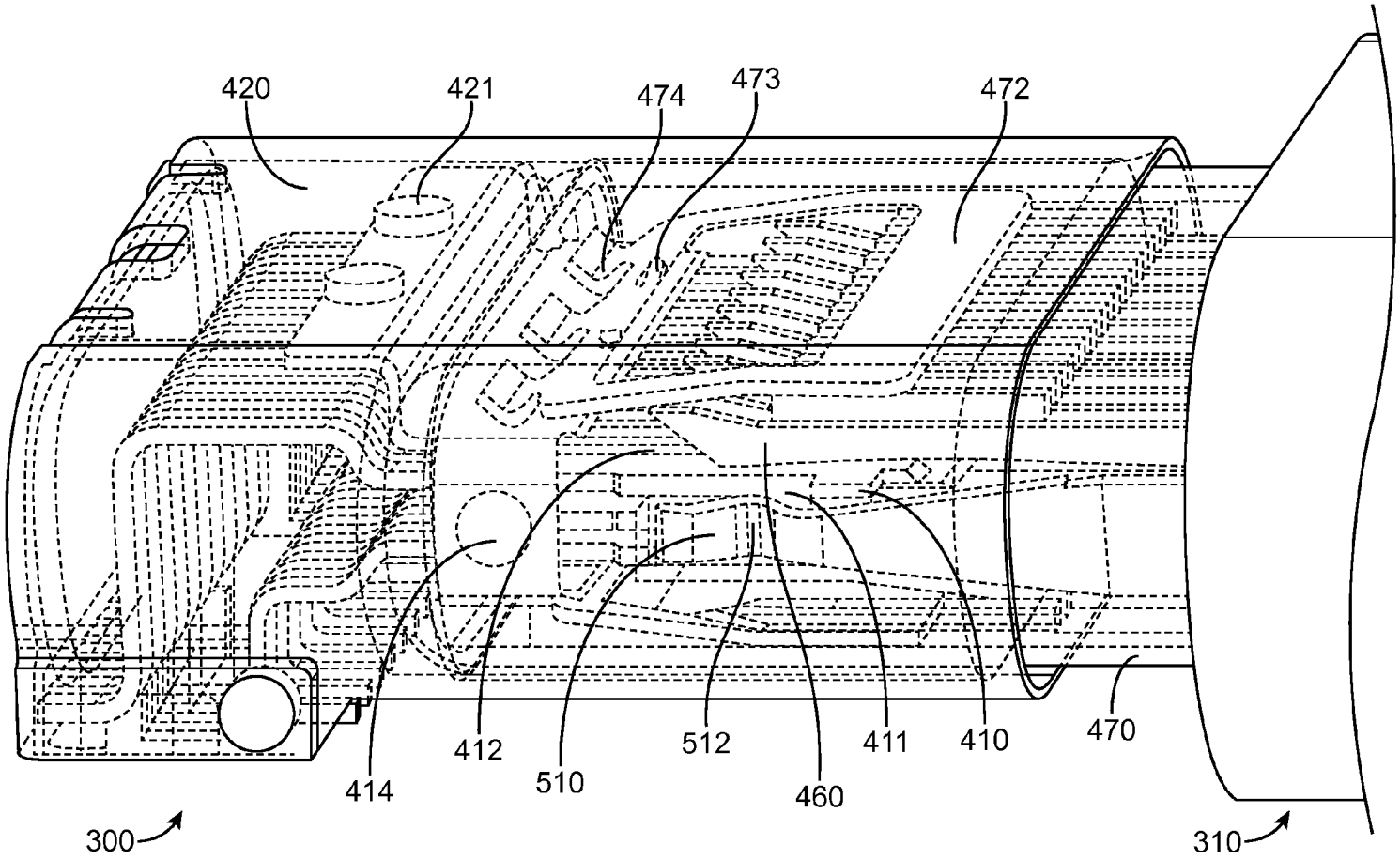
FIG. 5 illustrates a transparent oblique view of a connector system according to an embodiment of the present invention.

FIG. 5 illustrates a transparent oblique view of a connector system according to an embodiment of the present invention. This example may illustrate the functionality of the other receptacles and tongues herein and in other embodiments of the present invention. In this example, connector insert 310 may be inserted into connector receptacle 300. Again, more detail on these and other connector inserts may be found in co-pending U.S. patent application Ser. No. 14/543,711, filed Nov. 17, 2014, titled CONNECTOR RECEPTACLE HAVING A SHIELD, which is incorporated by reference.

This connector system, as with the other included connector systems may perform at least three functions. The first is to convey signals between a connector insert and a connector receptacle. These signals may include power, ground, and data signals, such as audio and video signals. A second is to shield these signals while they are being transferred. This may prevent or reduce the corruption of the signals during transfer. A third is to provide a retention force such that the connector insert is not inadvertently removed from the connector receptacle. Such accidental extractions may be particularly undesirable during transfer of large files.

Signals may be transferred using pins 460 in the connector insert 310, which may mate with contacts 412 in receptacle 300.

These signals may be shielded in a number of ways. For example, shield 470 of connector insert 310 may electrically connect to ground piece 472 at finger 473. Ground contacts 474 at a front of connector insert 310 may contact a horizontal portion of ground piece 414 in receptacle 300. Ground piece 414 may electrically connect to connector receptacle shield 420 via connection points 421. Shield 420 of connector receptacle 300 may electrically connect to shield 470 on receptacle 300.

Retention may be provided by side ground contacts 112 engaging notches 125 on tongue 129. Specifically, side ground contacts 510 may include contacting portion 512, which may engage notches 411 on sides of tongue 410. Notches 411 may be plated and connected to ground in the connector receptacle 300, thereby forming another ground path with side ground contacts 510, which may be connected to ground through the connector insert 310.

In various embodiments of the present invention, varying amounts of retention force may be desired. Accordingly, side ground contacts 510 may be pre-biased such that they spring back to fit into notches 411 during insertion. The strength and thickness of side ground contacts 510 may also be adjusted to provide different retention forces for different applications. In some embodiments of the present invention, for example some docking stations, it may be desirable to provide zero retention force, in which case side ground contacts 510 may be omitted.

Connector receptacle portions, such as a tongue, housing, or other portion, may be stiffened or reinforced in a variety of ways. Again, this reinforcement may be partially or substantially external on a tongue or other portion, or it may be partially or substantially internal to the tongue or other receptacle portion. For example, a partially external metallic frame may be used to provide reinforcement for a connector receptacle tongue. An example is shown in the following figure.

Figure 6:
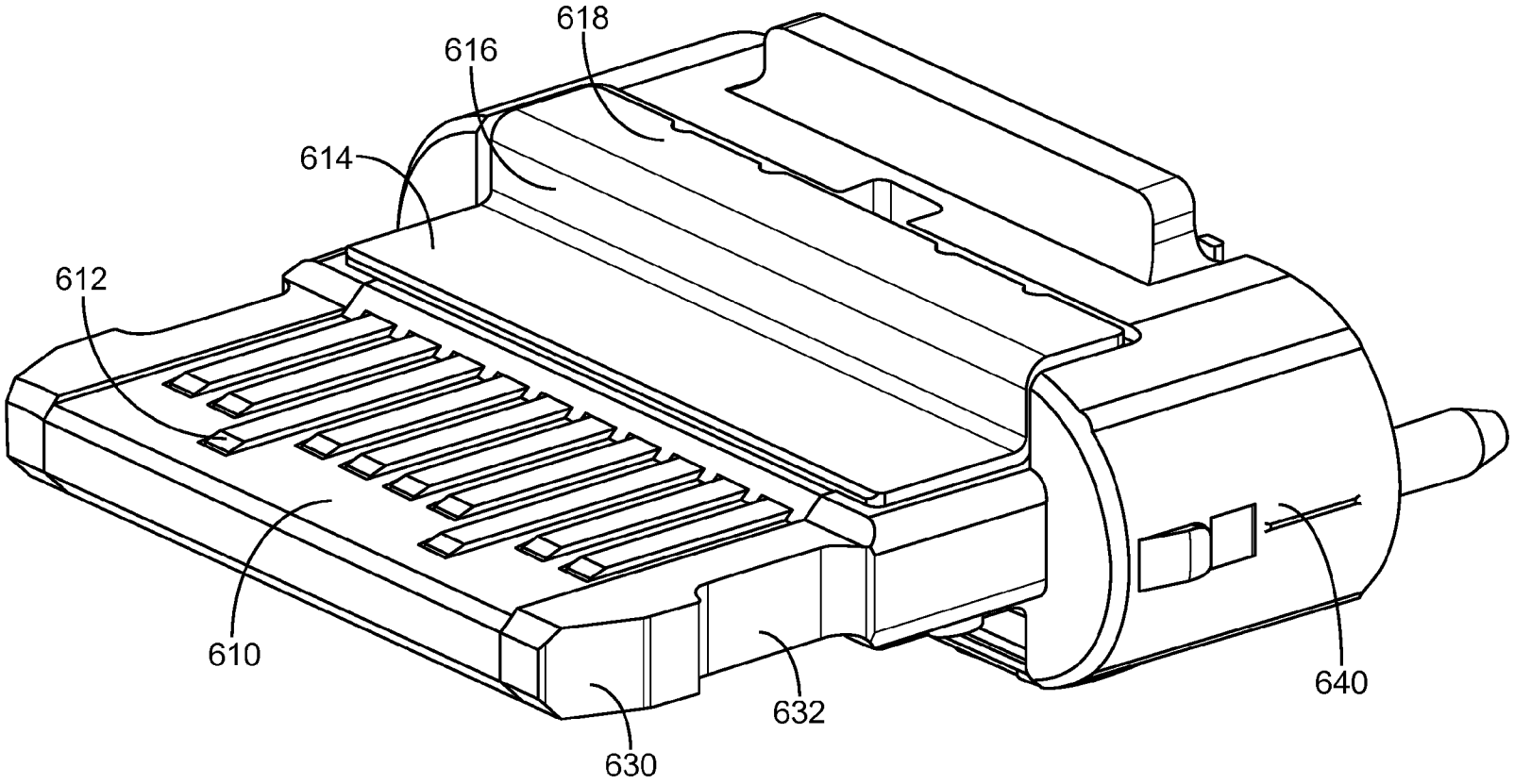
FIG. 6 illustrates a tongue for a connector receptacle according to an embodiment of the present invention.

FIG. 6 illustrates a tongue for a connector receptacle according to an embodiment of the present invention. As before, this tongue may also be used in a connector insert.

This tongue may include a tongue portion 610 supporting a number of contacts 612. Tongue 610 may include side portions 630 having cutouts 632. Cutouts 632 may be used to engage retention features on a connector insert. Ground contacts 614 may be included as before. Ground contacts 614 may electrically connect to a ground contact in a connector insert when the connector insert is inserted into a connector receptacle using this tongue. Ground contact 614 may further include vertical portions 616 and horizontal portion 618. Horizontal portion 618 may connect to a shield of a connector receptacle employed this tongue. Housing 640 may be included. This tongue, as with the other included tongues, may be included in a receptacle that is formed of a recess in a device enclosure and a tongue. Examples are shown in co-pending U.S. patent application Ser. No. 14/543,748, filed Nov. 17, 2014, titled CONNECTOR RECEPTACLE HAVING A TONGUE, which is incorporated by reference. Optionally, these tongues may be surrounded by a shield, as in the examples of FIGS. 3-5. Examples are shown in co-pending U.S. patent application Ser. No. 14/543,711, filed Nov. 17, 2014, titled CONNECTOR RECEPTACLE HAVING A SHIELD, which is incorporated by reference.

This connector receptacle tongue may be formed in various ways. A method consistent with an embodiment of the present invention is illustrated in the following figures.

Figure 7:
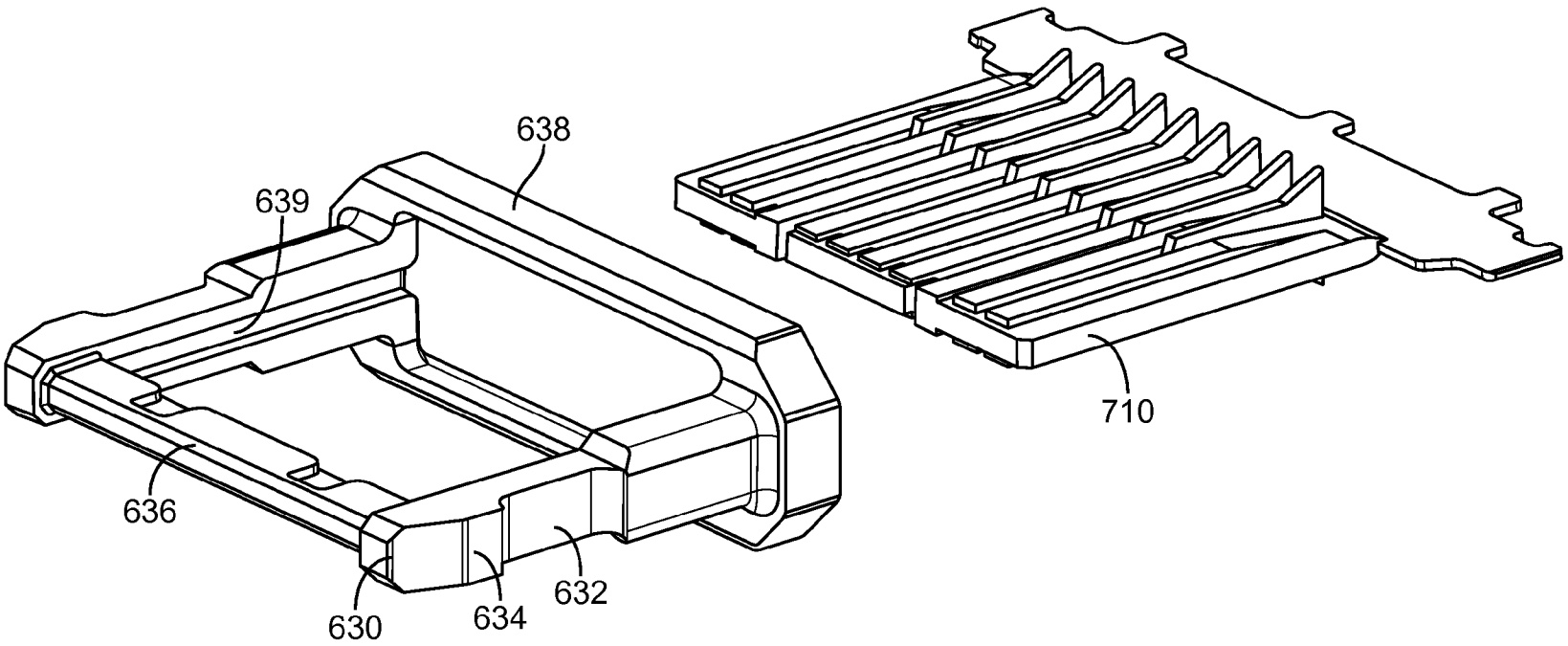
FIG. 7 illustrates portions of a connector receptacle tongue according to an embodiment of the present invention.

FIG. 7 illustrates portions of a connector receptacle tongue according to an embodiment of the present invention. This connector receptacle tongue may include metallic piece 630. Metallic piece 630 may include side portions 634 having cutouts 632. Side portions 340 may be braced with one or more cross braces 636 and 638. A nonconductive insert portion 710 may be aligned with slots or groves 639 on inner sides of side portions of 634 and slid into metallic piece 630. While the metallic piece in this and other embodiments of the present invention may be formed of metal, in other embodiments of the present invention metallic pieces may be formed of non-metallic materials, such as ceramics or other materials.

Figure 8:
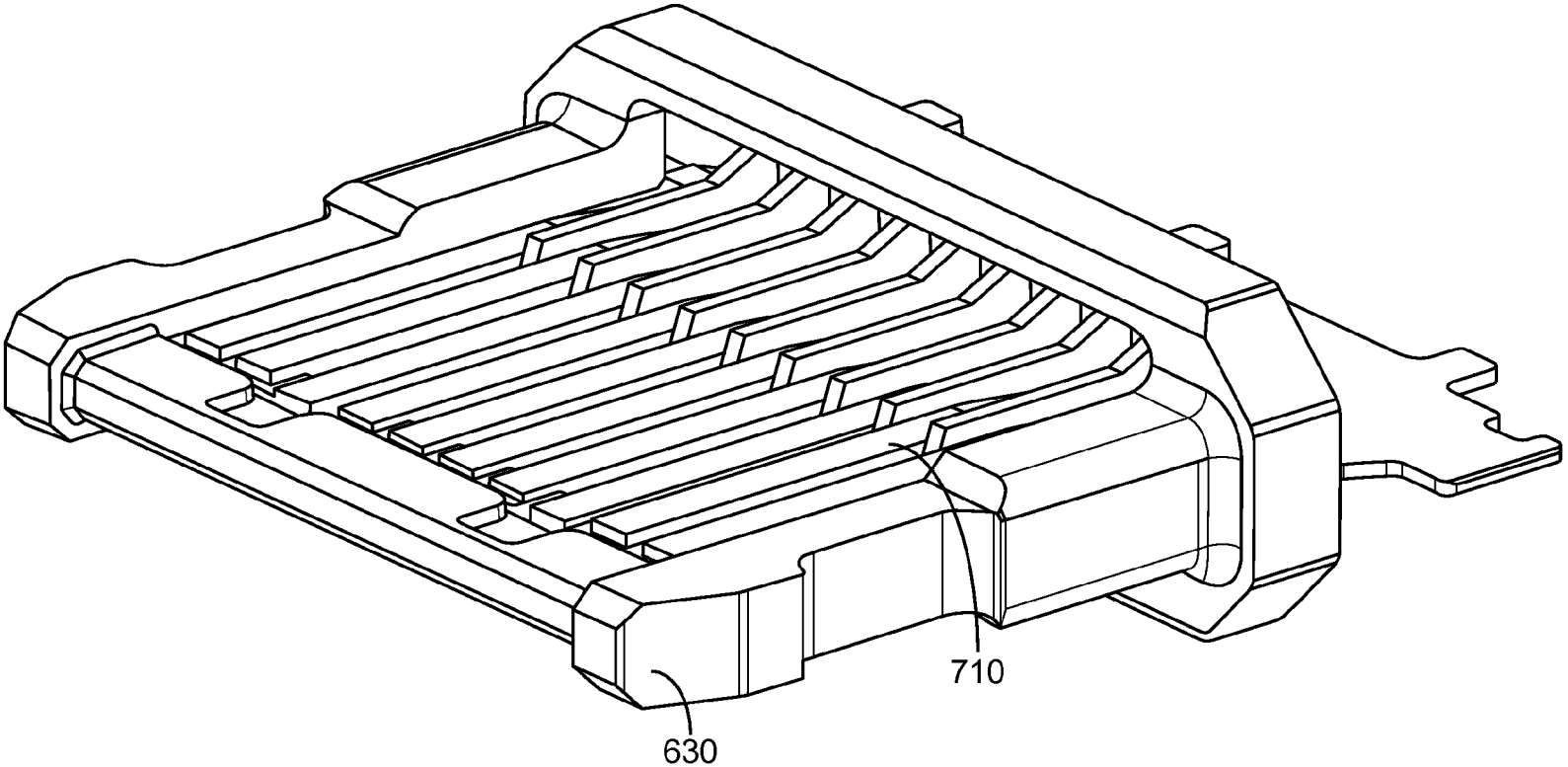
FIG. 8 illustrates a portion of a connector receptacle tongue according to an embodiment of the present invention.

FIG. 8 illustrates a portion of a connector receptacle tongue according to an embodiment of the present invention. In this figure, nonconductive insert portion 710 has been inserted into metallic piece 630. This nonconductive piece, as with the other similar nonconductive portions of the tongues shown here may be died or colored to match a color of a device enclosure housing the connector receptacle that includes the tongue.

Figure 9:
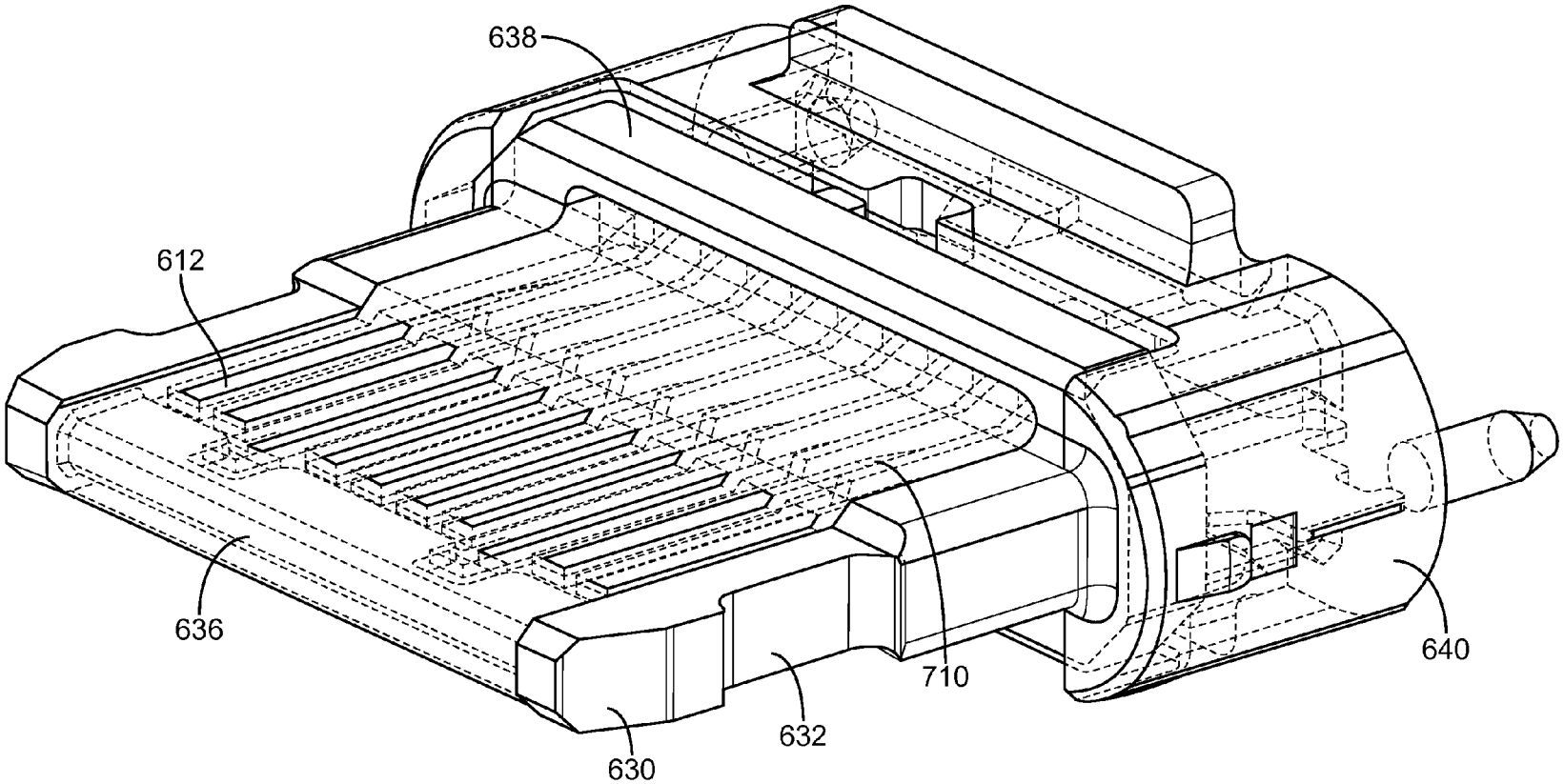
FIG. 9 illustrates a portion of a connector receptacle tongue according to an embodiment of the present invention.

FIG. 9 illustrates a portion of a connector receptacle tongue according to an embodiment of the present invention. In this figure, housing 640 has been injection molded around front cross brace 636, nonconductive insert portion 710, and portions of contacts 612. The tops, bottoms, and outer sides of side portions 630, the tops of contacts 612, and the tops of cross braces 638, may remain exposed. Ground contacts 614 may be attached to top and bottom sides of side portions 630, while horizontal portion 618 may be attached to cross braces 638. These attachments may be formed by soldering, laser or spot welding, or by using another appropriate technique.

In other embodiments of the present invention, reinforcing structures may be placed partially or substantially internal to the tongue, as opposed to partially or substantially being external, as in the example above. Examples of tongues having partially or substantially internal reinforcing structures are shown in the following figures.

Figure 10:
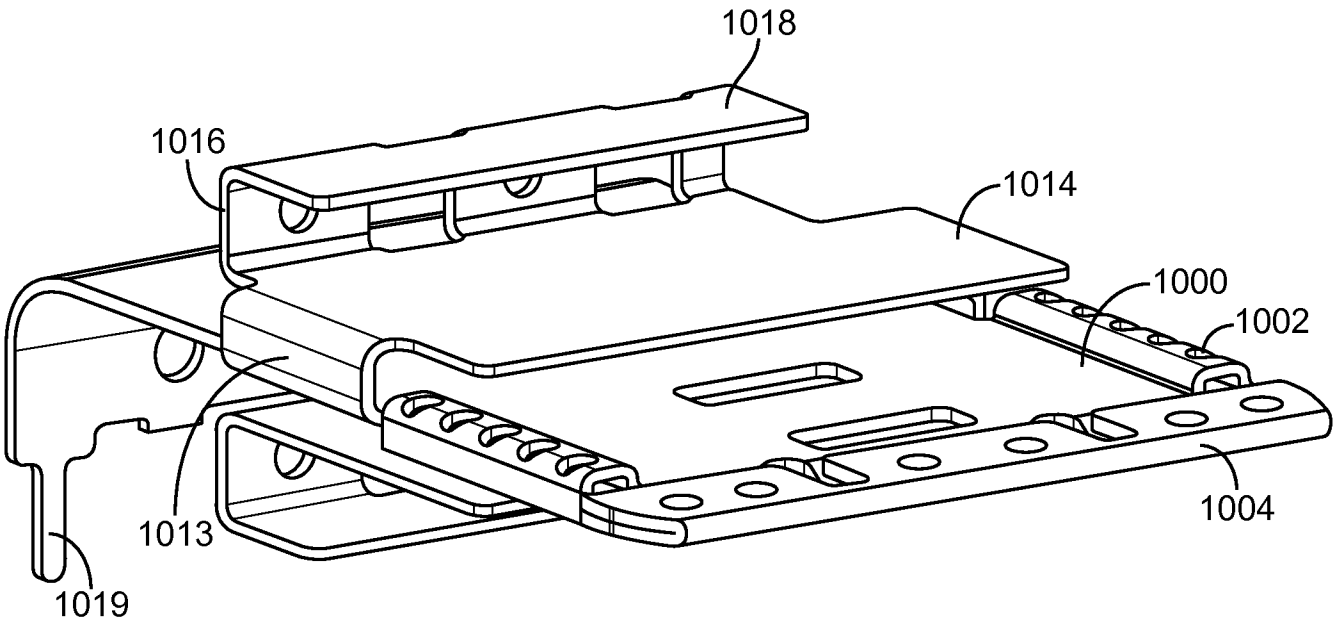
FIG. 10 illustrates a metallic center piece that may be used in a connector receptacle tongue according to an embodiment of the present invention.

FIG. 10 illustrates a metallic center piece that may be used in a connector receptacle tongue according to an embodiment of the present invention. This metallic center piece may include a center portion 1000. Center portion 1000 may include a left extension that may be folded over to form side 1013 and ground contacts 1014. This left extension may further include a rear extension folder over to form vertical portion 1016 and ground contact 1018. A right extension of center portion 1000 may be folded over to form similar contacts underneath. The metallic center piece may further include a rear extension that may include tabs 1019. Tabs 1019 may be inserted in an opening and soldered to a trace at the opening on a printed circuit board. Center portion 1000 may include folded side portions 1002 and folded front portion 1004. Folded side portions 1002 and folded front portion 1004 may provide reinforcement for the sides and front of the tongue. Several openings may be provided on this structure to allow the flow of plastic molding during construction of the receptacle tongue. While the metallic center piece in this and other embodiments of the present invention may be formed of metal, in other embodiments of the present invention metallic center pieces may be formed of non-metallic materials, such as ceramics or other materials.

Figure 11:
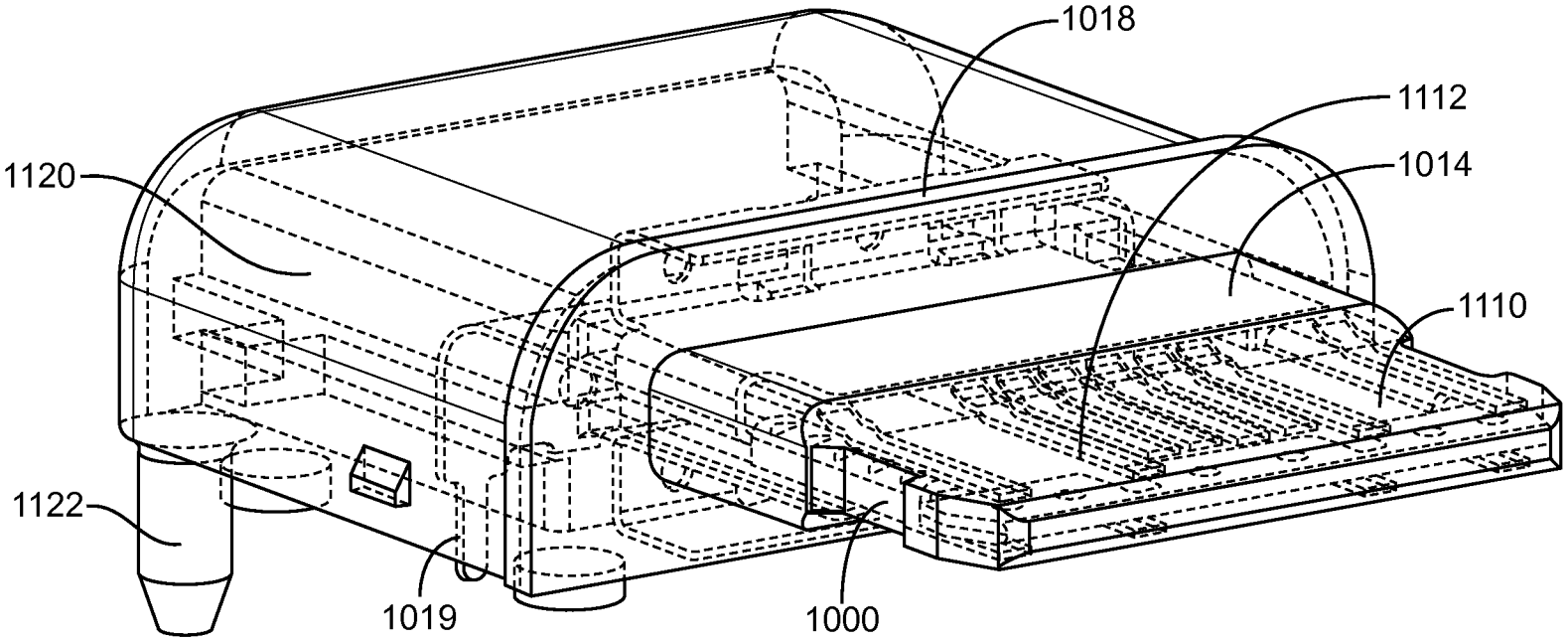
FIG. 11 illustrates a transparent view of a connector receptacle tongue according to an embodiment of the present invention.

FIG. 11 illustrates a transparent view of a connector receptacle tongue according to an embodiment of the present invention. Again, this connector tongue may include metallic center piece 1000, which may include folded extensions to provide ground contacts 1014 and 1018. A first overmold portion 1110 may be formed over a center portion of the metallic center piece. Contacts 1112 may then be placed in or included as part of first molded portion 1110. A second overmold portion 1120 may then be formed over the first portion. The second molded portion 1120 may include posts 1122, which may be inserted into openings in a printed circuit board or other appropriate substrate. Second overmold portion 1120 may leave ground contacts 1014 and 1018, as well as tops of signal contacts 1112, exposed. Furthermore, sides of folded side portions 1002 may be left exposed at notches inside the tongue, where they may electrically contact retention features of a connector insert.

As with the other metallic center pieces here, metallic center piece 1000 may be metallic, for example, it may be formed of sheet-metal. In other embodiments the present invention, metallic center pieces, such as, metallic center piece 1000, may be formed of other materials, including nonconductive materials.

Other embodiments the present invention may employ other types of metallic center pieces. An example is shown in the following figures.

Figure 12:
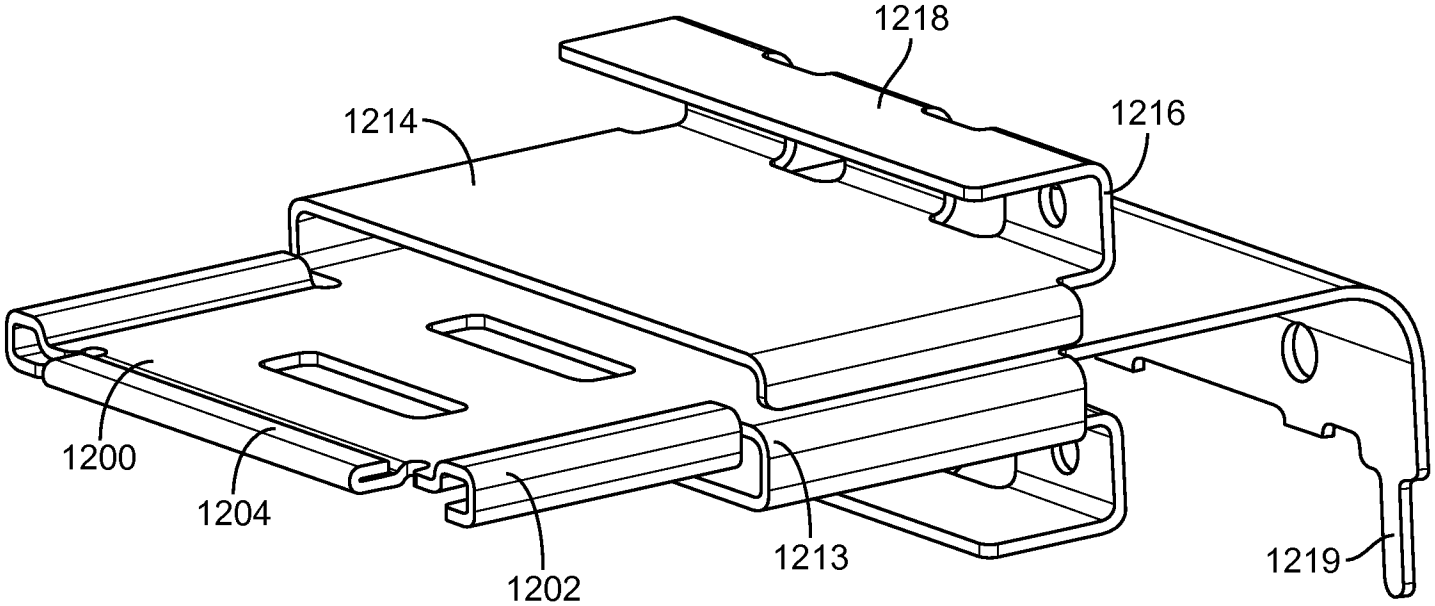
FIG. 12 illustrates another metallic center piece that may be used in a connector receptacle tongue according to an embodiment of the present invention.

FIG. 12 illustrates another metallic center piece that may be used in a connector receptacle tongue according to an embodiment of the present invention. As before, the metallic center piece may include a right and left extensions folded to form sides 1213 and ground contacts 1214, and these extensions may have rear extensions folded to form edges 1216 and ground contacts 1218. The metallic center piece may have a rear extension including tabs 1219. Folded reinforcement sides 1202 and front 1204 may be included.

Figure 13:
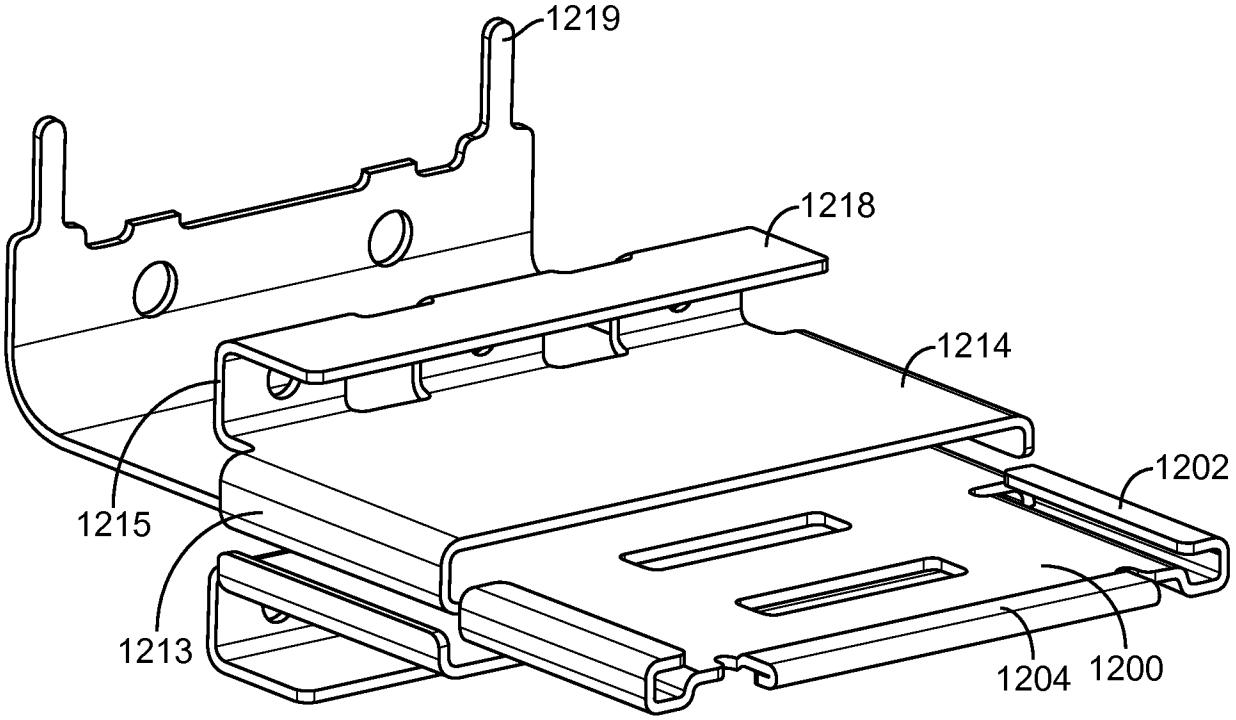
FIG. 13 illustrates an underside view of the metallic center piece of FIG. 12.

FIG. 13 illustrates an underside view of the metallic center piece of FIG. 12. As before, the side extensions and rear extension portions may be folded to form sides 1213 and 1215, as well as ground contacts 1214 and 1218. Side and front folded portions 1202 and 1204 may be included as before. A rear extension may include tabs 1219.

Figure 14:
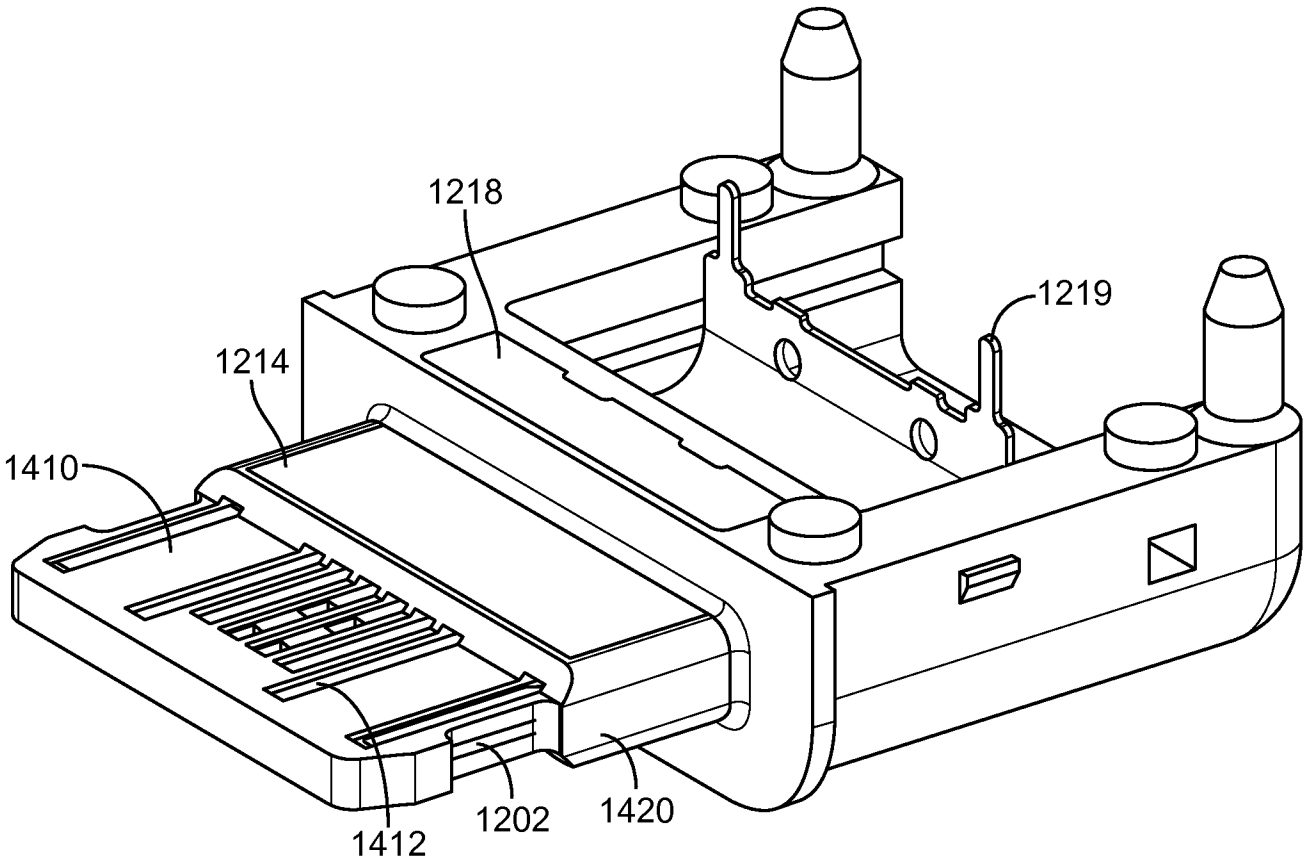
FIG. 14 illustrates a portion of a connector receptacle formed using a metallic center piece of FIG. 12.

FIG. 14 illustrates a portion of a connector receptacle formed using a metallic center piece of FIG. 12. A side of folded side portion 1202 may be exposed at a notch on the receptacle tongue. A first molded portion may be formed around the center portion of the metallic center piece. Contacts 1412 may be inserted or placed on the first molded portion 1410, or they may be in place when first molded portion 1410 is formed. A second molded portion 1420 may be formed around a rear of the first molded portion 1410. Second molded portion 1420 may leave ground contacts 1414 and 1418 exposed.

Figure 15:
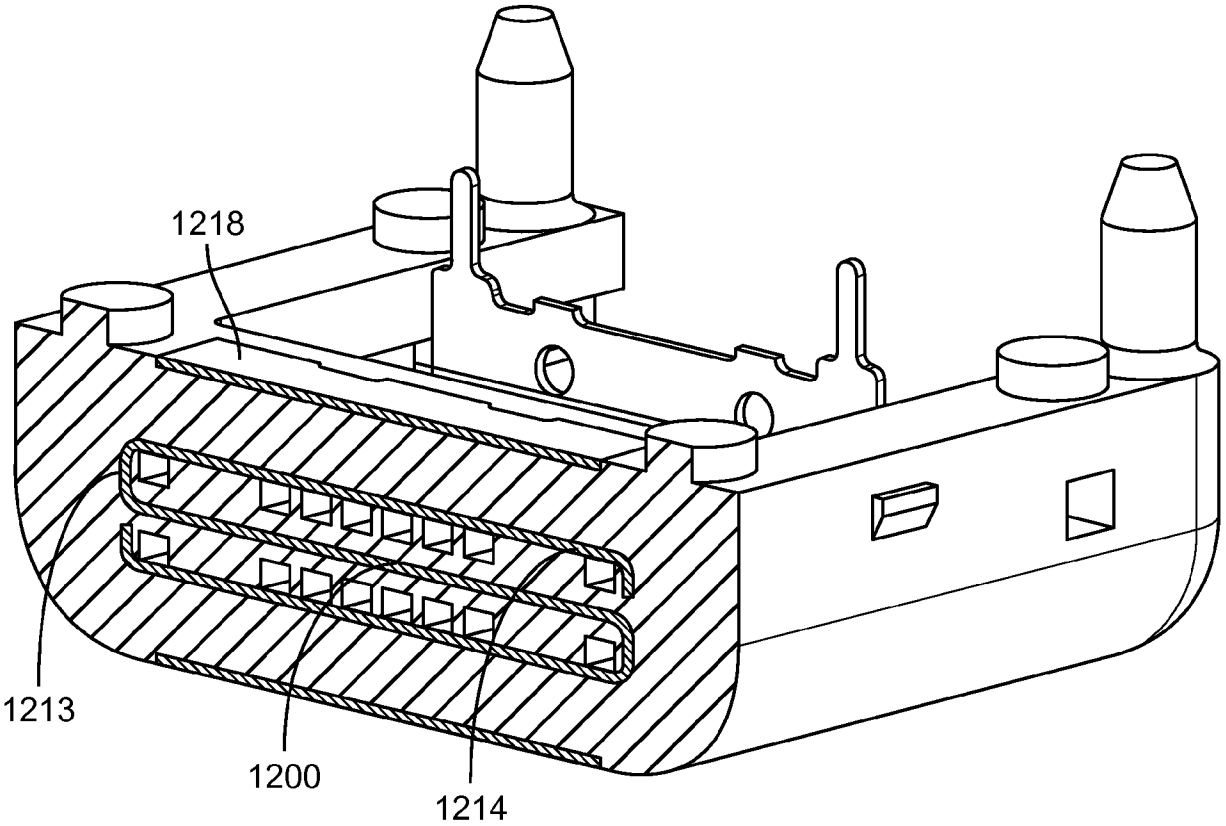
FIG. 15 illustrates a cutaway view of the connector receptacle of FIG. 14.

FIG. 15 illustrates a cutaway view of the connector receptacle of FIG. 14. This cutaway view shows the folds along a part of the metallic center piece. Specifically, metallic center piece 1200 may be folded to form sides 1213 and ground contacts 1214. Ground contact 1218 is also shown.

Figure 16:
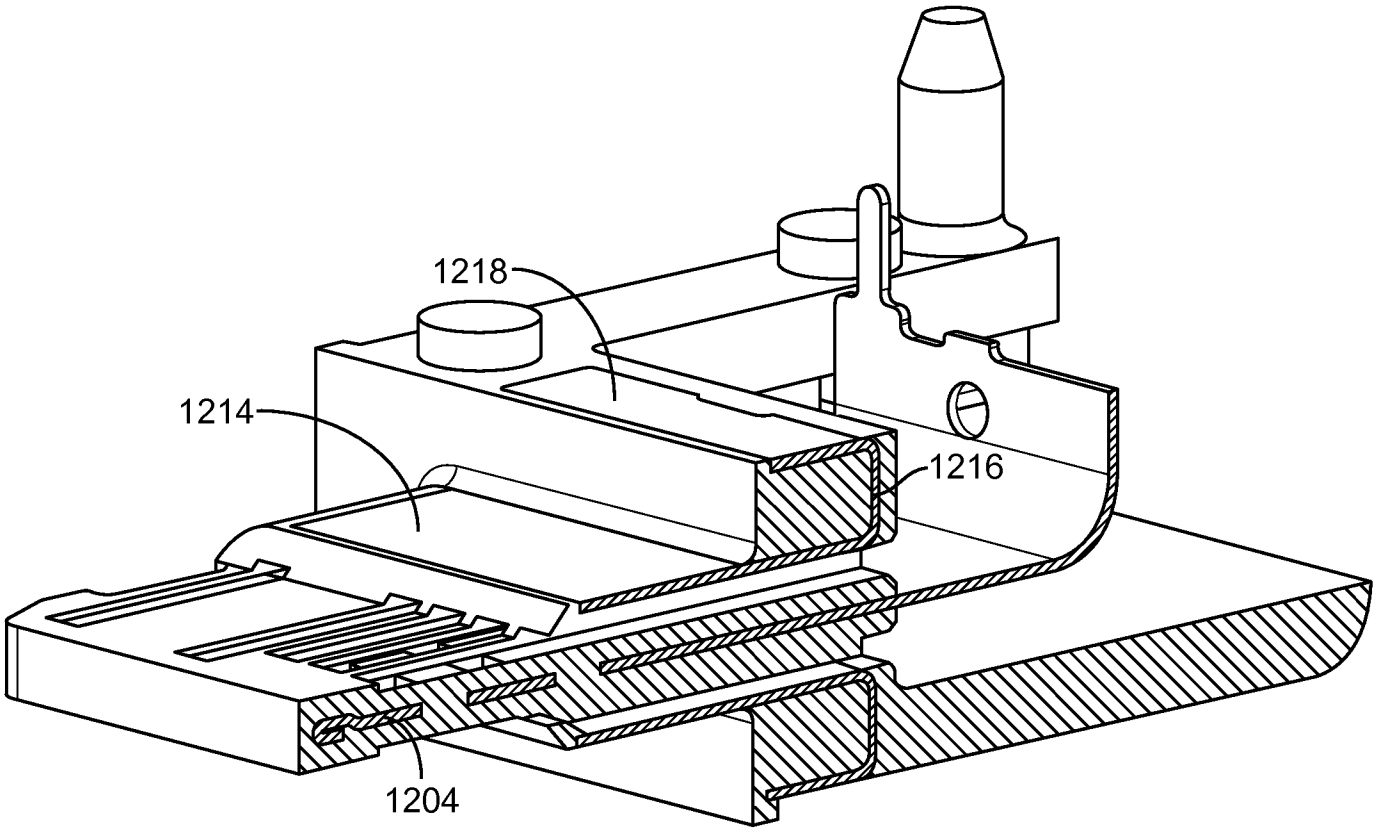
FIG. 16 illustrates another cutaway view of the connector receptacle of FIG. 14.

FIG. 16 illustrates another cutaway view of the connector receptacle of FIG. 14. In this example, the metallic center piece is folded to form sides 1216 and ground contacts 1218. A front folded portion 1610 may be formed to provide reinforcement at a front of the tongue.

Figure 17:
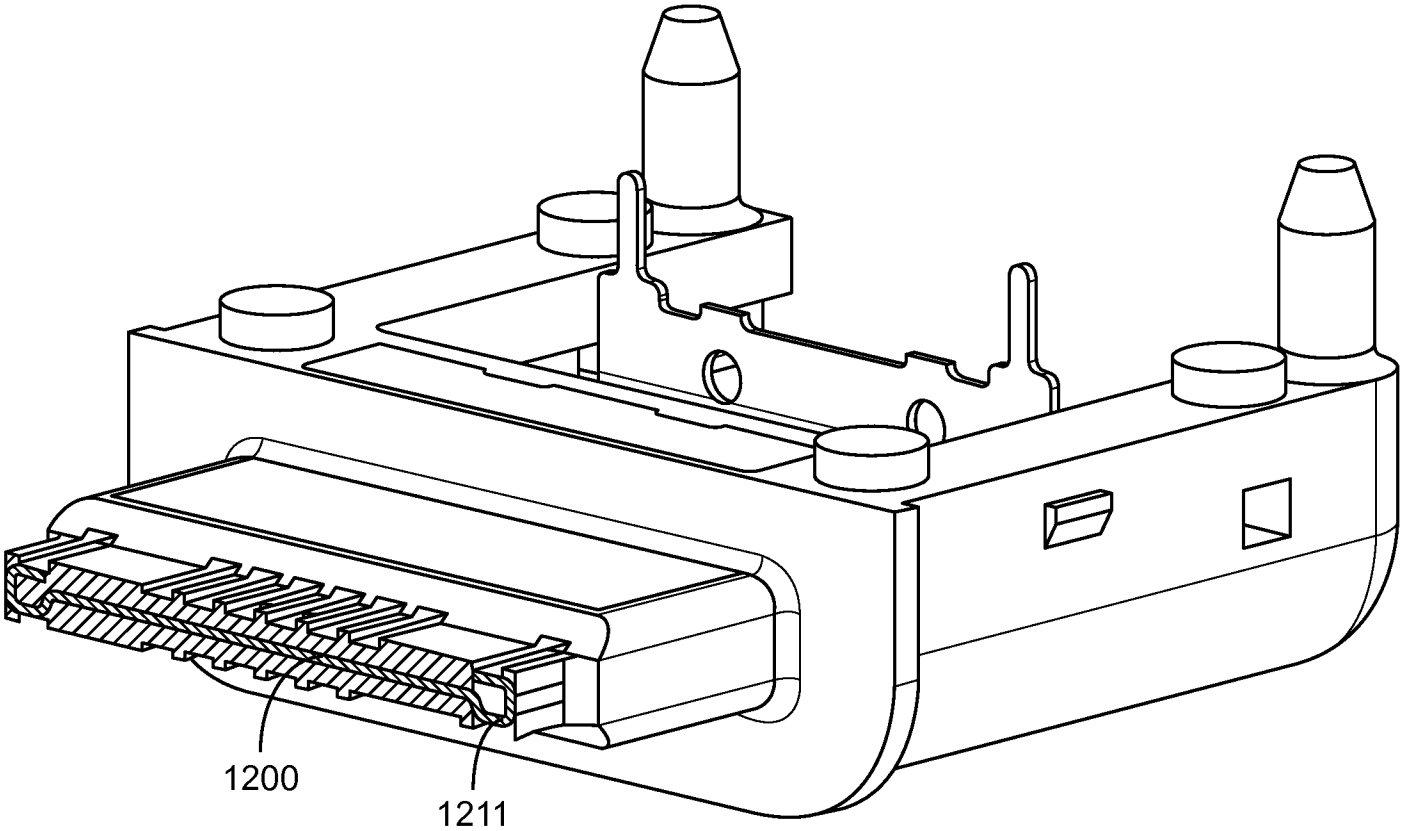
FIG. 17 illustrates another cutaway view of connector receptacle of FIG. 14.

FIG. 17 illustrates another cutaway view of connector receptacle of FIG. 14. In this example, folded side portions 1202 provide reinforcement at the sides of the tongue. An outside edge of folded side portion 1202 of metallic center piece 1200 may be left exposed by the first molded portion.

Figure 18:
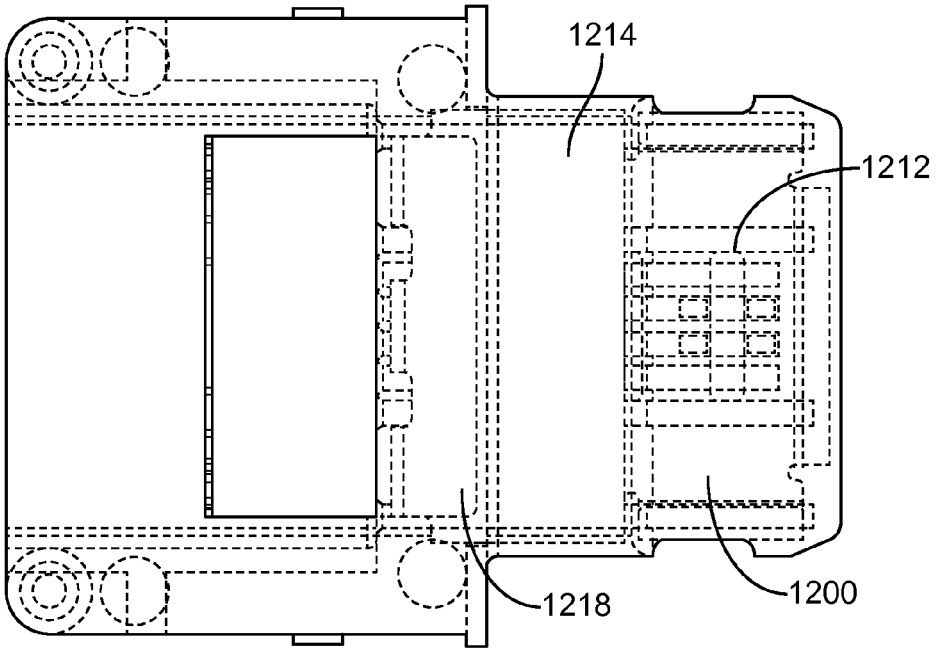
FIG. 18 illustrates a top view of a connector receptacle of FIG. 14.

FIG. 18 illustrates a top view of a connector receptacle of FIG. 14. This connector receptacle tongue may include metallic center piece 1200 supporting a tongue including contacts 1212, as well as ground contacts 1214 and 1218.

While in the above examples, the metallic center piece is formed as a unitary piece, in other embodiments of the present invention, a metallic center piece may be formed of two, three, or more individual pieces. These individual pieces may be soldered, spot or laser welded, or otherwise fixed to each other. Examples are shown in the following figures.

Figure 19:
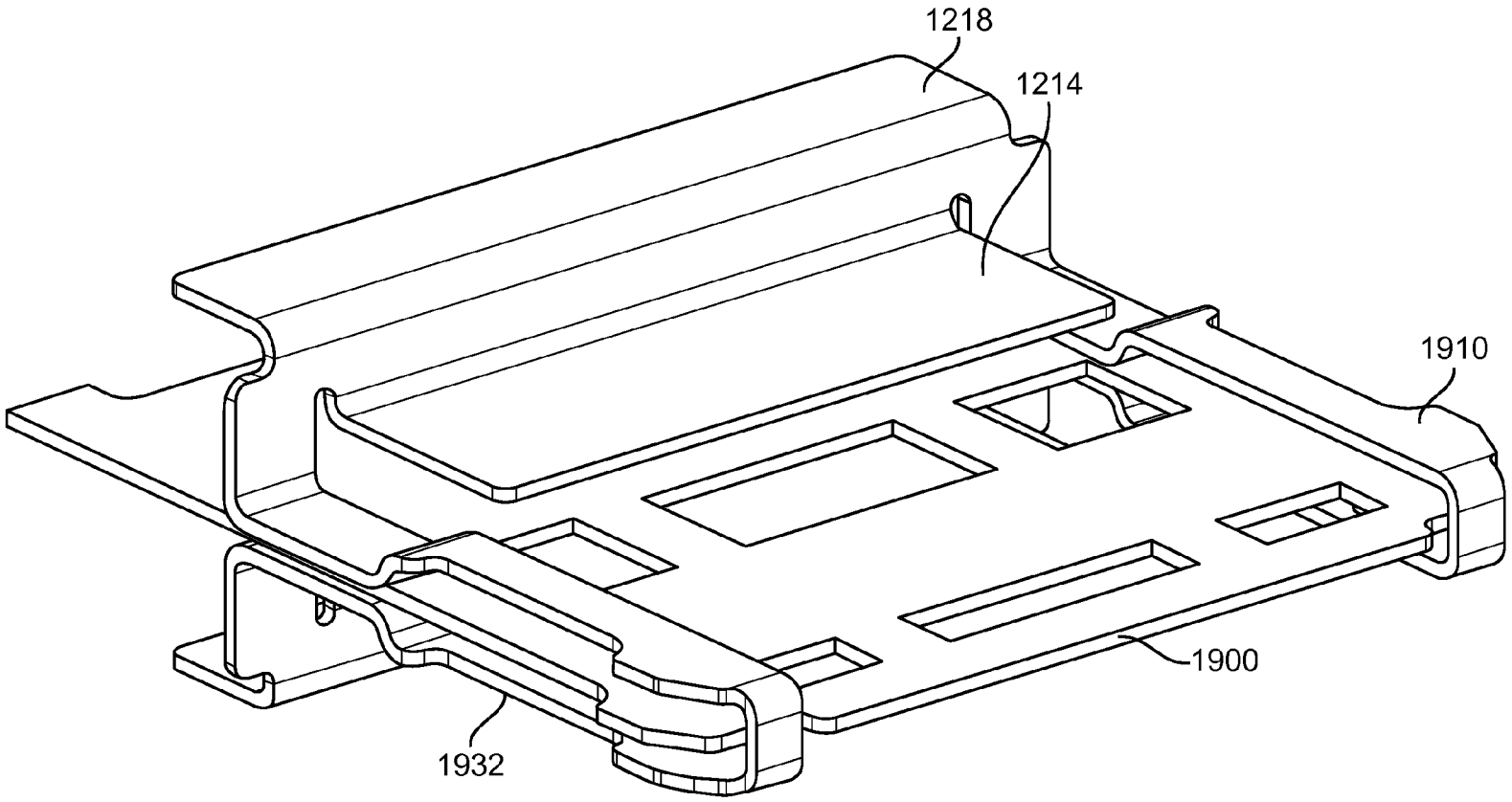
FIG. 19 illustrates a metallic center piece according to an embodiment of the present invention.

FIG. 19 illustrates a metallic center piece according to an embodiment of the present invention. In this example, a center portion 1900 may be attached to a second portion 1910. Second portion 1910 may be folded to form ground contacts 1214 and 1218. Outside edges 1932 may be exposed to a notch in the tongue. Edges 1932 may form electrical contact with retention features in a connector insert when the connector insert is inserted into a connector receptacle having this tongue.

One or more molding steps may be used to form a molded portion around this metallic center piece and to support a number of signal contacts. Various embodiments may employ two molding steps as shown above, where the first molded portion forms a support for a number of signal contacts, and a second overmold is placed around a rear of the tongue leaving ground contacts exposed. An example is shown in the following figure.

Figure 20:
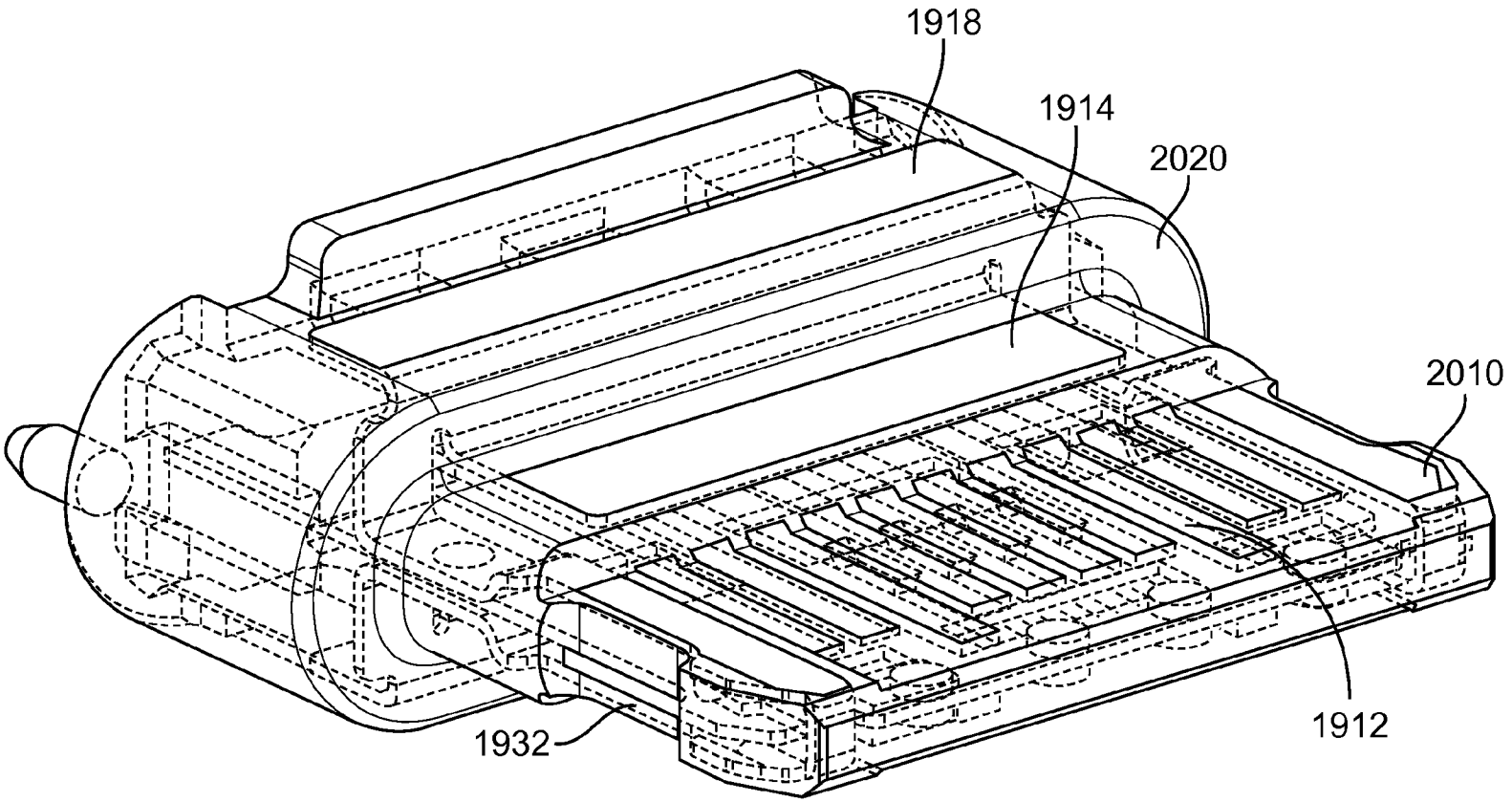
FIG. 20 illustrates a tongue for a connector receptacle according to an embodiment of the present invention.

FIG. 20 illustrates a tongue for a connector receptacle according to an embodiment of the present invention. As before, edges 1932 may be exposed at a notch in the tongue. Ground contacts 1914 and 1918 may be exposed, as are tops of signal contacts 1912. A first molded portion 2010 may form a front portion of the receptacle tongue, while a second overmold 2020 may be formed over a rear of the receptacle tongue.

Figure 21:
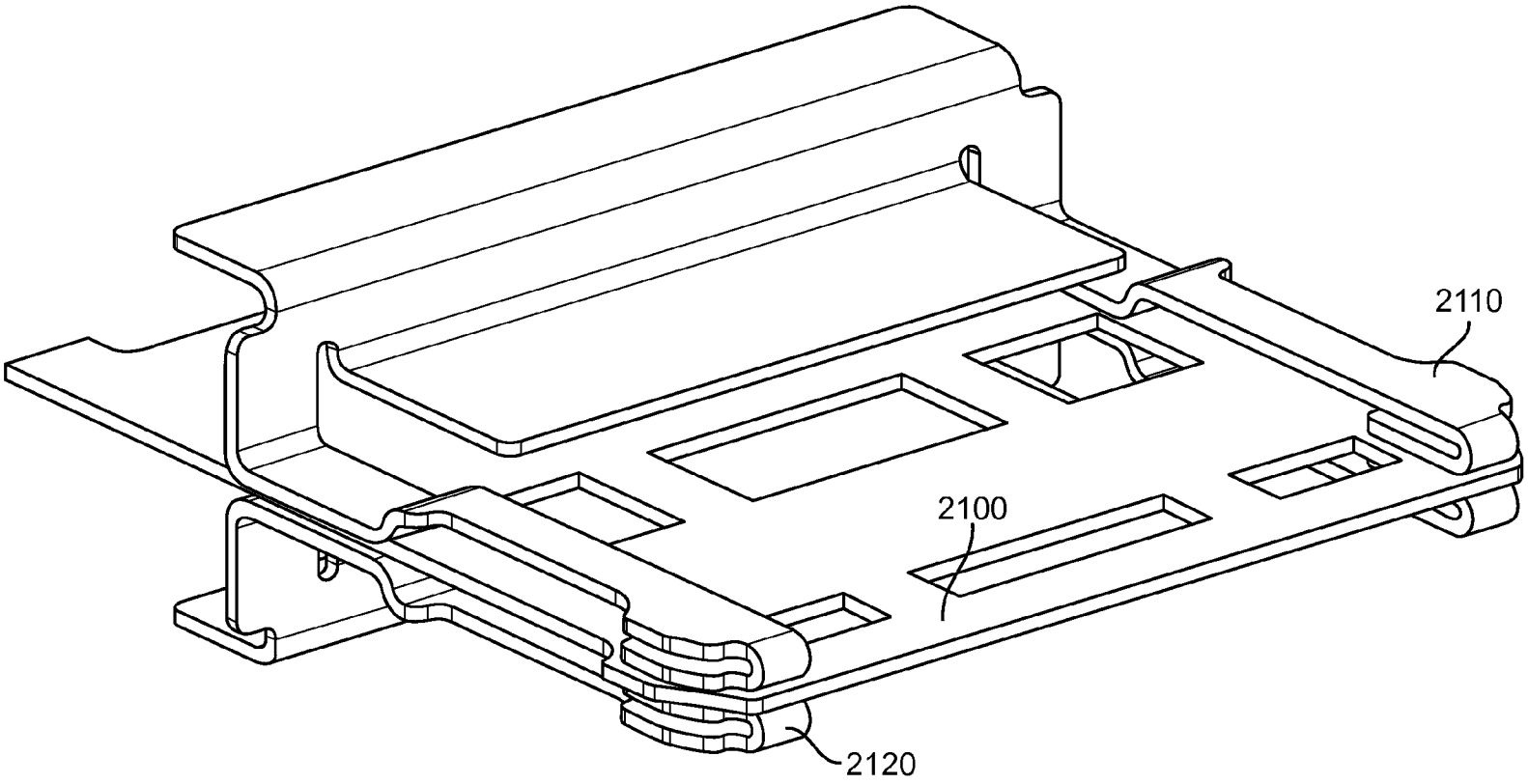
FIG. 21 illustrates another metallic center piece according to an embodiment of the present invention.

FIG. 21 illustrates another metallic center piece according to an embodiment of the present invention. In this example, the metallic center pieces formed of three pieces, a center piece 2100, a top piece 2110, and a bottom piece 2120. As before, the top and bottom pieces may be folded for ground contacts.

Figure 22:
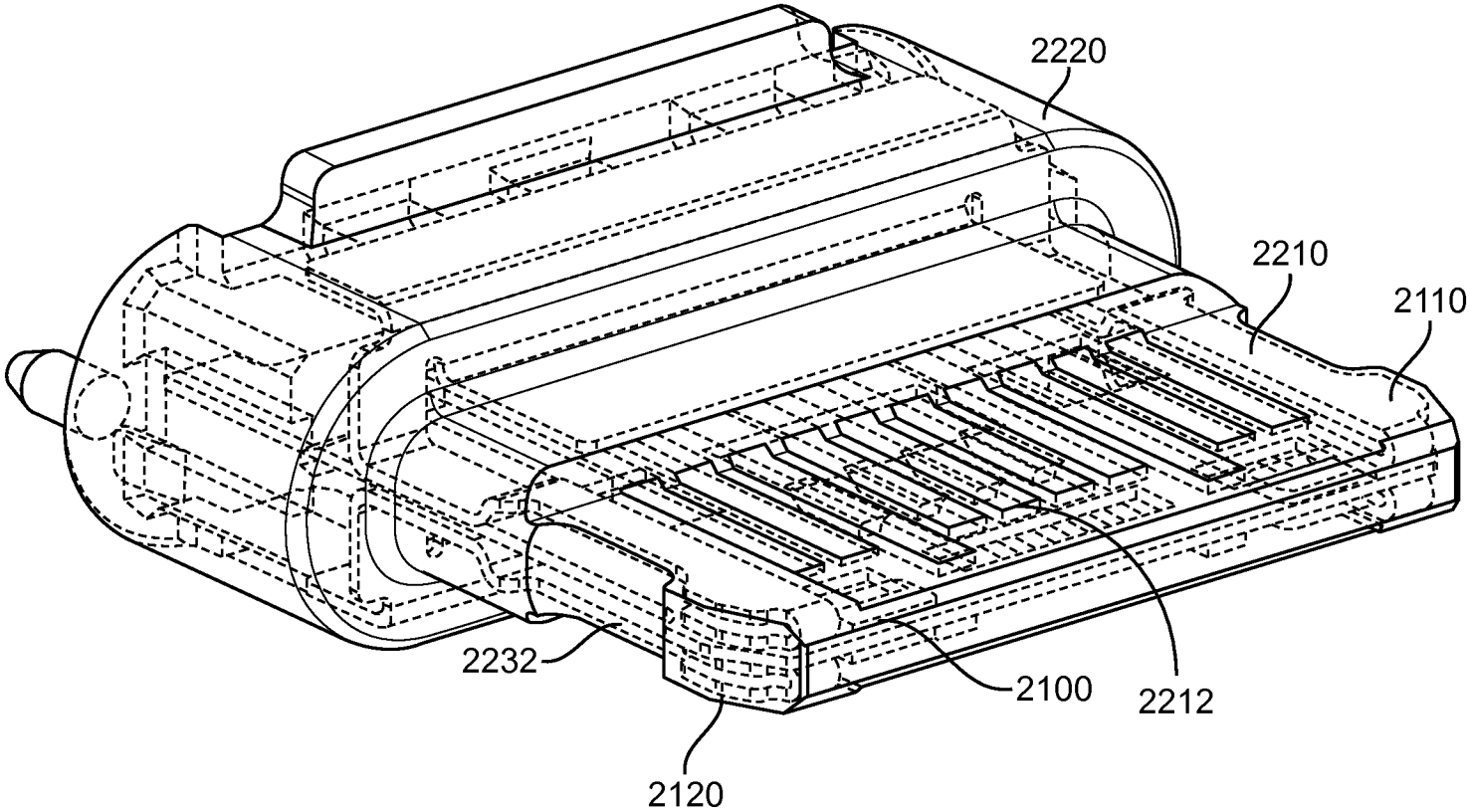
FIG. 22 illustrates a tongue for a connector receptacle according to an embodiment of the present invention.

FIG. 22 illustrates a tongue for a connector receptacle according to an embodiment of the present invention. As before, edges 2232 may be exposed at a notch of the tongue. Three pieces, 2100, 2110, and 2120 may be used to form the metallic center piece. First molded portion 2210 may provide support for contacts 2112, while a second overmold 2220 may form a rear of the connector receptacle tongue.

In another embodiment of the present invention, the three pieces used to form a metallic center piece may be stacked near a front of tongue to provide additional reinforcement. An example is shown in the following figure.

Figure 23:
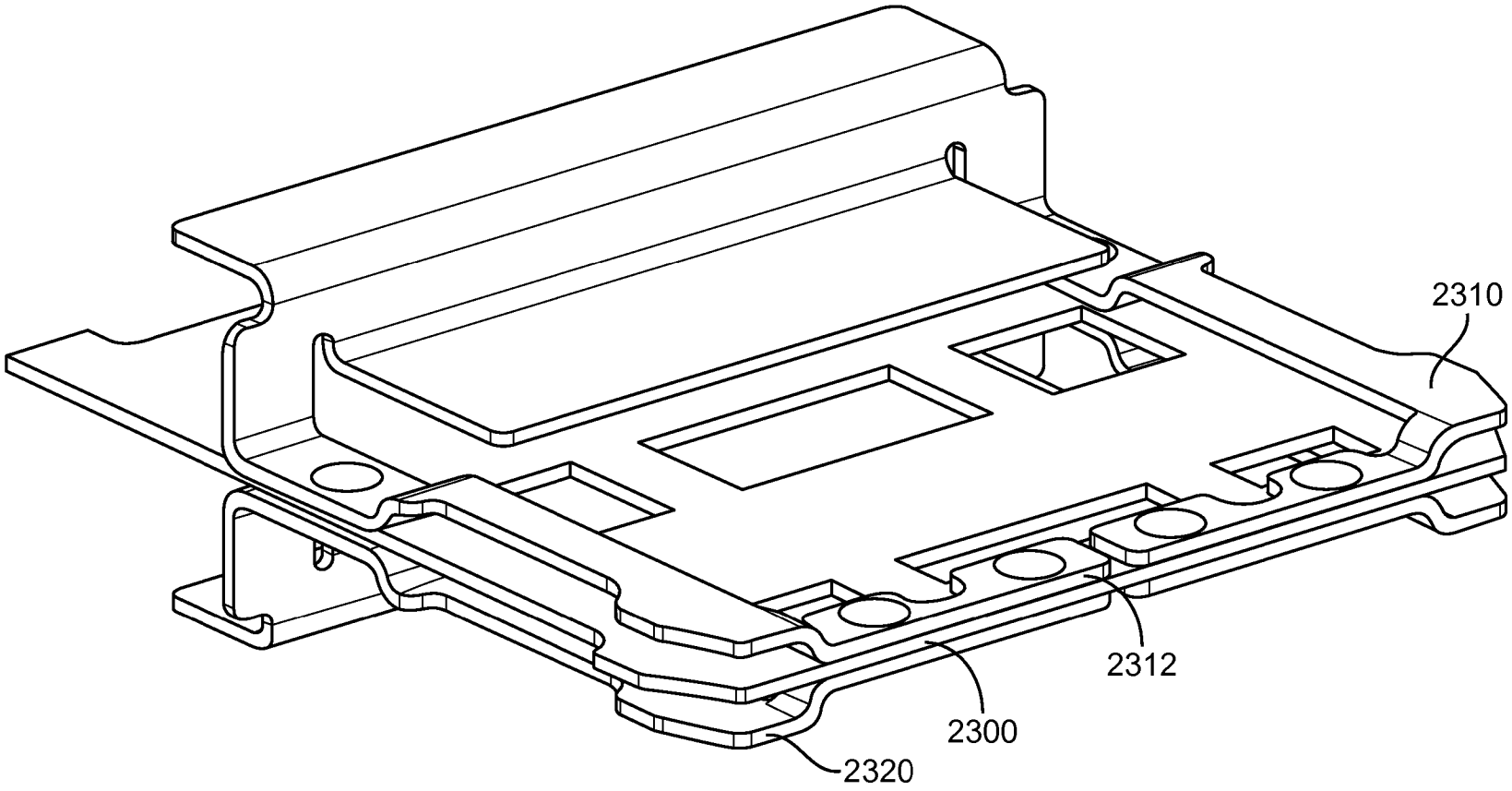
FIG. 23 illustrates a metallic center piece according to an embodiment of the present invention.

FIG. 23 illustrates a metallic center piece according to an embodiment of the present invention. In this example, the metallic center piece is formed of three pieces, a center portion 2300, a top piece 2310, and a bottom piece 2320. The top and bottom pieces extend along a front as shown as front lateral extensions 2312 to provide additional reinforcement at the front of the connector receptacle tongue.

Figure 24:
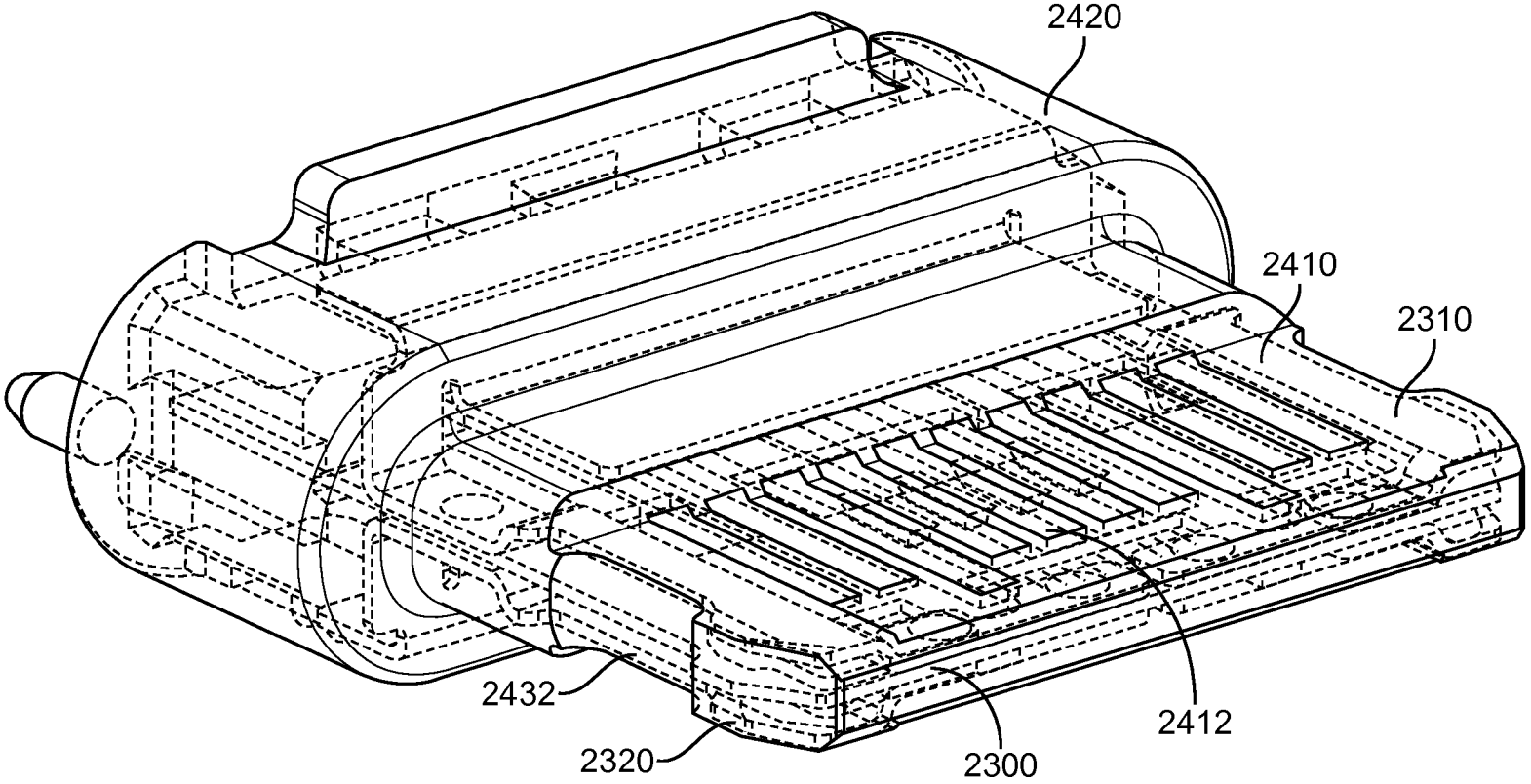
FIG. 24 illustrates a tongue for a connector receptacle according to an embodiment of the present invention.

FIG. 24 illustrates a tongue for a connector receptacle according to an embodiment of the present invention. As before, edges 2432 may be exposed in a notch of the tongue. Three pieces may be used to form the metallic center piece, including a middle layer 2300 a top layer 2310, and a bottom layer 2320. First molded portion 2410 may support contacts 2412, while a second overmold portion 2420 may form a rear of the tongue.

In various embodiments of the present invention, front lateral extensions 2312 may be shorter than in the above example. An example is shown in the following figure.

Figure 25:
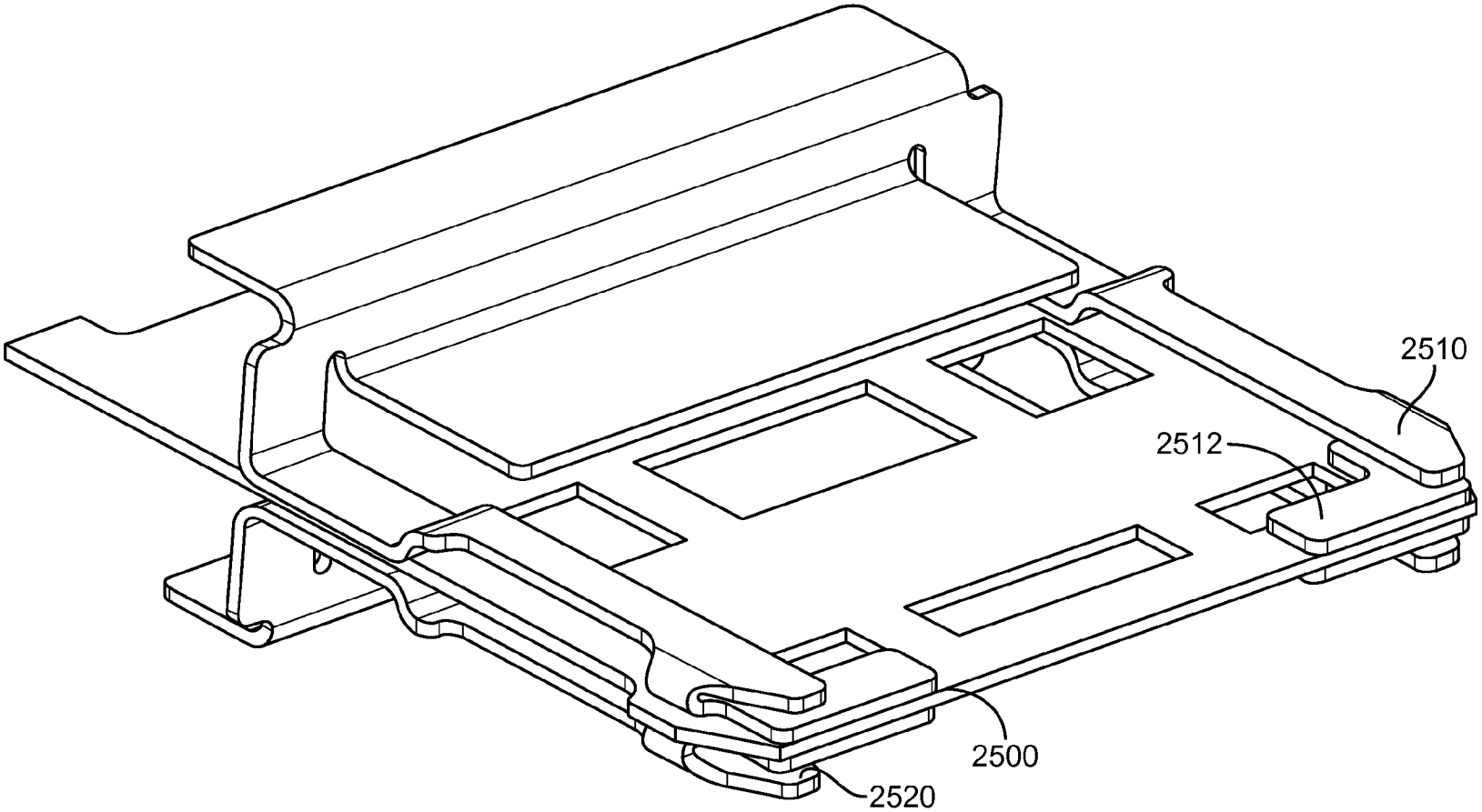
FIG. 25 illustrates a metallic center piece according to an embodiment of the present invention.

FIG. 25 illustrates a metallic center piece according to an embodiment of the present invention. In this example, the metallic center piece is formed of three pieces, a center portion 2500, a top portion 2510, and a bottom portion 2520. Lateral extensions 2512 in this example may be noticeably shorter than the front lateral extensions 2312 in the above example.

Figure 26:
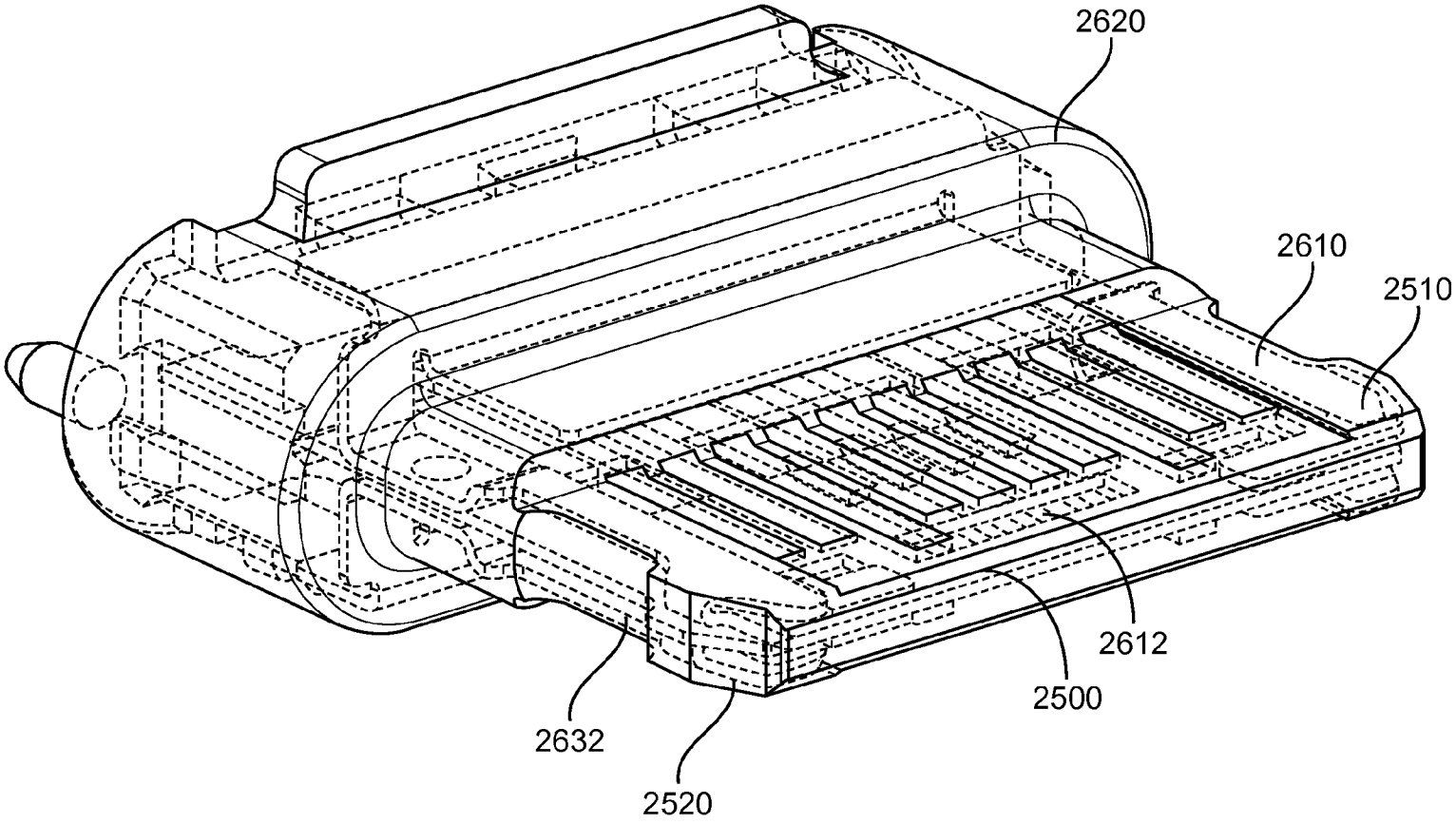
FIG. 26 illustrates a tongue for a connector receptacle according to an embodiment of the present invention.

FIG. 26 illustrates a tongue for a connector receptacle according to an embodiment of the present invention. As before, edges 2632 may be exposed in notches of the tongue. Again, three pieces may be used to form a metallic center piece, a center portion 2500, a top portion 2510, and a bottom portion 2520. First and second molded portions 2610 and 2620 may be used as before. First molded portion 2610 may be used to support contacts 2612.

In the above embodiments of the present invention, the metallic center piece may be formed as a single piece or unit. For example, the metallic center piece may be stamped and folded from a single piece of sheet metal. Again, in other embodiments of the present invention, the metallic center piece may be formed of multiple pieces. An example is shown in the following figure.

Figure 27:
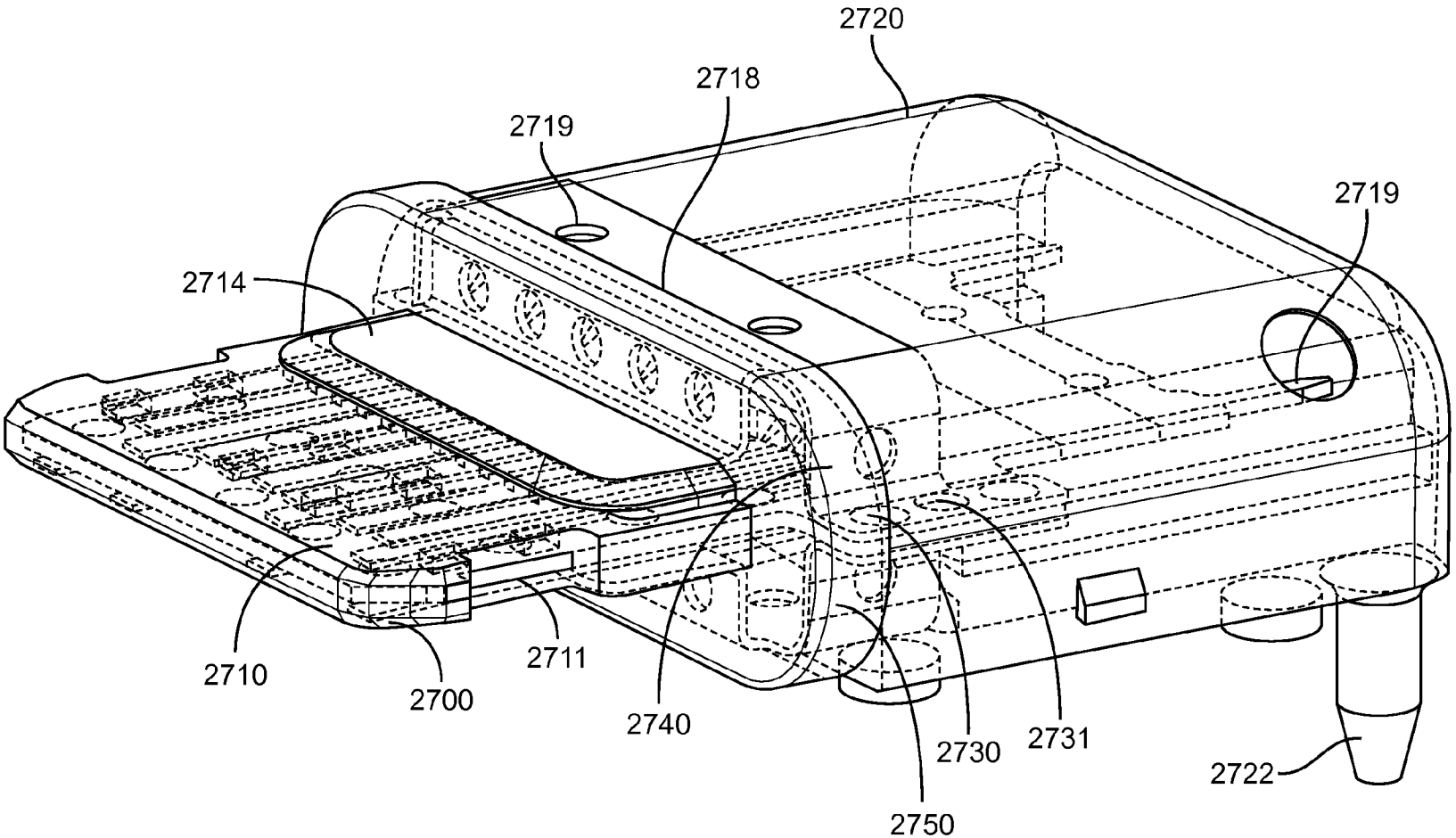
FIG. 27 illustrates another tongue for a connector receptacle according to an embodiment of the present invention.

FIG. 27 illustrates another tongue for a connector receptacle according to an embodiment of the present invention. In this specific embodiment of the present invention, the metallic center piece may be formed of three individual pieces. Specifically, the metallic center piece may be formed of a center portion 2710, an upper portion 2740 forming ground contacts 2714 and 2718, and a lower portion 2750. Center portion 2710, upper portion 2740, and lower portion 2750 may each include side tabs 2730. Side tabs 2730 may be laser welded together to secure upper portion 2740, lower portion 2750, and center portion 2710 together. These tabs may also be used to align the metal portions to each other during laser welding. Specifically, these tabs may be aligned and clamped together during laser welding.

Center portion 2710 may provide reinforcement for tongue 2700. Upper portion 2740 may provide an upper ground contact 2718 and a lower ground contact 2714. Lower portion 2750 may provide similar ground contacts on the underside of this tongue. The metallic center piece may be housed in housing 2720. Housing 2720 may include posts 2722, which may be inserted in a printed circuit board or other appropriate substrate for mechanical stability. The portions of the metallic center piece may include holes or openings, such as openings 2719, to improve the flow of plastic or other material during the molding process. While the tongues shown in these examples, or similar tongues consistent with embodiments of the present invention, may be used in a connector receptacle, in other embodiments of the present invention, these or similar tongues may be used in connector inserts.

Figure 28:
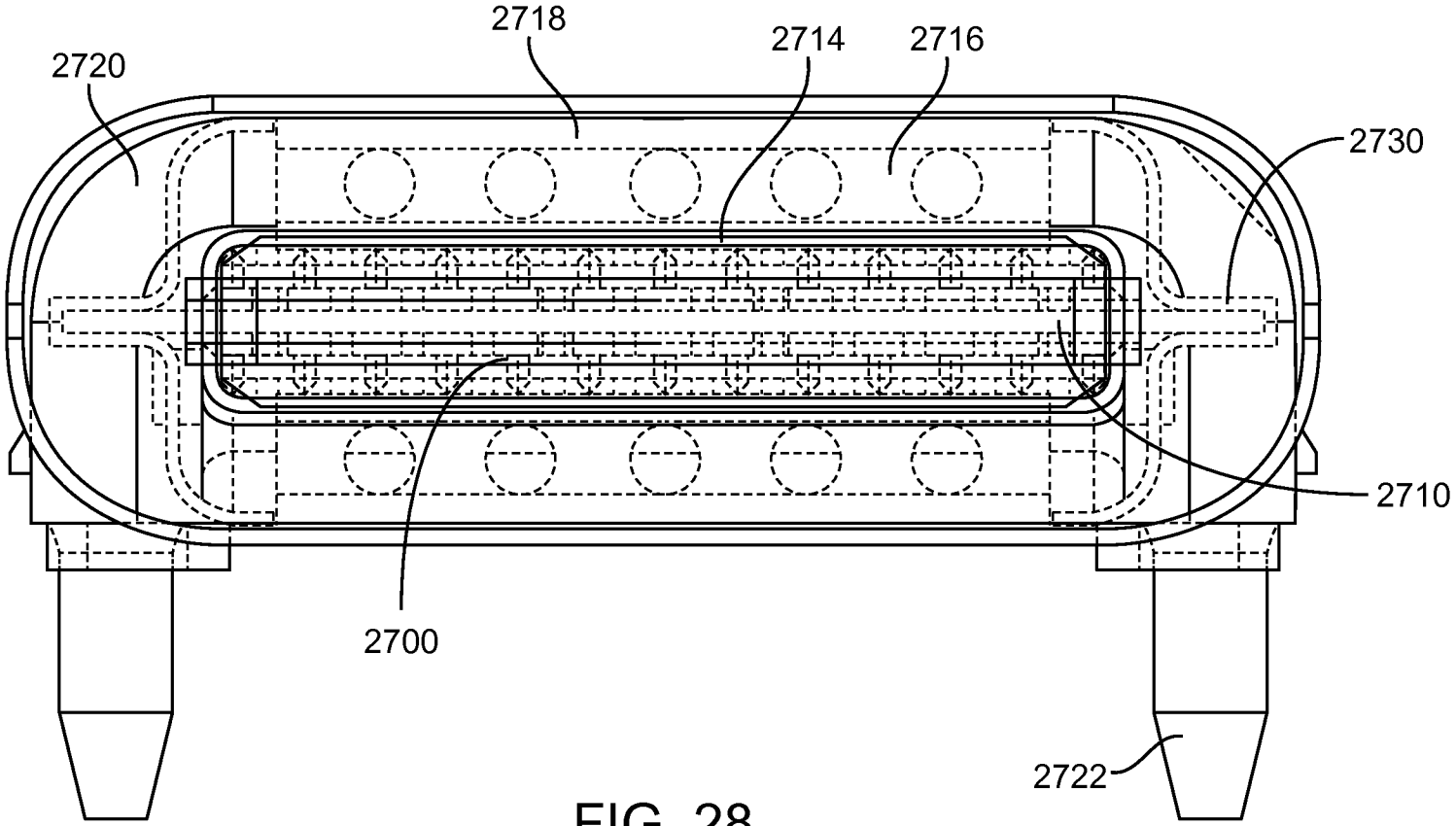
FIG. 28 illustrates a front view of the connector receptacle tongue of FIG. 27.

FIG. 28 illustrates a front view of the connector receptacle tongue of FIG. 27. Again, the reinforcing metallic center piece may include a center portion 2710, an upper portion 2740, and a lower portion 2750. These portions may include tabs 2730, which may be aligned and held together during a laser welding process to secure three pieces together as a unit. The upper portions and lower portions may be folded to form upper ground contacts 2718 and lower ground contacts 2714, which may be joined together by a vertical face 2716. In this example, center portion 2710 may be used to reinforce tongue 2700. Housing 2720 may be formed around the metallic center piece, and may include posts 2742 for mechanical stability.

Figure 29:
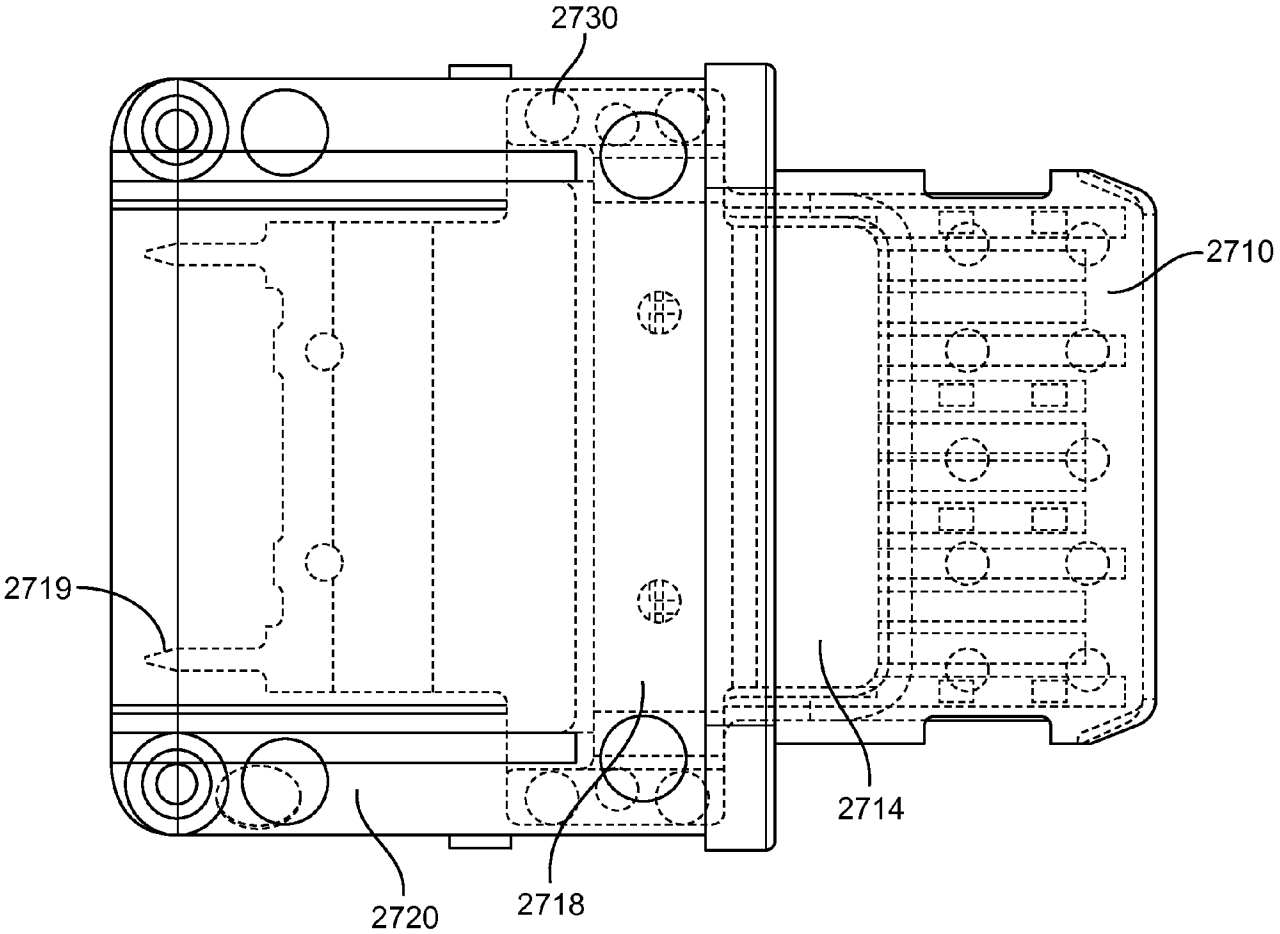
FIG. 29 illustrates a top view of the connector receptacle tongue of FIG. 27.

FIG. 29 illustrates a top view of the connector receptacle tongue of FIG. 27. Again, a metallic center piece may include a center portion 2710 and upper portion forming ground contacts 2714 and 2718. Tabs 2719 may extend from a rear of center a portion 2710. These tabs 2719 and a supporting portion may be folded downward and tabs 2719 may be inserted into a printed circuit board or other appropriate substrate. Housing 2720 may surround portions of the metallic center piece such that ground contacts 2714 and 2718 are exposed. As before, the portions of the metallic center piece may include side tabs 2730. Tabs 2730 may be aligned with each other and used to clamp or hold the individual pieces of the metallic and piece together during laser or spot welding.

Figure 30:
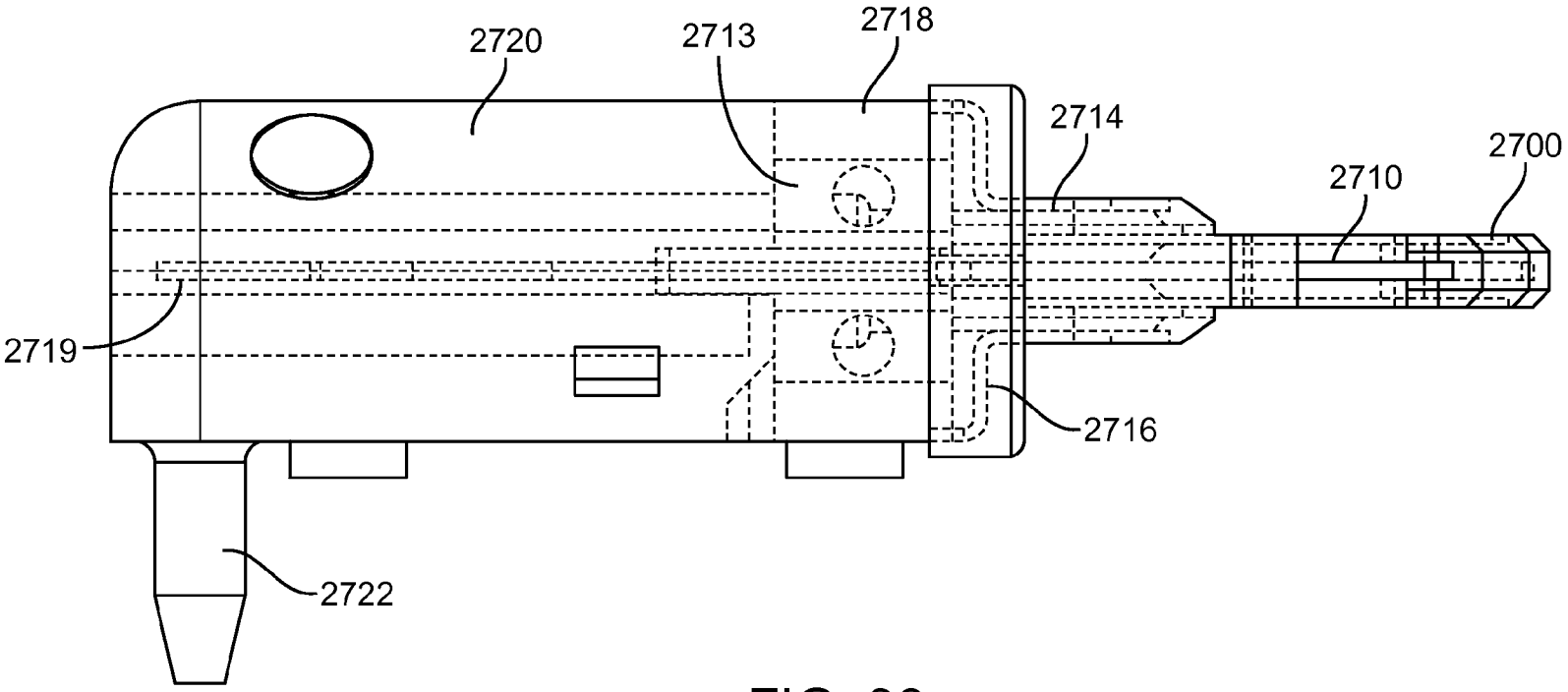
FIG. 30 illustrates a side view of the connector receptacle tongue of FIG. 27.

FIG. 30 illustrates a side view of the connector receptacle tongue of FIG. 27. As before, tongue 2700 may be reinforced with a center portion 2710 of the metallic center piece. The metallic center piece may further include an upper portion 2740 and a lower portion 2750. These upper and lower portions may provide ground contacts 2714 and 2718. The metallic center piece maybe housed in housing 2720 that may include tabs 2722. Tabs 2719 may extend from a backend of center portion 2710. This rear portion may be folded downward such that tabs 2719 may extend from a bottom of housing 2720 where they may be inserted in to openings in a printed circuit board.

Figure 31:
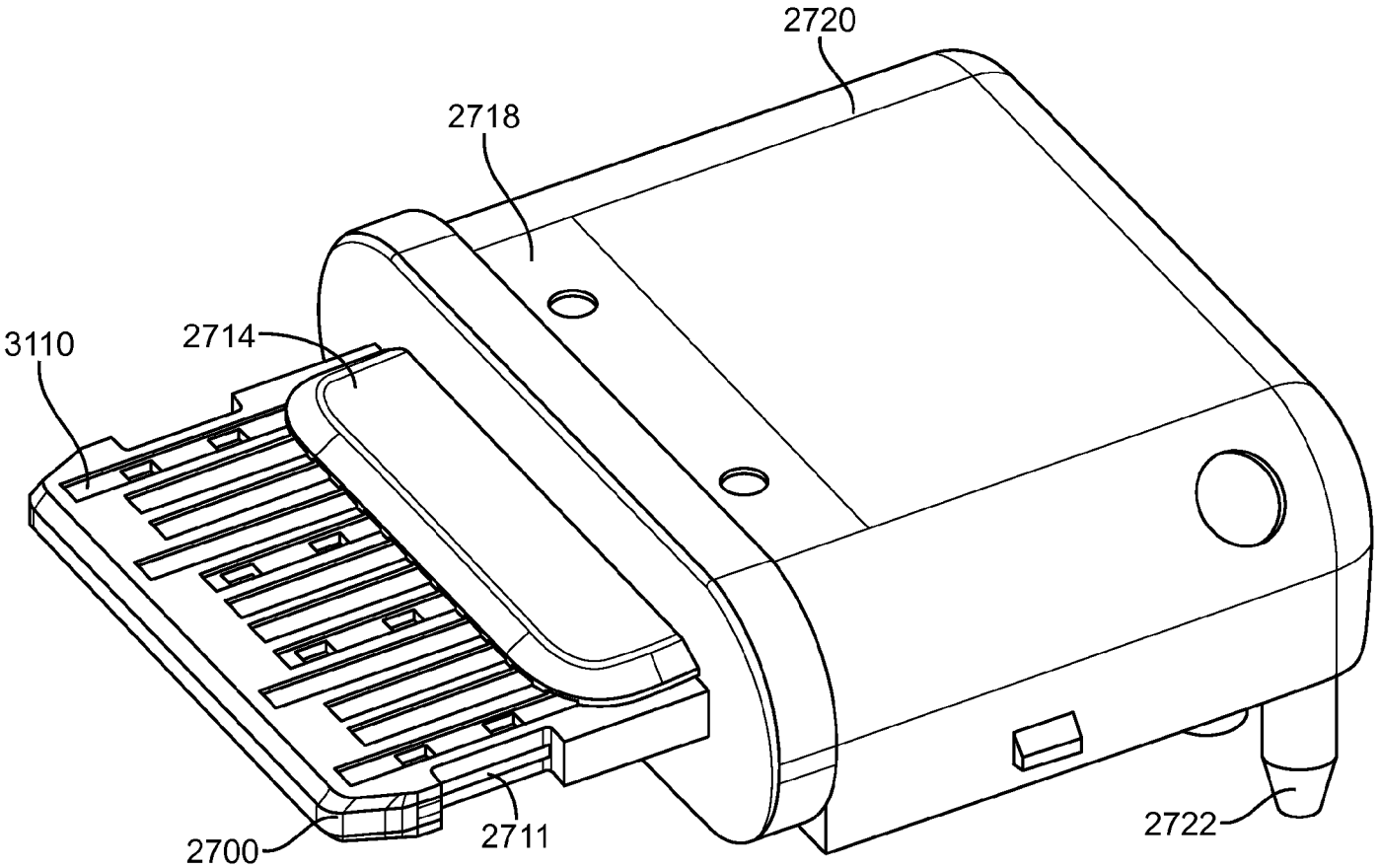
FIG. 31 illustrates a top oblique view of the connector receptacle tongue of FIG. 27.

FIG. 31 illustrates a top oblique view of the connector receptacle tongue of FIG. 27. Tongue 2700 may include slots 3110 for a plurality of contacts. Housing 2720 may be formed such that ground contacts 2714 and 2718 are exposed. Housing 2720 may include tabs 2722.

Figure 32:
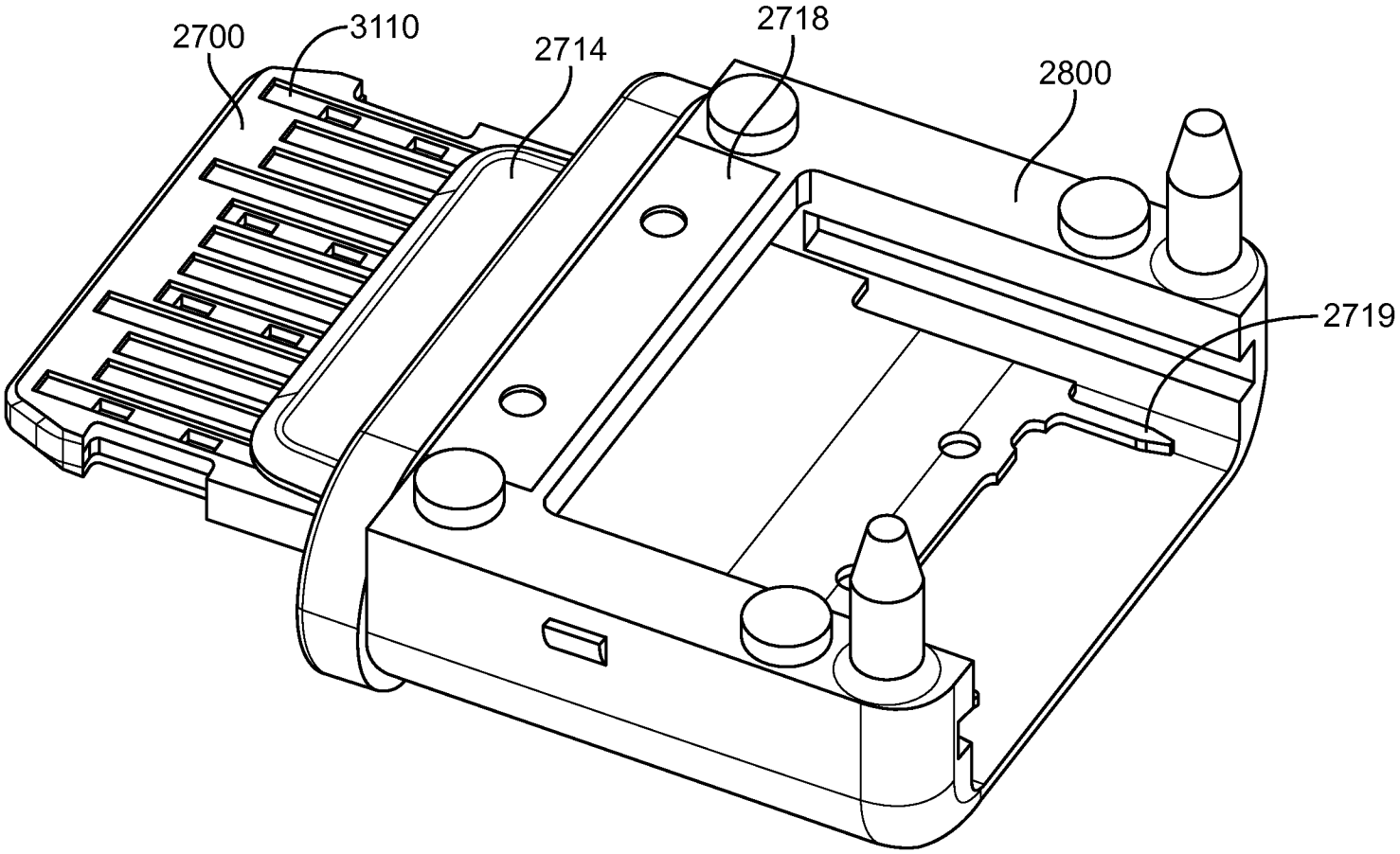
FIG. 32 illustrates an underside oblique view of the connector receptacle tongue of FIG. 27.

FIG. 32 illustrates an underside oblique view of the connector receptacle tongue of FIG. 27. Again, tongue 2700 may include slots 3110 for a plurality of contacts. A rear portion of a center portion including tabs 2719 may be angled such that tabs 2719 extend beyond a bottom of housing 2820. This may allow tabs 2719 to be inserted into openings in a printed circuit board or other appropriate substrate. As before, housing 2820 may be arranged such that ground contacts 2714 and 2718 are exposed.

Figure 33:
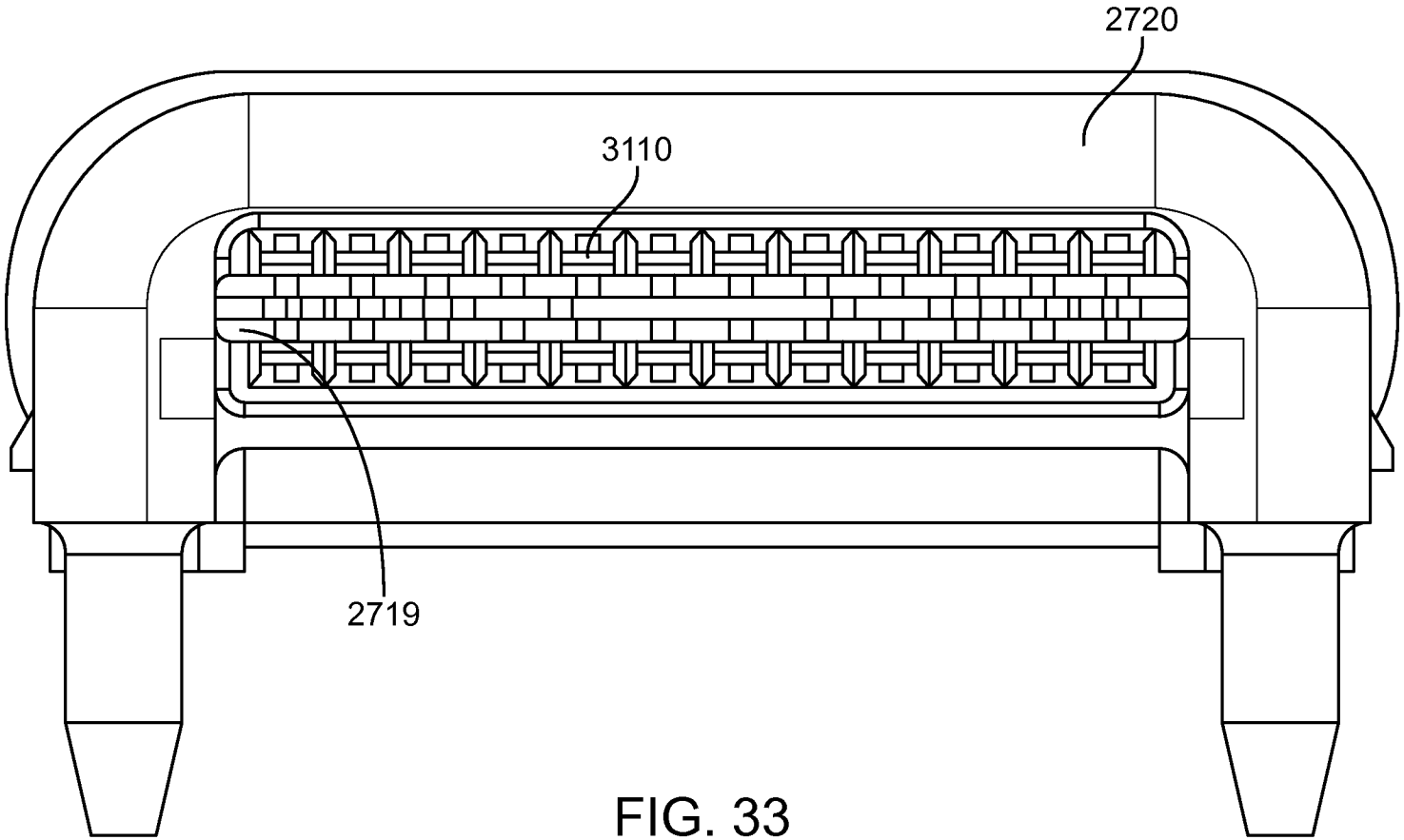
FIG. 33 illustrates a rear view of the connector receptacle tongue of FIG. 27.

FIG. 33 illustrates a rear view of the connector receptacle tongue of FIG. 27. Again, housing 2720 may be arranged to form slots 3110 for a plurality of contacts. A metallic center portion may include tabs 2719 as before.

Figure 34:
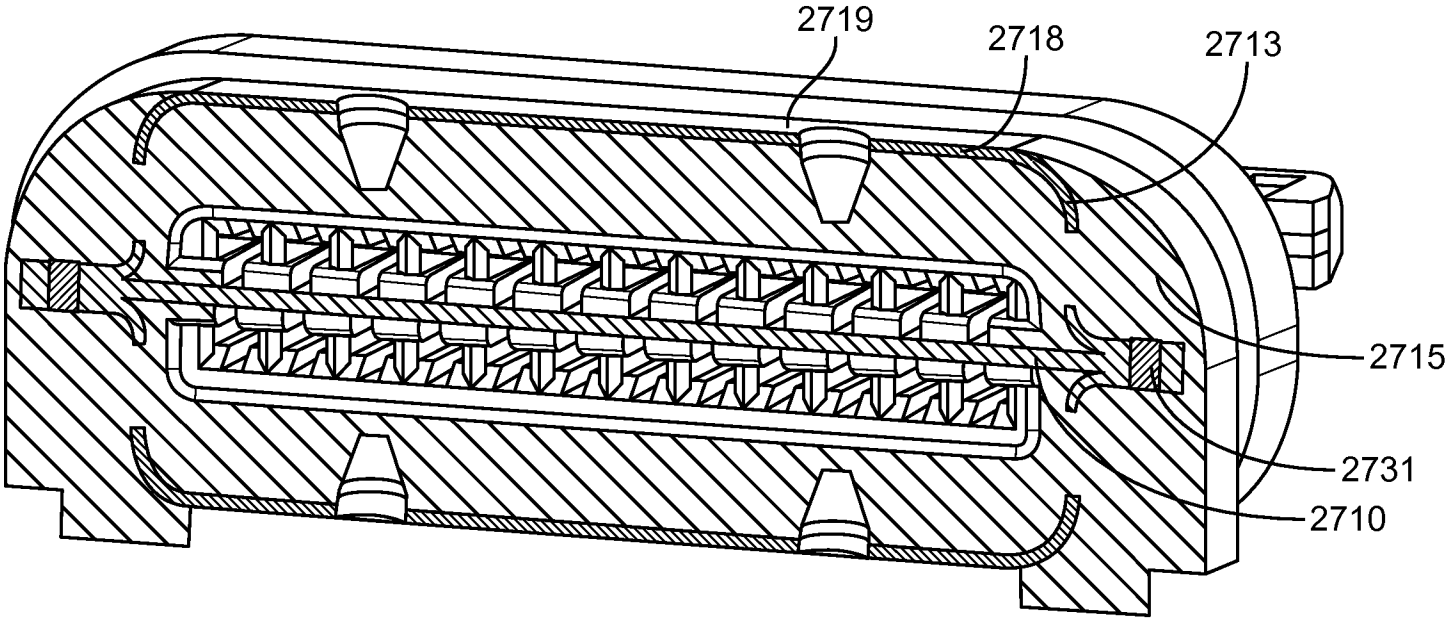
FIG. 34 illustrates a cutaway view of the connector receptacle tongue of FIG. 27.

FIG. 34 illustrates another cutaway view of the connector receptacle tongue of FIG. 27. This example shows slices of a metallic center piece including center portion 2710 and upper portion including ground contact 2718 and sidewall portion 2713, and a mirrored bottom portion. Side tabs 2730 may include openings 2731.

Figure 35:
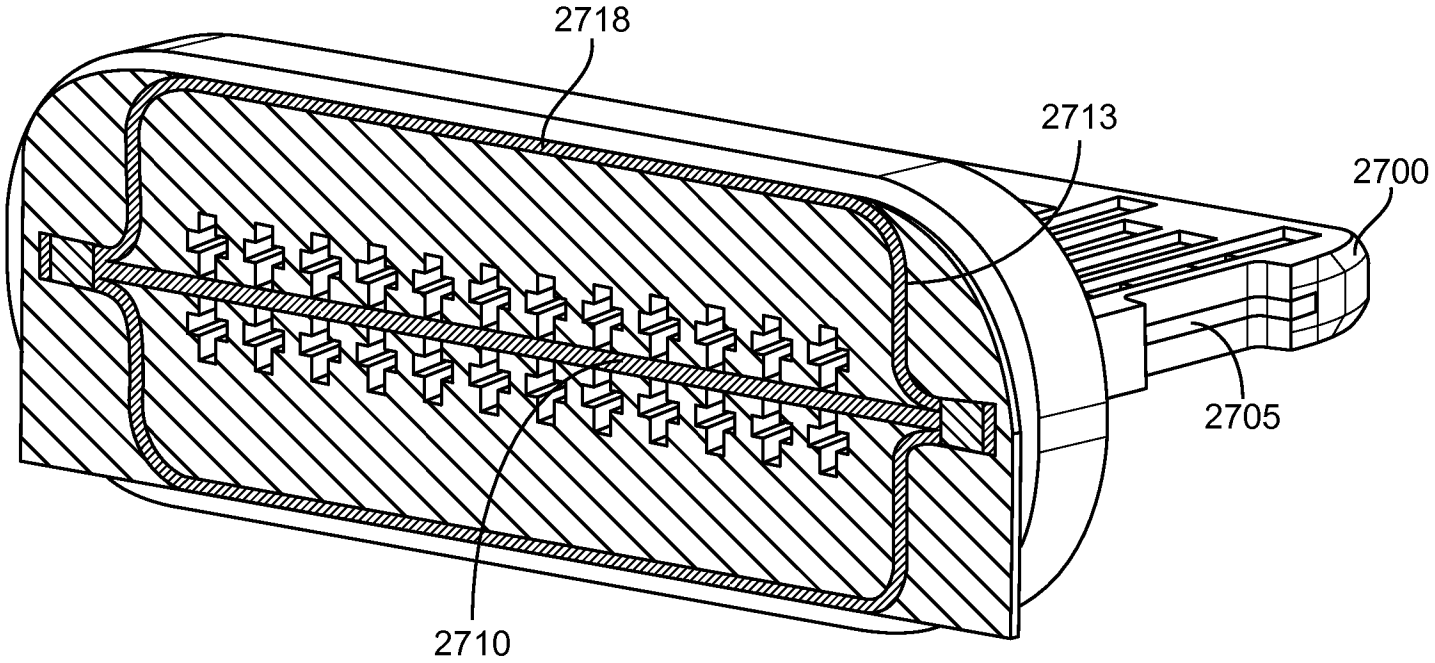
FIG. 35 illustrates another cutaway view of the connector receptacle tongue of FIG. 27.

FIG. 35 illustrates another cutaway view of the connector receptacle tongue of FIG. 27. Again, a metallic center piece may include a center portion 2710, and upper portion including ground contact 2718 and sidewall 2713. A side portion 2705 of center a portion 2710 may be exposed on tongue 2700. This may provide an electrical connection with side ground contacts on a connector insert when the insert is inserted into a connector receptacle including this tongue.

Figure 36:
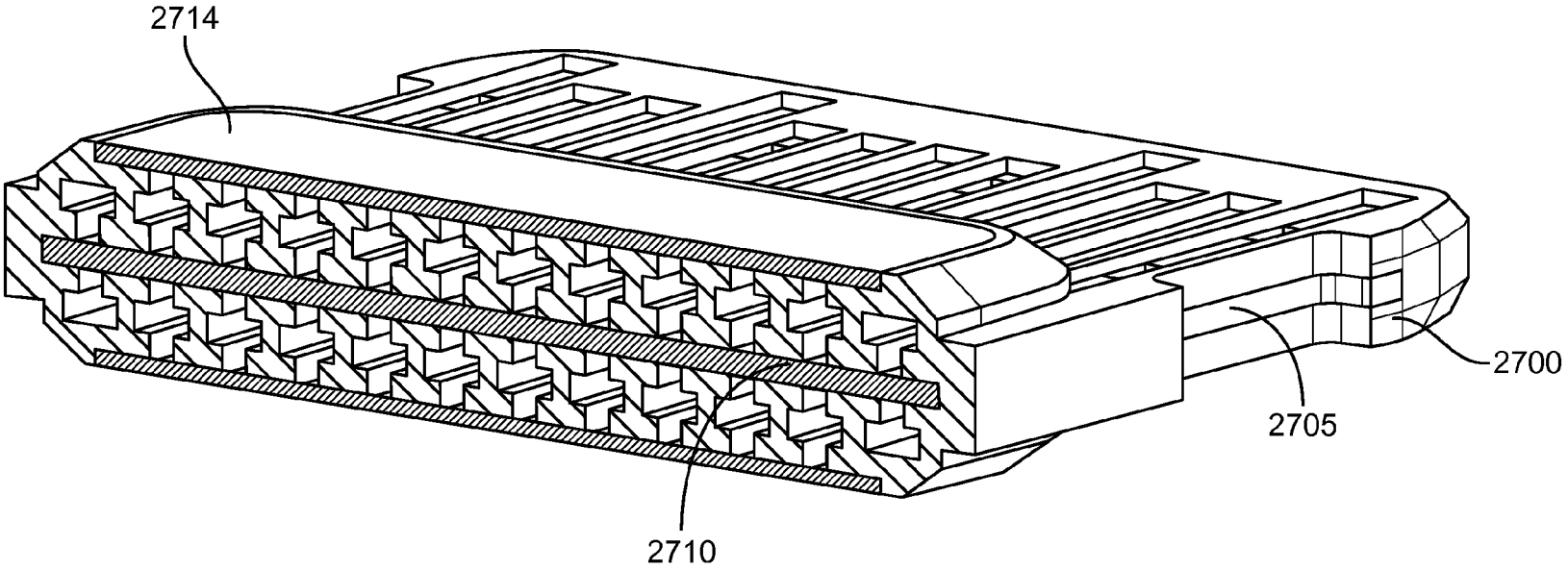
FIG. 36 illustrates another cutaway view of the connector receptacle tongue of FIG. 27.

FIG. 36 illustrates another cutaway view of the connector receptacle tongue of FIG. 27. Again, a metallic center piece may include a center portion 2710 forming side ground contacts 2705 in tongue 2700. The metallic center piece may also include an upper portion and lower portion forming ground contacts 2714.

Figure 37:
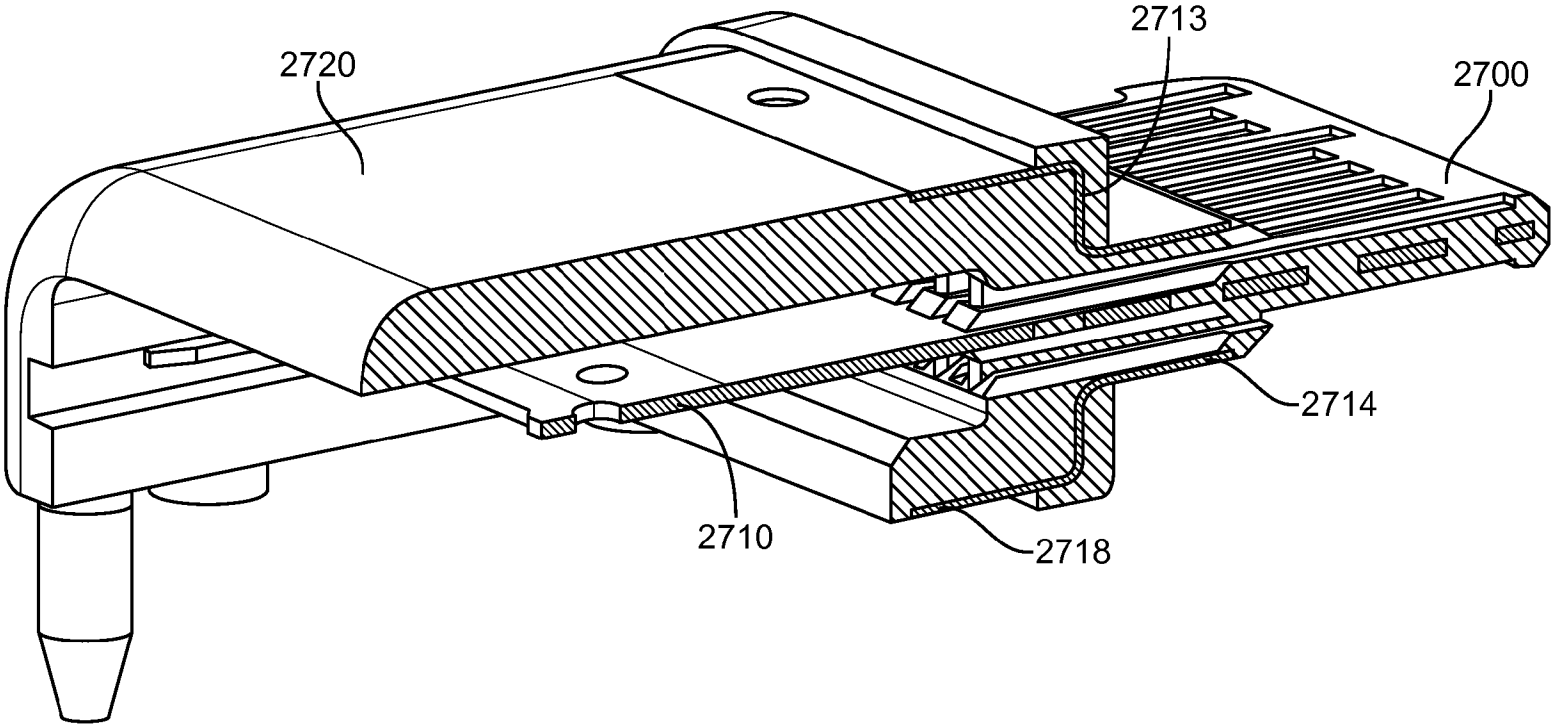
FIG. 37 illustrates another cutaway view of the connector receptacle tongue of FIG. 27.

FIG. 37 illustrates another cutaway view of the connector receptacle tongue of FIG. 27. Again, this tongue may include a metallic center piece having a portion 2710 for providing reinforcement for tongue 2700. Upper and lower portions forming ground contacts 2714 and 2718 may be provided. Ground contacts 2714 and 2718 may be attached by vertical face 2713. Housing 2720 may be formed around portions of the metallic center piece such that ground contacts 2714 and 2718 are exposed.

Other illustrative embodiments of the present invention may employ tongues for connector receptacles, where the tongues may include one or more printed circuit board portions. Using a printed circuit board may provide a connector receptacle tongue where signal traces may be well-matched and shielded. Examples are shown in the following figures.

Figure 38:
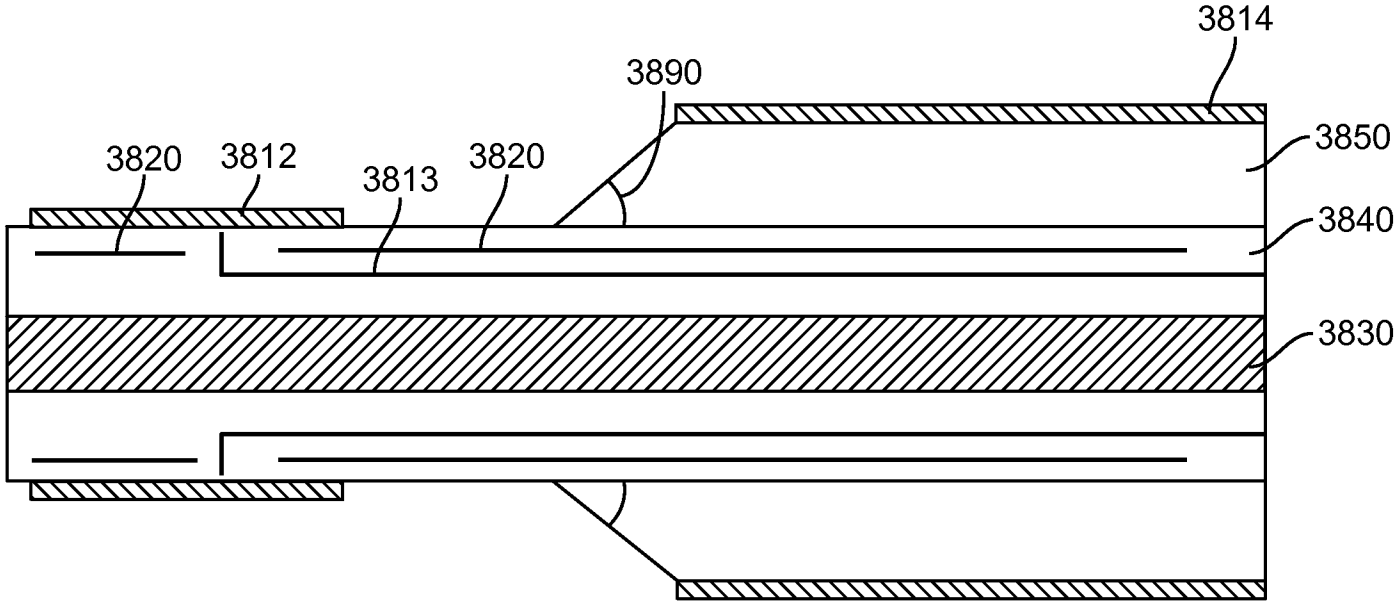
FIG. 38 illustrates a portion of a connector receptacle tongue according to an embodiment of the present invention.

FIG. 38 illustrates a portion of a connector receptacle tongue according to an embodiment of the present invention. This tongue may include a metal core 3830. Metal core 3830 may provide mechanical reinforcement for the tongue, as well as electrical isolation between traces on a top and bottom of the tongue. A first printed circuit board portion 3840 may be placed on a surface of metal core 3830. Printed circuit board 3840 may support contacts 3812, interconnect 3813, and ground shielding 3820. Additional printed circuit board portion 3850 may be placed on first circuit board portion 3840. The additional circuit board portion 3850 may be attached, laminated, or otherwise form for fixed to a surface of first printed circuit board portion 3840. In other embodiments the present invention, portions of a second printed circuit board portions may be removed, leaving the additional printed circuit board portion 3850 behind. Additional printed circuit board portion 3850 may be plated to form ground contacts 3814. Angle 3890 may be various angles, for example it may be at least approximately 10, 20, 30, 40, 50, 60 degrees or more.

In this embodiment of the present invention, it may be desirable to route a trace from one side of the tongue to another. Accordingly, embodiments of the present invention may provide isolation between a metal core and a via used to connect traces on a top and bottom of the tongue. An example is shown in the following figure.

Figure 39:
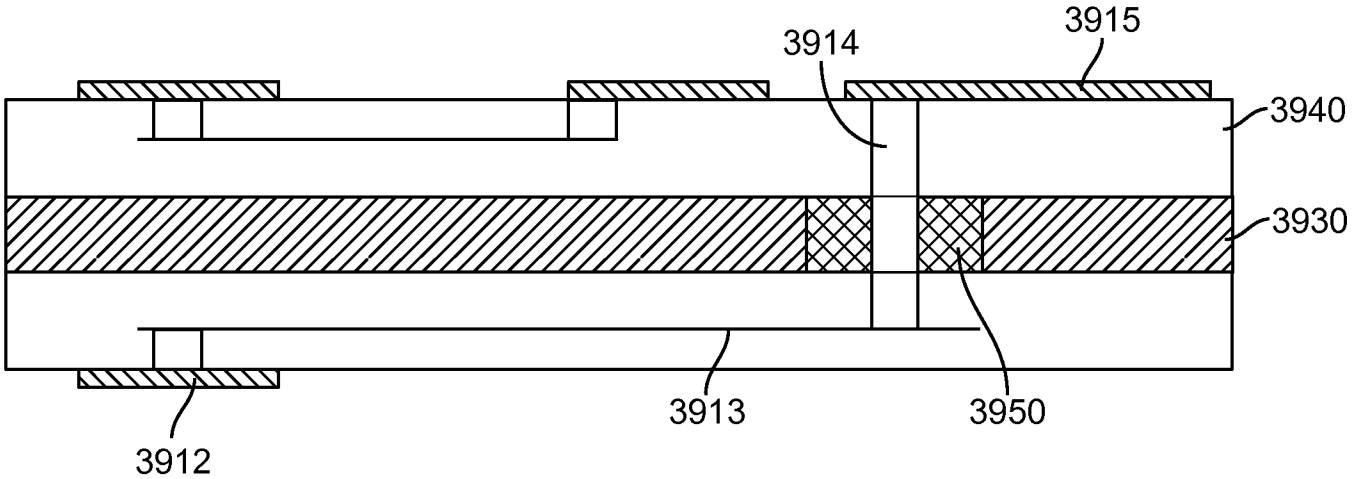
FIG. 39 illustrates a method of routing a signal in a time according to an embodiment of the present invention.

FIG. 39 illustrates a method of routing a signal in a time according to an embodiment of the present invention. In this example, contact 3912 may be electrically connected through interconnect 3913 and via 3914 to contact 3915. An isolation region 3950 may isolate via 3914 from metal core 3930. This isolation region may be formed of a resin or other material. Region 3950 may be formed before metal core 3930.

In other embodiments of the present invention, instead of forming a raised additional printed circuit board portion, a raised portion may be formed using injection molded plastic or other material. An example is shown in the following figure.

Figure 40:
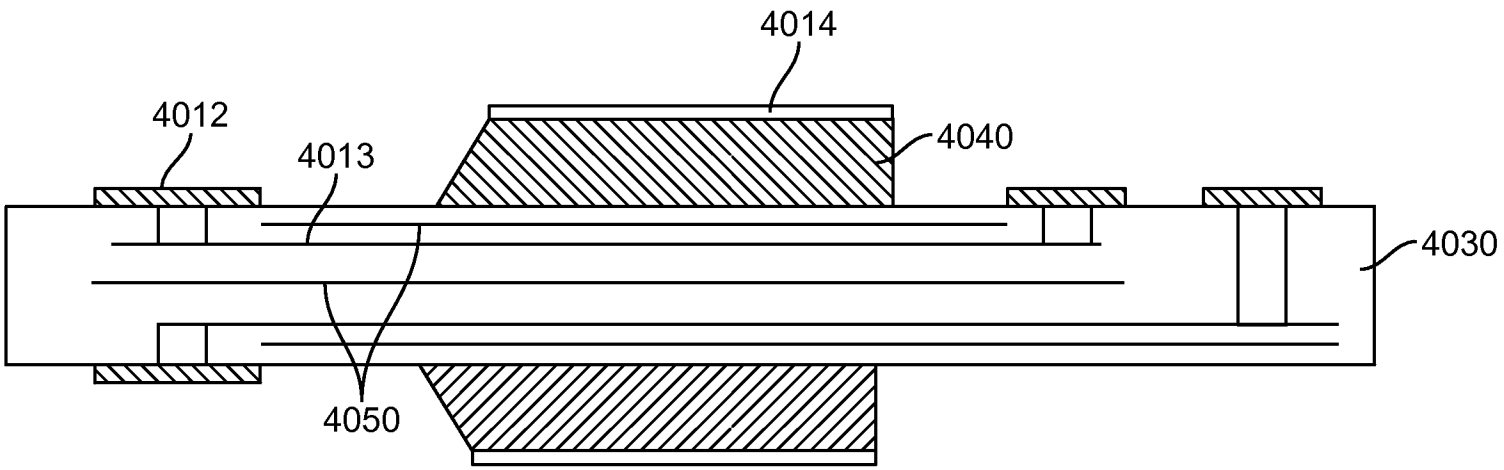
FIG. 40 illustrates a connector receptacle tongue according to an embodiment of the present invention.

FIG. 40 illustrates a connector receptacle tongue according to an embodiment of the present invention. In this example, contact 4012 may electrically connect to interconnect traces 4013 in printed circuit board 4030. A plastic molded portion 4040 may be plated to form ground contacts 4014. Ground traces 4050 may be used to isolate interconnect trace 4013.

In other embodiments of the present invention, printed circuit boards may be used to support contacts and interconnect, while a bulk of a tongue may be formed of plastic. An example is shown in the following figure.

Figure 41:
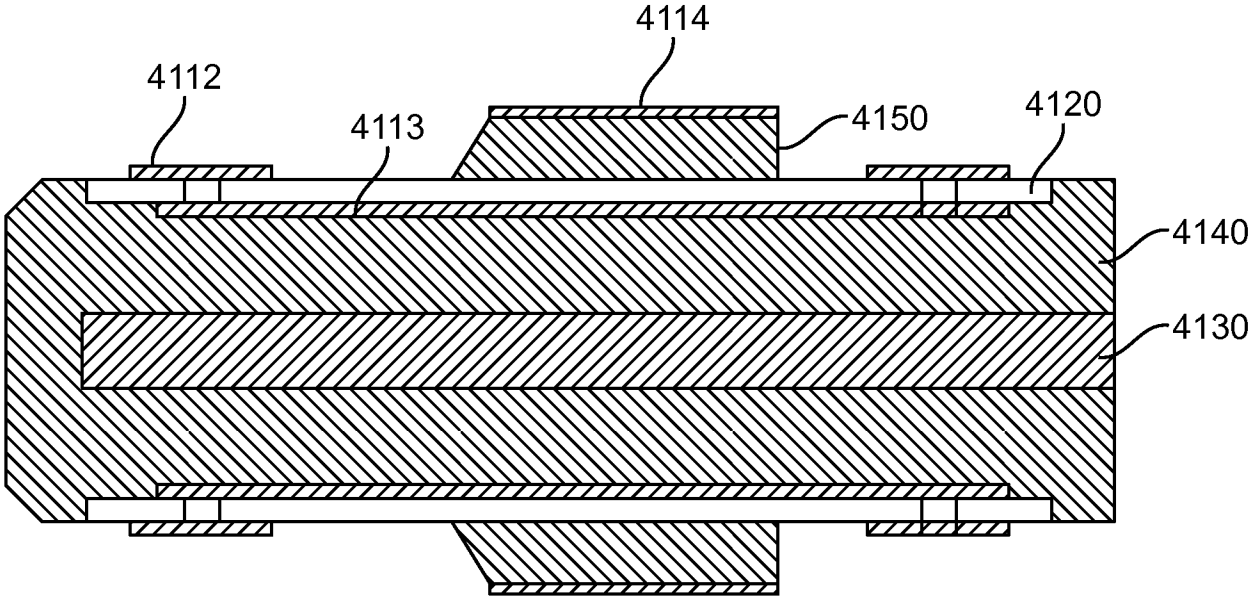
FIG. 41 illustrates a connector receptacle tongue according to an embodiment of the present invention.

FIG. 41 illustrates a connector receptacle tongue according to an embodiment of the present invention. In this example, plastic housing 4140 may be formed around a metal core 4130. Again, metal core 4130 may provide reinforcement and electrical isolation. Printed circuit boards 4120 may be molded in place or attached to plastic housing 4140. Printed circuit boards 4120 may support contacts 4112 and interconnect traces 4113. Second overmold portions 4150 may be formed and plated to form ground contacts 4114.

Figure 42:
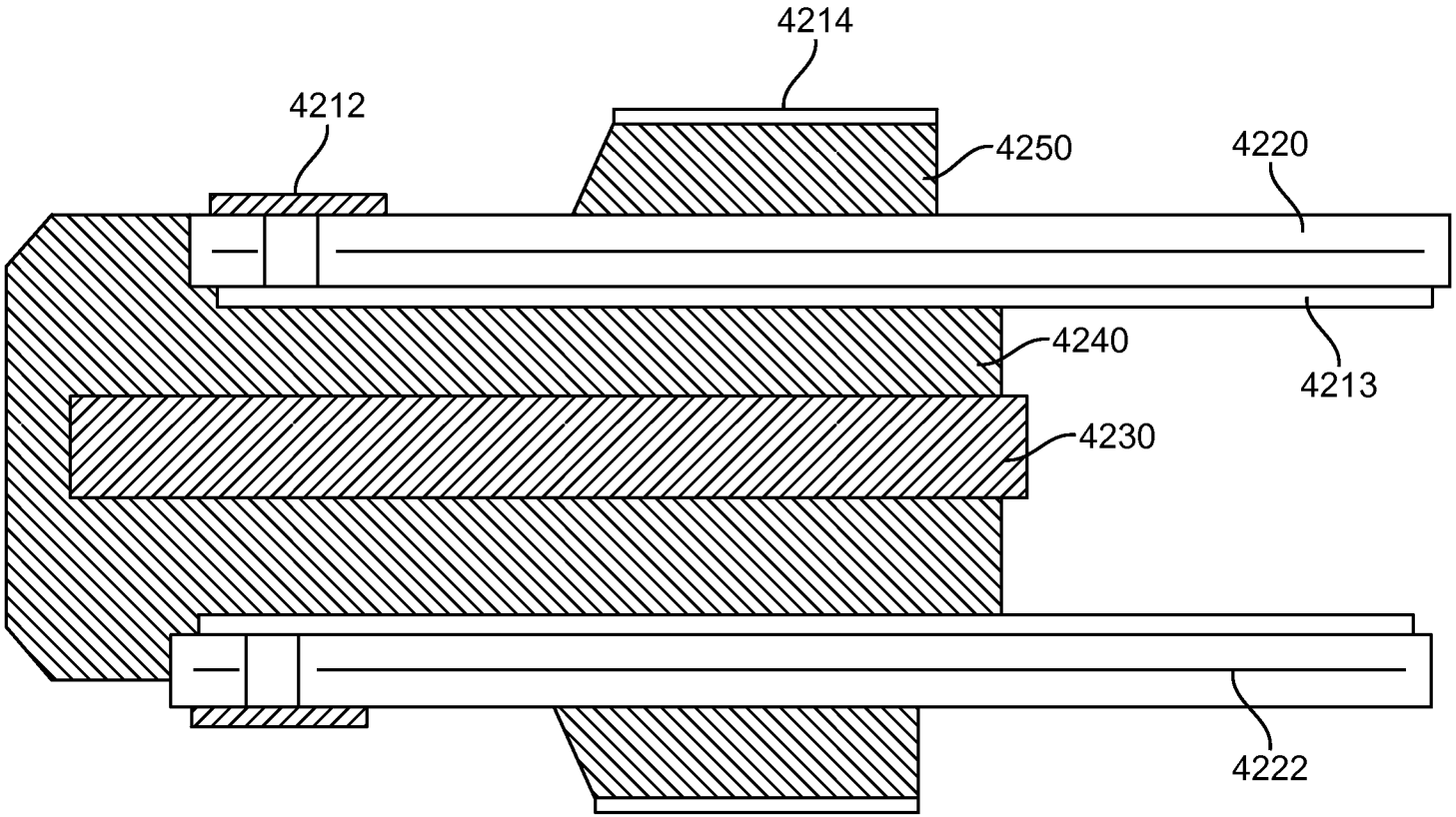
FIG. 42 illustrates another connector receptacle tongue according to an embodiment of the present invention.

FIG. 42 illustrates another connector receptacle tongue according to an embodiment of the present invention. In this figure, boards 4220 and metal core 4230 may be extended behind plastic molded portion 4240. This may allow easy access to interconnect traces 4213 and metal core 4230. This may be further enhanced by the substitution of flexible circuit boards for printed circuit boards for boards 4220. By making boards 4220 flexible circuit boards, traces 4213 may readily be interconnected to a printed circuit board, such as a main logic board, motherboard, or other appropriate substrate.

In other embodiments of the present invention, laser direct structuring may be used. Specifically, a laser may be used to define the positions of contacts and interconnect traces on a piece of LDS plastic. Contacts and traces may then be formed on the surface of the LDS plastic. An overmold at least partially around the LDS plastic may be used to form a tongue for a connector receptacle. An example is shown in the following figure.

Figure 43:
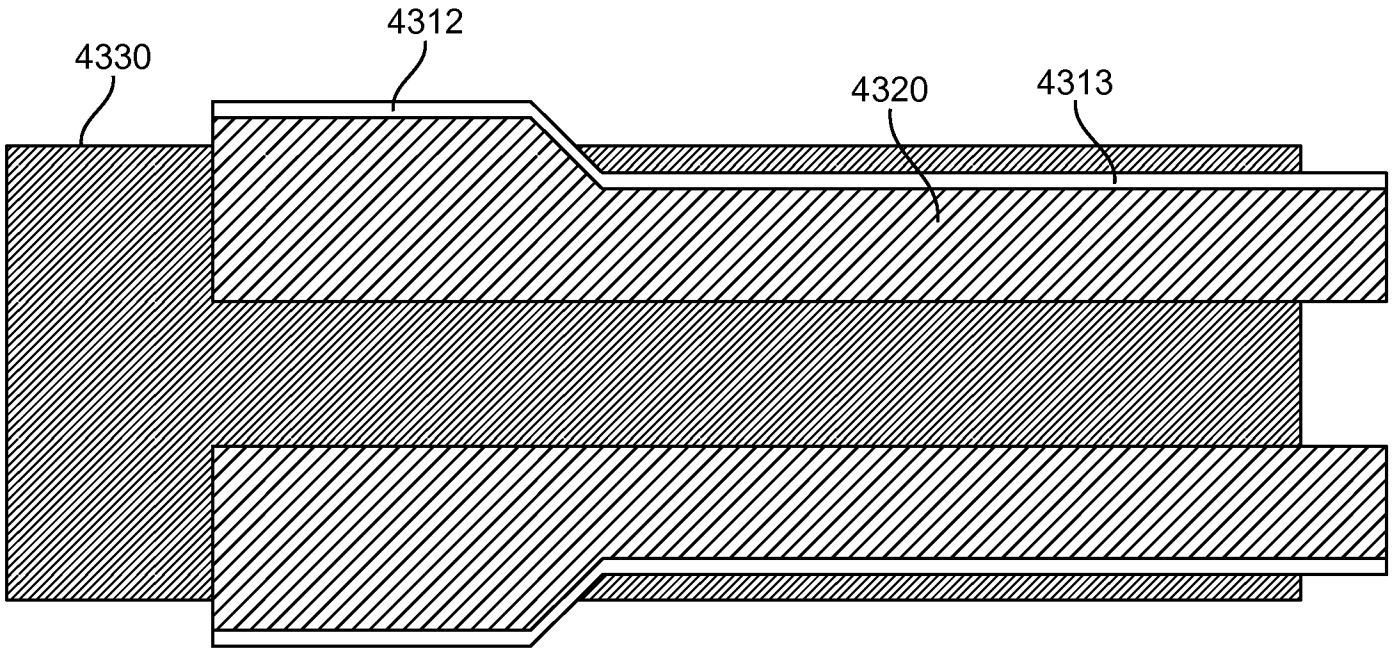
FIG. 43 illustrates a portion of a tongue for a connector receptacle according to an embodiment of the present invention.

FIG. 43 illustrates a portion of a tongue for a connector receptacle according to an embodiment of the present invention. Contacts 4312 and interconnect traces 4313 may be formed on a surface of LDS plastic 4320. Plastic overmold 4330 may be used to fix LDS plastic pieces 4320 in place and form a portion of the connector receptacle tongue.

Figure 44:
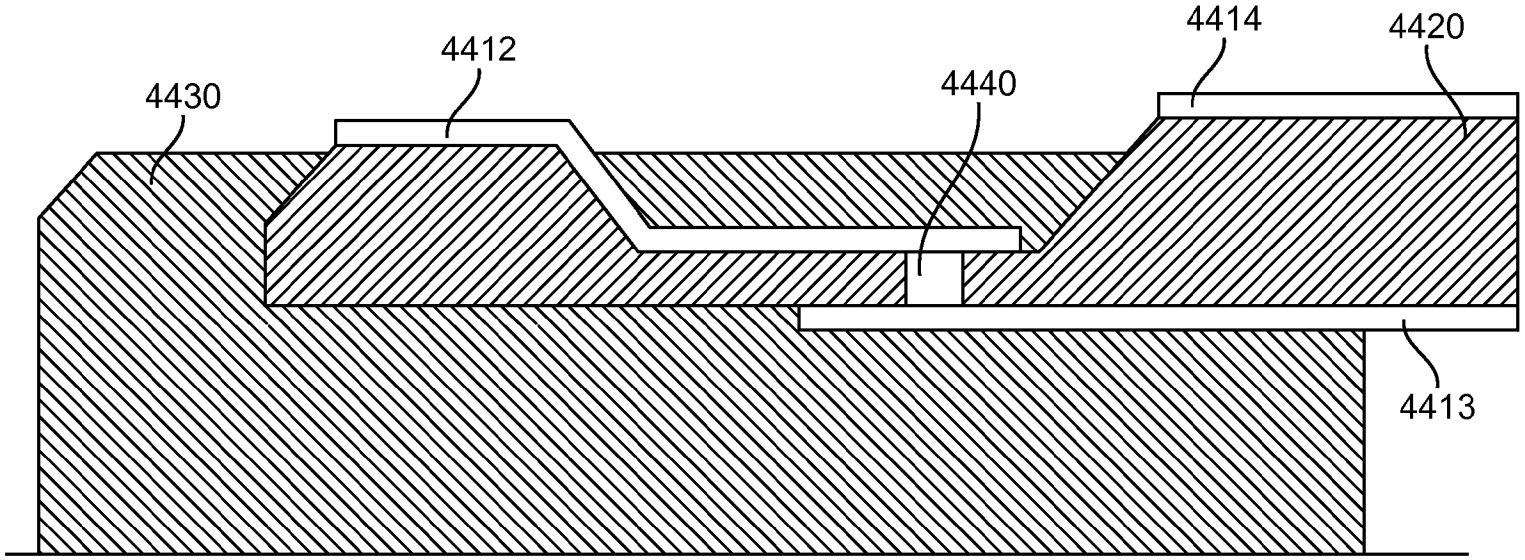
FIG. 44 illustrates another portion of a tongue for a connector receptacle according to an embodiment of the present invention.

FIG. 44 illustrates another portion of a tongue for a connector receptacle according to an embodiment of the present invention. Again, contacts 4412 and interconnect traces 4413, as well as ground pad 4414 may be formed on surfaces of LDS plastic 4420. A via 4440 may be used for signal interconnect. Plastic housing 4430 may be used to form a portion of the connector receptacle tongue. It should be noted that this figure illustrates a top half of a portion of a connector receptacle tongue. A symmetrical bottom portion may be included in an actual receptacle tongue.

Again, embodiments of the present invention may include reinforced tongues to prevent damage to a connector receptacle. An example is shown in the following figures.

Figure 45:
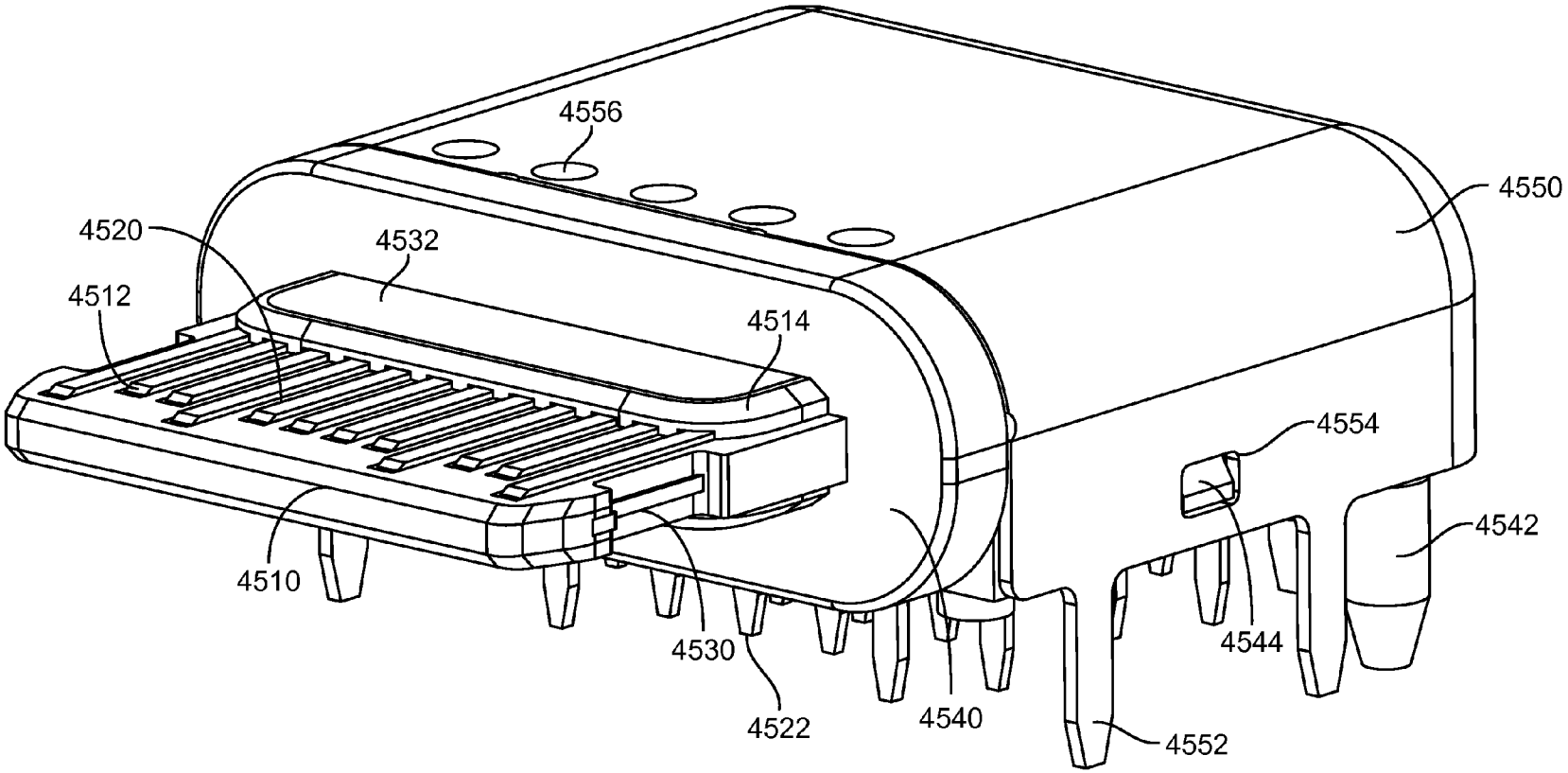
FIG. 45 illustrates a connector receptacle having a reinforced tongue according to an embodiment of the present invention.

FIG. 45 illustrates a connector receptacle having a reinforced tongue according to an embodiment of the present invention. This connector receptacle may include housing 4540. Tongue 4510 may be formed as part of housing 4540. Tongue 4510 may include a wider portion 4514. Tongue 4510 may include a number of slots or grooves 4512 for supporting contacts 4520. Contacts 4520 may terminate in through-hole contact portions 4522. Through-hole contact portions 4522 may fit in openings in a printed circuit board or other appropriate substrate and be attached to traces for conveying power, ground, signals, or other voltages or currents.

Housing 4540 may include posts 4542. Posts 4542 may be inserted into openings in a printed circuit board or other appropriate substrate for mechanical stability.

Housing 4540 may be at least partially covered by shield 4550. Shield 4550 may include opening 4554 for accepting a tab 4544 on a side of housing 4540. This may secure shield 4550 in place relative to housing 4540. Shield 4050 may further include tabs 4552 to fit in openings in a printed circuit board or other appropriate substrate. Tabs 4552 may connect to ground to provide shielding.

This connector receptacle may further include a central ground plane structure. This ground plane structure may provide side ground contacts 4530. Shield 4550 may be attached to a portion of the central ground plane structure by spot or laser welding at points 4556. The central ground plane structure may further include ground contacts 4532, which may reside on wider portion 4514 of tongue 4510.

Figure 46:
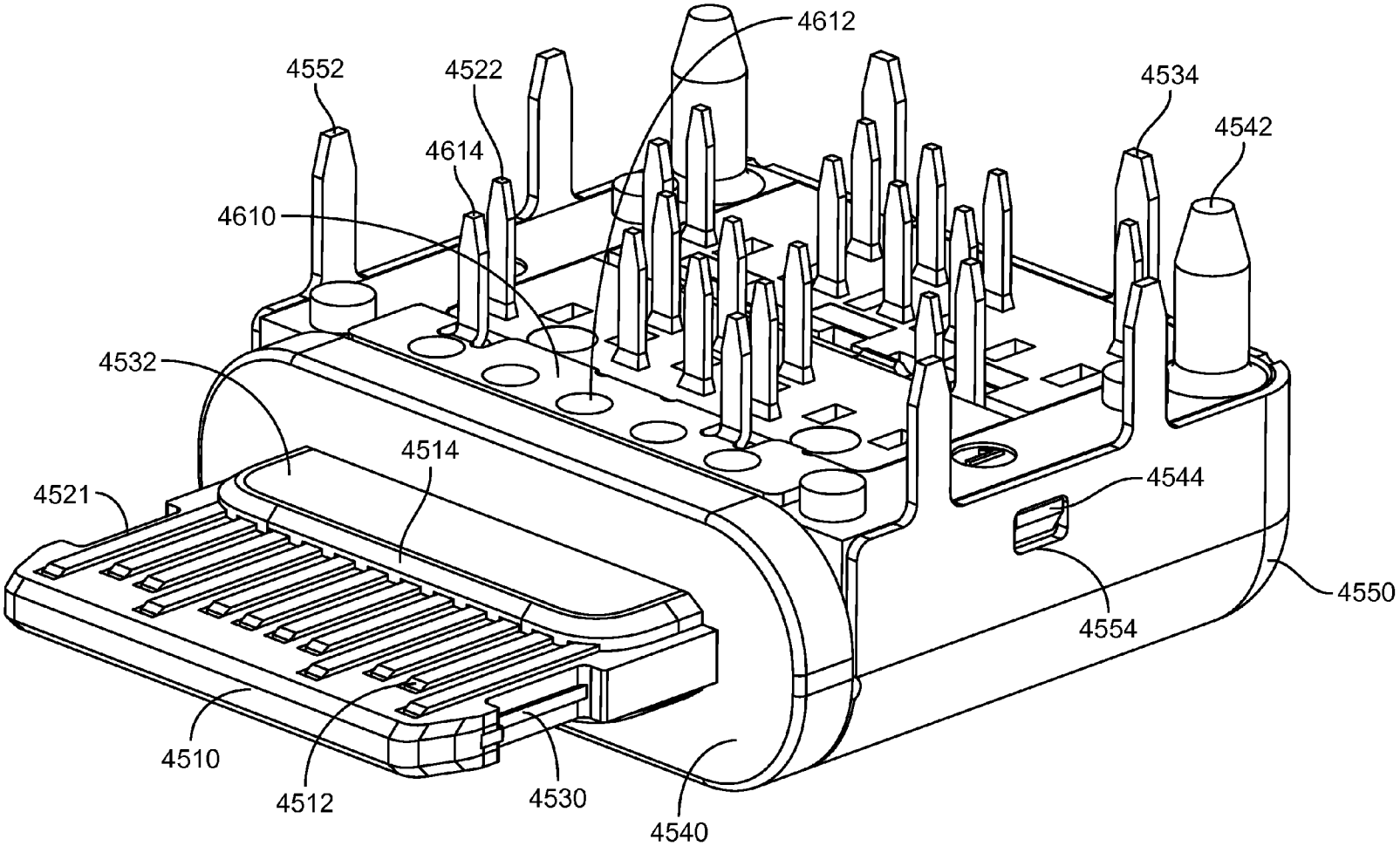
FIG. 46 illustrates an under side view of the connector receptacle of FIG. 45.

FIG. 46 illustrates an under side view of the connector receptacle of FIG. 45. As before, tongue 4510 may be formed as a portion of housing 4540. Housing 4540 may include posts 4542 to fit in openings in a printed circuit board or other appropriate substrate for mechanical stability. Housing 4540 may further include tabs 4544 to fit in openings 4554 of shield 4550. This may keep shield 4550 secured in place relative to housing 4540.

Tongue 4510 may include a number of slots or grooves 4512. Contacts 4520 may be located in slots or grooves 4512. Contacts 4520 may terminate in through-hole contact portions 4522. Side ground contacts 4530 may be formed as part of a central ground plane structure. The central ground plane structure may further include ground contacts 4532 and contacts 4534. Contacts 4534 may be arranged to fit in openings in a printed circuit board or other appropriate substrate, where they may be connected to ground for shielding and ground return purposes.

Shield portion 4610 may be located on an under side of the connector receptacle. Shield portion 4610 may connect to central ground plane structure by spot laser welding at points 4612. Shield portion 4610 may connect to ground in a printed circuit board or other appropriate substrate via contacts 4614.

Figure 47:
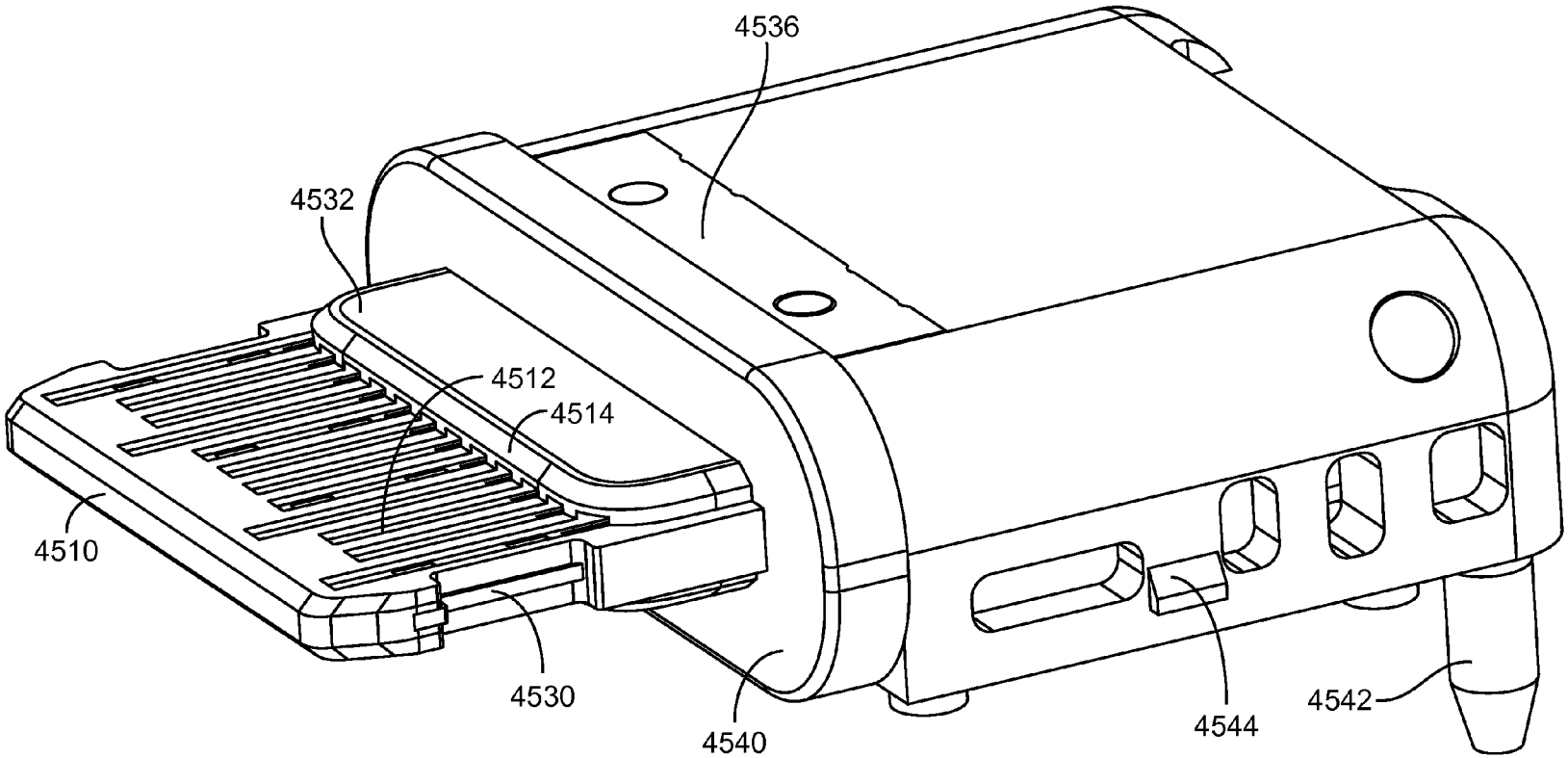
FIG. 47 illustrates a housing formed around a central ground plane structure according to an embodiment of the present invention.

FIG. 47 illustrates a housing formed around a central ground plane structure according to an embodiment of the present invention. As before, housing 4540 may include posts 4542 and tabs 4544. Tongue 4510 may be formed as part of housing 4540. Tongue 4510 may include a wider portion 4514 for supporting ground contacts 4532. Tongue 4510 may include a number of slots or grooves 4512 for accepting a plurality of contacts.

A central ground plane structure may include side ground contacts 4530 and ground contacts 4532. Upper contacts 4536 may also be included. A shield (not shown) may be attached to upper contact 4536 by spot or laser welding.

Figure 48:
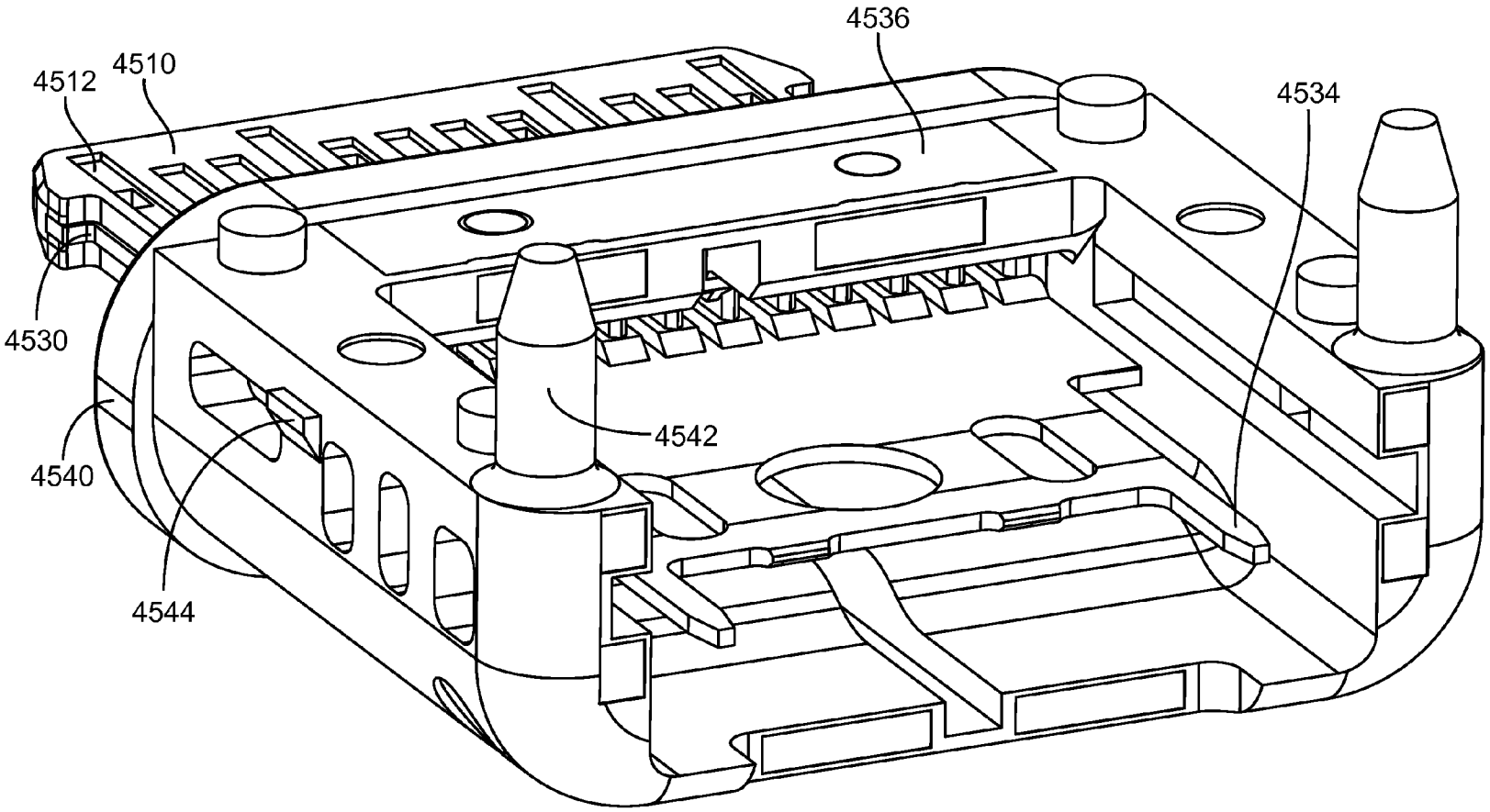
FIG. 48 illustrates an under side view of housing formed around a central ground plane structure according to an embodiment of the present invention.

FIG. 48 illustrates an under side view of housing formed around a central ground plane structure according to an embodiment of the present invention. Housing 4540 may include posts 4542 and tabs 4544. Tongue 4510 may be formed as part of housing 4540. Tongue 4510 may include slots or grooves 4512 for accepting a number of contacts.

A central ground plane structure may provide side ground contacts 4530 and upper contact 4536. The central ground plane structure may be grounded to a ground plane in a printed circuit board or other appropriate substrate via contacts 4534.

Figure 49:
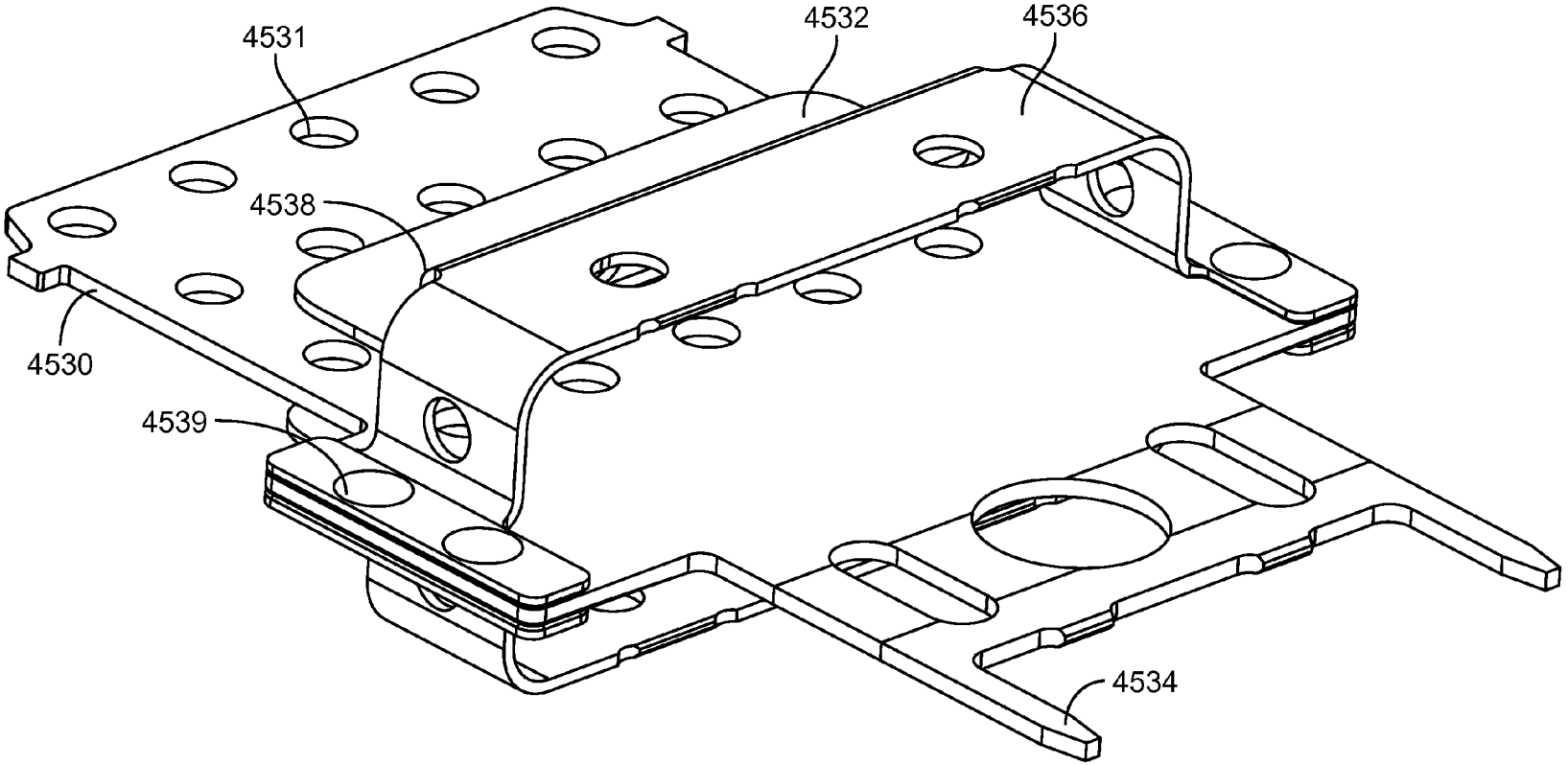
FIG. 49 illustrates a central ground plane structure according to an embodiment of the present invention.

FIG. 49 illustrates a central ground plane structure according to an embodiment of the present invention. Central ground plane structure may include a front portion including side ground contacts 4530. This front portion may include a number of openings 4531. Openings 4531 may be used to assist a flow of plastic during the formation of tongue 4510 and housing 4540. Also, by joining the plastic on each side of the central ground plane structure, the tongue may be made more robust. Upper ground portions 4536 may be attached at points 4539. The upper ground portions may include a downward portion 4538, which may be attached to ground contacts 4532. Downward portion 4538 may include a number of openings 4531 to assist the flow of plastic or other material during the formation of housing 4540. The central ground plane structure may include contacts 4534 for forming a ground connection to a printed circuit board or other appropriate substrate on which the connector receptacle resides.

Figure 50:
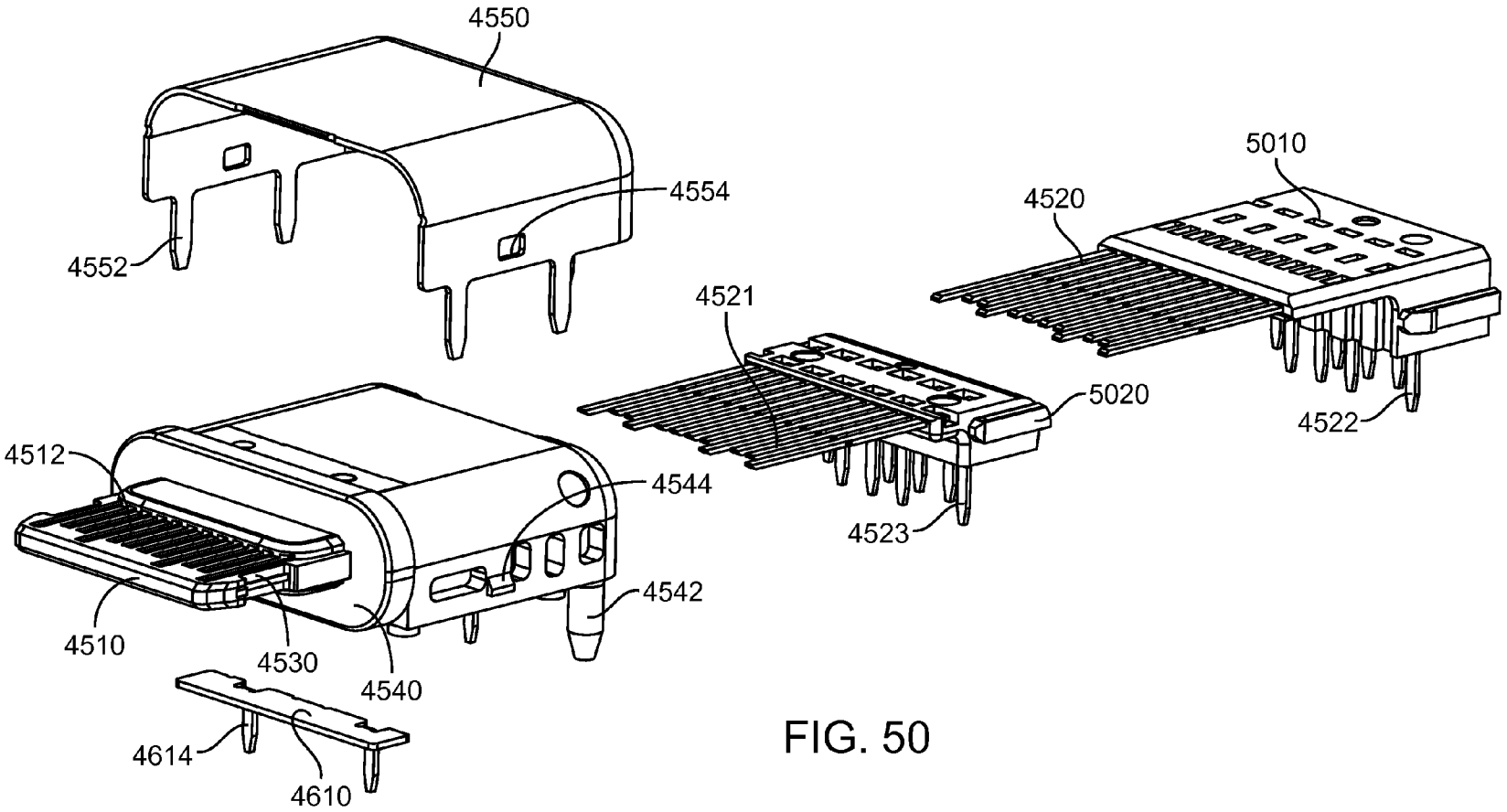
FIG. 50 is an exploded view of the connector receptacle of FIG. 45.

FIG. 50 is an exploded view of the connector receptacle of FIG. 45. As before, housing 4540 may include posts 4542 and tabs 4544. Tongue 4510 may be formed as part of housing 4540. Tongue 4510 may include a number of slots 4512. Contacts 4520 and 4521 may be inserted into housing 4540 such that contacts 4520 and 4521 are located in slots 4512 on a top and bottom of tongue 4510. Contacts 4520 and 4521 may terminate in contacting portion 4522 and 4523. Contacts 4520 and 4521 may be secured together by housing portions 5010 and 5020. Shield 4550 may fit over housing 4540 such that opening 4554 fits over or tab 4544. Shield 4550 may then be attached to the central ground plane structure by spot or laser welding as before. Shield portion 4610 may be attached to an underside of the connector receptacle and maybe spot or laser welded to the central ground plane structure.

Again, embodiments of the present invention may provide connector receptacle tongues having a frame or other structure for mechanical reinforcement. An example is shown in the following figures.

Figure 51:
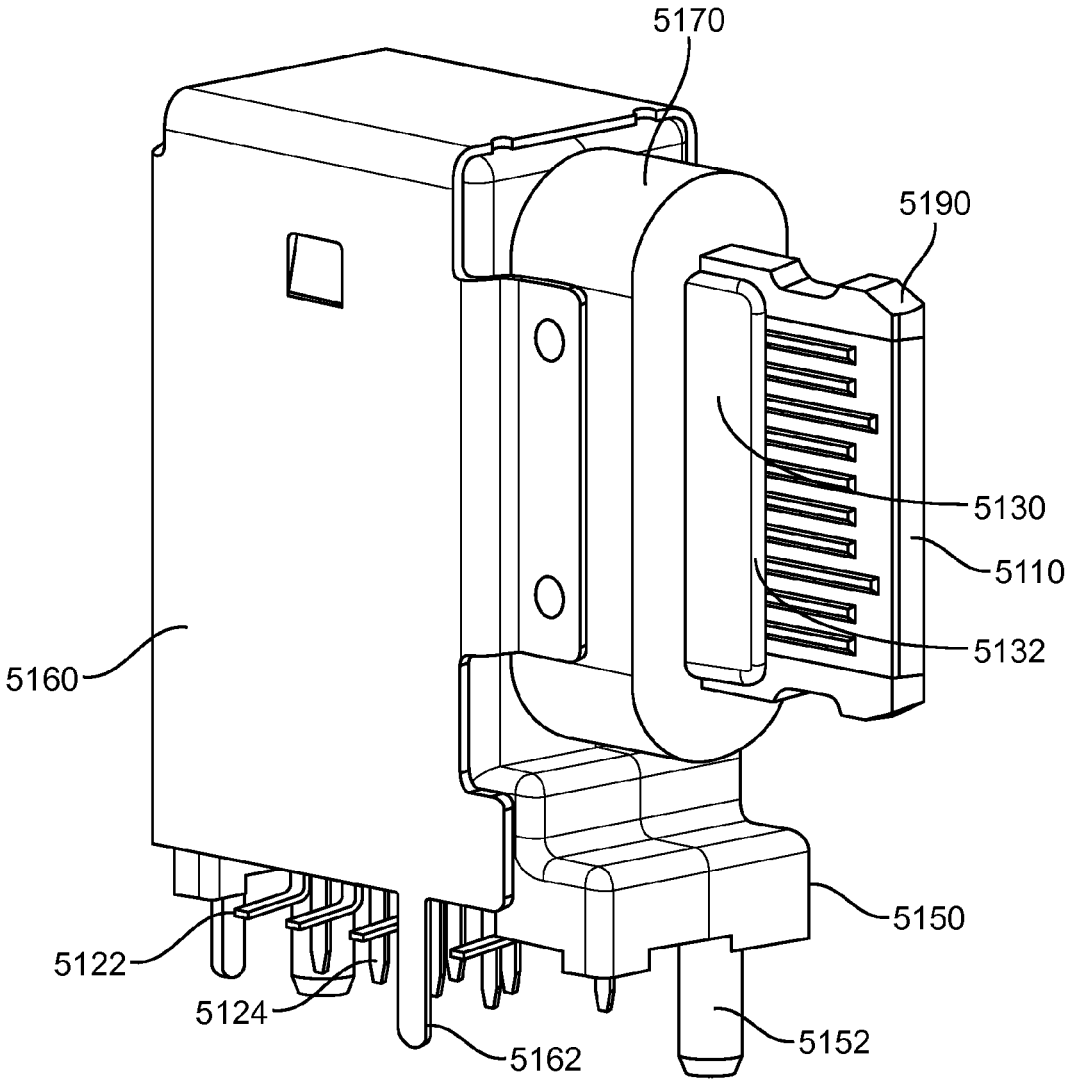
FIG. 51 illustrates a reinforced tongue on an interposer according to an embodiment of the present invention.

FIG. 51 illustrates a reinforced tongue on an interposer according to an embodiment of the present invention. In this example, tongue 5110 may be connected to housing 5150 via connecting portion 5170. Tongue 5110 may support a number of contacts 5120. Contacts 5120 may emerge from a bottom of the interposer as surface-mount contacting portions 5122 or through-hole-contacting portions 5124. Tongue 5110 may support ground contacts 5130 on a top and bottom side. Ground contacts 5130 may be isolated from contacts 5120 by portion 5132. Housing 5150 may include one or more posts 5152. Posts 5152 may be inserted into openings in a printed circuit board or other appropriate substrate for mechanical stability. Shield 5160 may substantially covered a rear, top, and left and right sides of housing 5150. Shield 5160 may include tabs 5162. Tabs 5162 may be inserted into openings in a printed circuit board or other substrate and be connected to ground traces or ground planes for shielding purposes.

Again, tongue 5110 may be relatively small and thin. This may otherwise result in a connector receptacle that is at least somewhat susceptible to damage. Accordingly, tongue 5110 may be formed having a frame for reinforcement purposes. This frame may form side ground contacts 5190. Further details of this frame are shown in the following figures.

Figure 52:
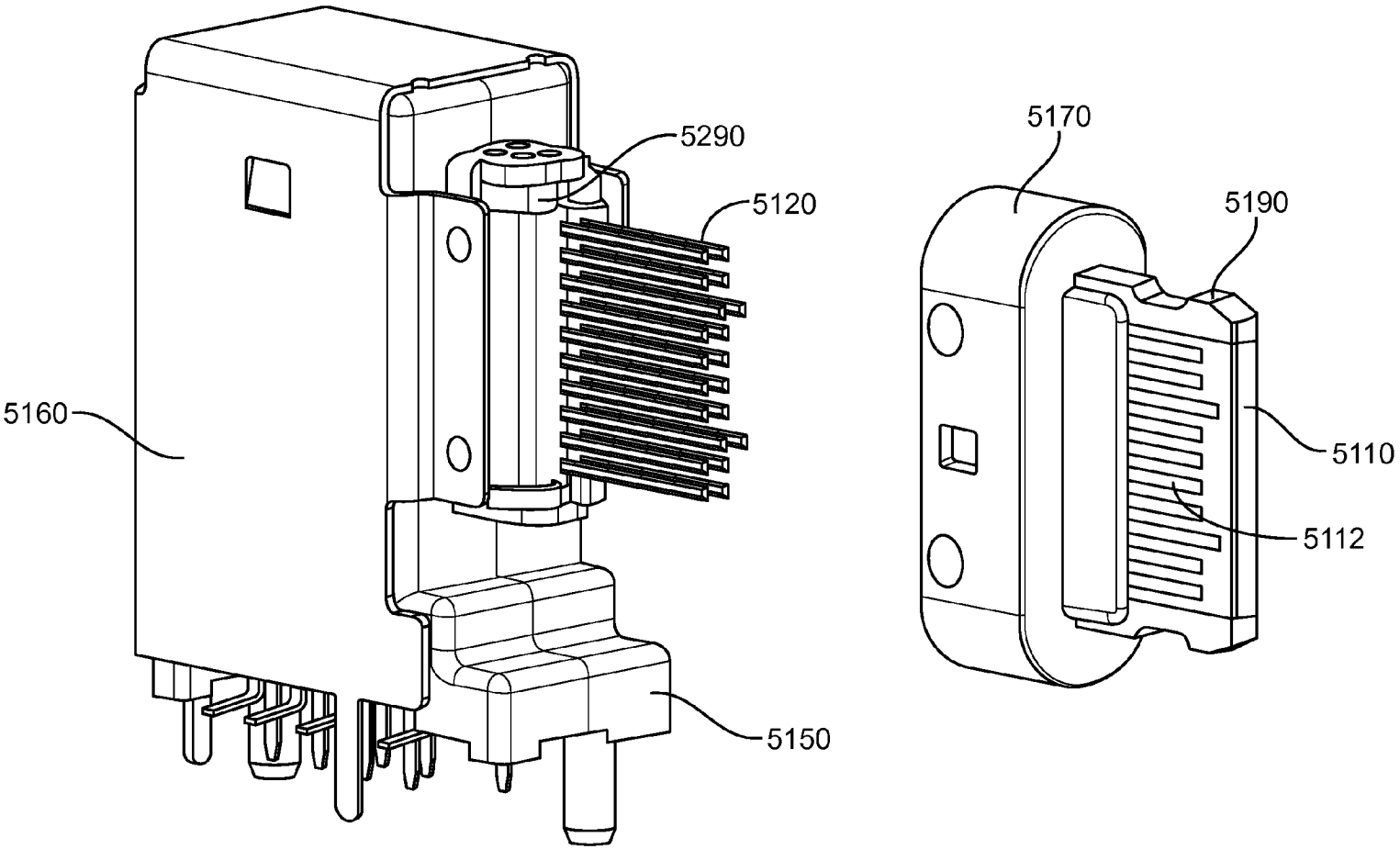
FIG. 52 illustrates a partially exploded view of the interposer of FIG. 51.

FIG. 52 illustrates a partially exploded view of the interposer of FIG. 51. Again, housing 5150 may be at least partially shielded by a shield 5160. Contacts 5120 may emerge from a front of housing 5150 such that they may be located on tongue 5110. Specifically, tongue 5110 may include a number of slots 5112 for accepting contacts 5120. Side ground contacts 5190 may be part of a frame providing reinforcement for tongue 5110. Connecting structure 5170 may be used to attach tongue 5110 to housing 5150. The frame including side ground contacts 5190 may be used to carry a large amount of ground current. This current may flow through side ground contacts through contacts 5290 to ground.

Figure 53:
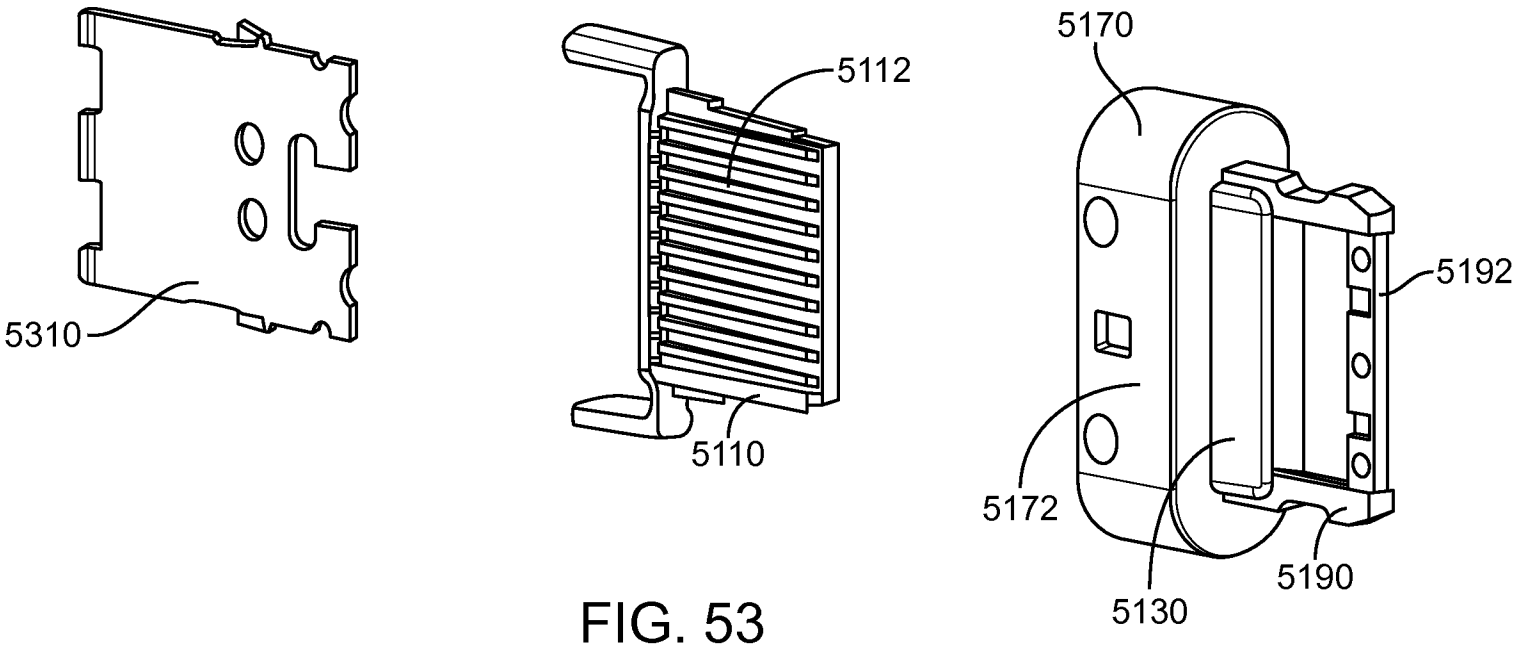
FIG. 53 illustrates an exploded view the tongue of the interposer of FIG. 51.

FIG. 53 illustrates an exploded view of a tongue for the interposer of FIG. 51. Tongue 5110 may include a central ground plane 5310. Central ground plane 5310 may fit in a center of tongue 5110. Tongue 5110 may include slots 5112 for receiving contacts 5120. Tongue 5110 may further include a frame 5190 attached to connecting portion 5170. Frame 5190 may include cross piece 5192. Cross piece 5192 may be exposed to form a front ground contact, or cross piece 5192 may be covered in plastic of tongue 5110. Side ground contacts 5190 may be exposed and may form electrical connections with retention contacts in the plug.

Tongue 5110 may be formed in different ways in various embodiments of the present invention. For example, frame 5190, cross piece 5192, ground contacts 5130, and connecting portion 5170 may be formed of a single piece of conductive material, such as metal. For example, the structure may be formed using metal injection molding, stamping, or other process. In one embodiment of the present invention, frame 5190, cross piece 5192, ground contacts 5130, and connecting portion 5170 may be formed of a single piece of conductive material using metal-injection molding, and ground contacts 5130 may have a thickness of only 0.15 mm. These structures may be formed of sheet metal or other material. Contacts 5120 and central ground piece 5310 may be attached and the insert molded portion for tongue 5110 may be formed. Again, the insert molded portion may be colored to match a color of a device enclosure. In other embodiments of the present invention, tongue 5110 may be inserted into frame 5190. Central ground piece 5310 may be inserted into a central opening in tongue 5110. Contacts 5120 may then be inserted into slots 5112 on tongue 5110.

Figure 54:
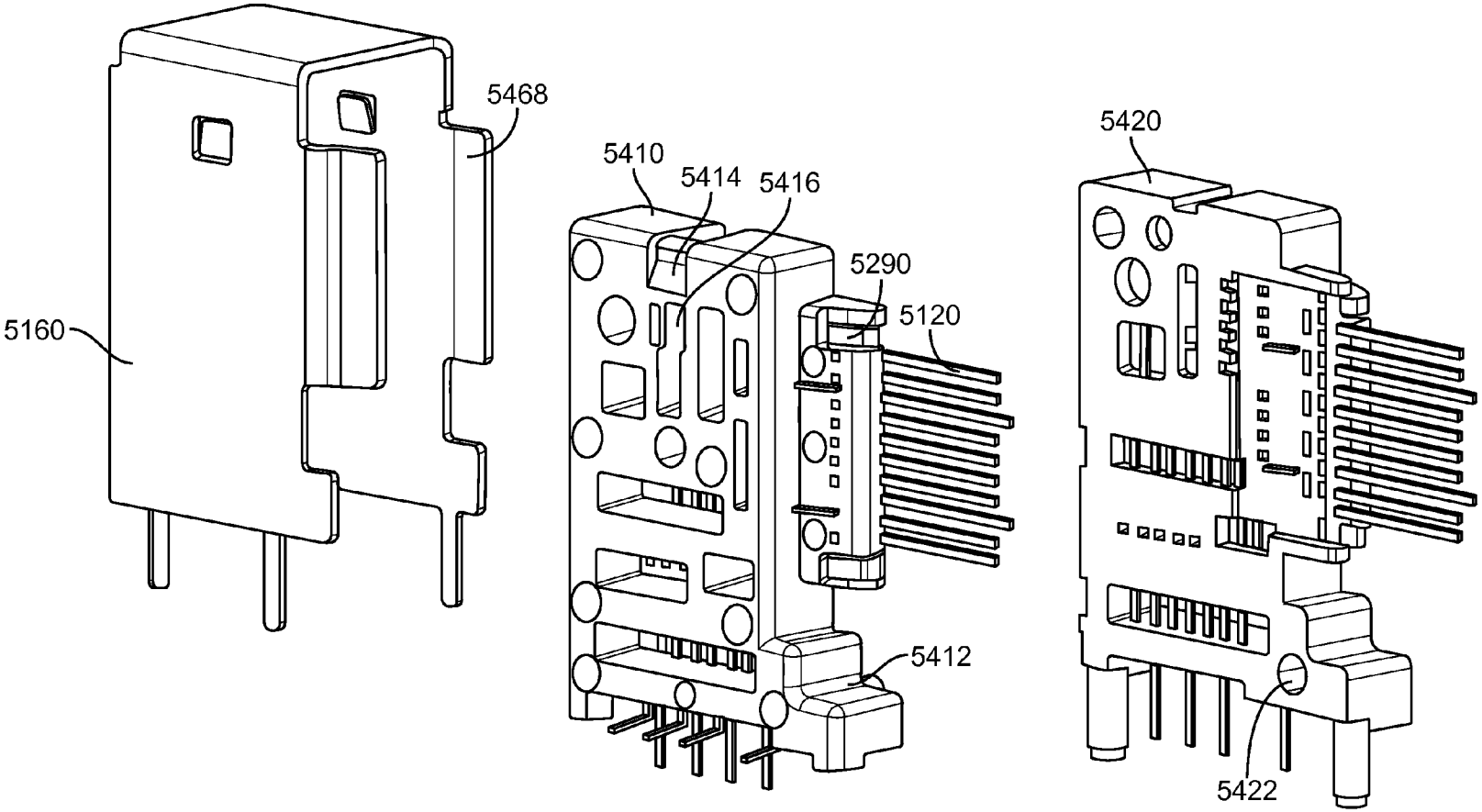
FIG. 54 illustrates a partially exploded view of the interposer of FIG. 51.

FIG. 54 illustrates a partially exploded view of the interposer FIG. 51. As in the above example, the housing may be formed in two pieces. Specifically, housing 5150 may be formed of housing portions 5410 and 5420. These housing portions 5410 and 5420 may be formed around contacts 5120. Posts 2712 on housing portion 5410 may be inserted into openings 5422 on housing portion 5420 to join housing portion 5410 to housing portion 5420. Shield 5160 may be fit over the top of housing portions 5410 and 5420. Tabs 5466 may fit over notches 5414 and into an opening 5416 to secure shield 5170 in place. Shield 5460 may include flaps 5468. Flaps 5468 may be attached to surfaces 5172 on connecting portion 5170. This attachment maybe formed by laser or spot welding, soldering, or other technique.

In various embodiments of the present invention including the examples shown, contacts, ground contacts, metallic pieces including metallic center pieces, and other conductive portions of a connector receptacle, such as the shell or shield, may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions may be formed using injection or other molding, 3-D printing, machining, or other manufacturing process. The nonconductive portions may be formed of silicon or silicone, rubber, hard rubber, plastic, nylon, liquid-crystal polymers (LCPs), or other nonconductive material or combination of materials. Again, the gaskets or grommets may be formed of various materials including, but not limited to, elastomers with low compression set. This may help to ensure consistent performance over the life of the connector receptacle. In specific embodiments of the present invention, the elastomers used may be silicone or urethane. The printed circuit boards used may be formed of FR-4 or other material. Various printed circuit boards shown and in other embodiments of the present invention may be replaced by other substrates, such as flexible circuit boards.

Embodiments of the present invention may provide connector receptacles that may be located in and may connect to various types of devices, such as portable computing devices, tablet computers, desktop computers, laptops, all-in-one computers, cell phones, smart phones, media phones, storage devices, portable media players, navigation systems, monitors, power supplies, adapters, remote control devices, chargers, and other devices. These connector receptacles may provide pathways for signals and power compliant with various standards such as Universal Serial Bus (USB), a High-Definition Multimedia Interface (HDMI), Digital Visual Interface (DVI), power, Ethernet, DisplayPort, Thunderbolt, Lightning and other types of standard and non-standard interfaces that have been developed, are being developed, or will be developed in the future.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector receptacle comprising:
- a tongue having a top and a bottom, the tongue comprising:
- a metallic piece, the metallic piece comprising:
  - side portions to form sides of the tongue, the sides between the top and bottom of the tongue;
  - a front cross-brace between and joining the side portions and near a front of the tongue; and
  - a first rear cross-brace on the top of the tongue and a second rear cross-brace on the bottom of the tongue and below the first rear cross-brace, the first rear cross-brace and the second rear cross-brace near a rear of the tongue and joining the side portions, wherein the first and second rear cross-braces are formed with the side portions and the front cross-brace as a single piece;
- a nonconductive insert portion in the metallic piece and around the front cross-brace; and
- a plurality of signal contacts on the nonconductive insert portion, the signal contacts having contacting portions between the first and second rear cross-braces and the front of the tongue.

2. The connector receptacle of claim 1 wherein outside, top, and bottom surfaces of the side portions of the metallic piece are exposed.

3. The connector receptacle of claim 2 further comprising a molding over the nonconductive insert portion and front cross-brace.

4. The connector receptacle of claim 1 wherein inner sides of the side portions each have a groove and the nonconductive insert portion is arranged to slide along the groves when the nonconductive insert portion is inserted into the metallic piece during assembly.

5. The connector receptacle of claim 1 wherein the metallic piece is formed using metal-injection molding.

6. The connector receptacle of claim 1 further comprising a first ground contact on the top of the tongue and contacting the first rear cross-brace and a second ground contact on the bottom of the tongue and contacting the second rear cross-brace.

7. The connector receptacle of claim 6 wherein the nonconductive insert portion is formed of injection-molded plastic.

8. The connector receptacle of claim 6 wherein the plurality of signal contacts comprises a first set of signal contacts between the first ground contact and the front of the tongue and a second set of signal contacts between the second ground contact and the front of the tongue.

9. The connector receptacle of claim 8 wherein the side portions are notched to engage a side ground contact on a connector insert when the connector insert is inserted into the connector receptacle.

10. The connector receptacle of claim 1 further comprising a central ground plane in a center of the tongue.

11. A connector receptacle comprising:
- a connecting portion;
- a tongue extending from the connecting portion and comprising:
- a metallic piece, the metallic piece comprising:
  - side portions extending from the connecting portion to form sides of the tongue; and
  - a cross-brace between the side portions; and
- a first ground contact on a top of the tongue and a second ground contact on a bottom of the tongue, the first ground contact and the second ground contact extending from the connecting portion;
- a nonconductive insert portion in the metallic piece;
- a plurality of signal contacts on the nonconductive insert portion, the signal contacts having contacting portions between the first and second ground contacts and a front of the tongue; and
- a molding over the nonconductive insert portion and the cross-brace.

12. The connector receptacle of claim 11 wherein the top and outside surfaces of the side portions of the metallic piece are exposed to form additional ground contacts on a top and bottom of the tongue.

13. The connector receptacle of claim 12 wherein the side portions and the cross-brace of the metallic piece formed as a single piece.

14. The connector receptacle of claim 11 wherein inner sides of the side portions each have a groove and the nonconductive insert portion is arranged to slide along the groves when the nonconductive insert portion is inserted into the metallic piece during assembly.

15. The connector receptacle of claim 14 wherein the metallic piece is formed using metal-injection molding.

16. The connector receptacle of claim 11 wherein the molding is formed of injection-molded plastic.

17. The connector receptacle of claim 16 further comprising a central ground plane in a center of the tongue.

18. A connector receptacle comprising:
- a tongue comprising:
- a metallic piece, the metallic piece comprising:
  - side portions forming side ground contacts along sides the tongue;
  - a front cross-brace along a front of the tongue and joining the side portions; and
  - a first rear cross-brace on a top of the tongue and a second rear cross-brace on a bottom of the tongue and below the first rear cross-brace, the first rear cross-brace and the second rear cross-brace near a rear of the tongue and joining the side portions, wherein the first and second rear cross-braces are formed with the side portions and the front cross-brace as a single piece;

a nonconductive insert portion in the metallic piece;

a plurality of signal contacts on a top and a bottom of the nonconductive insert portion;

a first ground contact on a rear portion of the top of the tongue; and a second ground contact on a rear portion of the bottom of the tongue.

19. The connector receptacle of claim 18 further comprising a molding over the nonconductive insert portion and the front cross-brace.

20. The connector receptacle of claim 18 further comprising a central ground plane in a center of the tongue.

* * * * *